US012723356B2

(12) United States Patent
Matys

(10) Patent No.: US 12,723,356 B2
(45) Date of Patent: Sep. 1, 2026

(54) STACKABLE INTERLOCKING STRUCTURAL FOAM BLOCKS FOR SUPPORTING PATIOS AND OTHER HARDSCAPE BLOCK SYSTEMS

(71) Applicant: Risi Stone Inc., Newmarker (CA)

(72) Inventor: Tyler Matys, Newmarket (CA)

(73) Assignee: Risi Stone Inc., Newmarket (CA)

( * ) Notice: Subject to any disclaimer, the term of this patent is extended or adjusted under 35 U.S.C. 154(b) by 150 days.

(21) Appl. No.: 18/887,840

(22) Filed: Sep. 17, 2024

(65) Prior Publication Data

US 2025/0101690 A1 Mar. 27, 2025

Related U.S. Application Data

(60) Provisional application No. 63/562,911, filed on Mar. 8, 2024, provisional application No. 63/540,350, filed on Sep. 25, 2023.

(30) Foreign Application Priority Data

Mar. 22, 2024 (CA) ..... CA 3232933

(51) Int. Cl.
*E01C 15/00* (2006.01)
*E01C 3/00* (2006.01)

(52) U.S. Cl.
CPC ..... *E01C 15/00* (2013.01); *E01C 3/003* (2013.01)

(58) Field of Classification Search
CPC ..... E01C 15/00; E01C 3/003; E01C 5/005; E01C 11/221; E01C 3/06; E01C 5/001; E01C 3/006; E04F 11/035; E02D 29/025; E02D 17/202; E02D 17/205; E02D 29/0266
See application file for complete search history.

(56) References Cited

U.S. PATENT DOCUMENTS 4,524,551 A * 6/1985 Scheiwiller ..... E02D 29/025 52/592.6
5,163,261 A * 11/1992 O'Neill ..... E02D 29/0225 52/592.6
5,257,880 A * 11/1993 Janopaul, Jr. ..... E02D 29/025 52/562
6,536,994 B2 * 3/2003 Race ..... E02D 29/0241 405/262
6,857,825 B1 * 2/2005 Morrell ..... E02D 29/025 405/286
9,512,594 B2 * 12/2016 Callewaert ..... E02D 29/0266
11,035,118 B2 * 6/2021 Gamarekian ..... E04B 2/34
2005/0108973 A1 * 5/2005 Hammer ..... E04C 1/395 52/596
2007/0110523 A1 * 5/2007 Rainey ..... E02D 29/025 405/286

(Continued)

FOREIGN PATENT DOCUMENTS

CA 3194410 A1 * 8/2023
EP 1862597 A1 * 12/2007 ..... E02D 29/025

*Primary Examiner* — Patrick J Maestri
(74) *Attorney, Agent, or Firm* — Dickinson Wright LLP; Matthew D. Powell

(57) ABSTRACT

Described herein are various examples of stackable interlocking support blocks formed of rigid foam, for forming single- and multi-course support systems for assembling hardscape raised patios and/or stairs, and stair and patio systems including such support systems.

12 Claims, 39 Drawing Sheets

(56) References Cited

U.S. PATENT DOCUMENTS

| | | | | |
|---|---|---|---|---|
| 2009/0304458 | A1* | 12/2009 | Chang | E02B 3/127<br>405/284 |
| 2011/0203212 | A1* | 8/2011 | Matys | E04F 13/0816<br>52/562 |
| 2011/0243669 | A1* | 10/2011 | Friederichs | E02D 29/025<br>52/600 |
| 2021/0108390 | A1* | 4/2021 | Matys | E02D 29/0266 |

* cited by examiner

STACKABLE INTERLOCKING STRUCTURAL FOAM BLOCKS FOR SUPPORTING PATIOS AND OTHER HARDSCAPE BLOCK SYSTEMS

CROSS-REFERENCE TO RELATED APPLICATION

This application claims priority to U.S. Provisional Patent Application Ser. No. 63/540,350 entitled "EXTERIOR PATIO STRUCTURAL FRAMEWORK USING HIGH DENSITY STYROFOAM" filed on Sep. 25, 2023, to U.S. Provisional Patent Application Ser. No. 63/562,911 entitled "MODULAR LIGHTWEIGHT STRUCTURAL FILL SYSTEM USED IN CONJUNCTION WITH A SEGMENTAL RETAINING WALL" filed on Mar. 8, 2024, and to Canadian Patent Application No. 3,232,933 entitled "STACKABLE INTERLOCKING STRUCTURAL FOAM BLOCKS FOR SUPPORTING PATIOS AND OTHER HARDSCAPE BLOCK SYSTEMS" filed on Mar. 22, 2024. The contents of each of these related applications is incorporated by reference herein.

FIELD OF THE INVENTION

The present disclosure relates generally to hardscape construction, and more particularly to techniques and systems useful for constructing patios and other hardscape block systems from modular precast concrete blocks.

BACKGROUND OF THE INVENTION

For many years, landscape contractors have constructed outdoor raised patios and steps to enhance property quality, utility, attractiveness and/or to provide pedestrian access to buildings in instances of significant changes in grade.

While various techniques for constructing outdoor patios and steps are known, including uses of hardscape blocks, improvements are desirable.

SUMMARY OF THE INVENTION

In accordance with an aspect, there is provided a stackable interlocking support block comprising: a rigid foam body comprising: a top side and a bottom side opposite the top side; a front side and a rear side opposite the front side; and a first side and a second side opposite the first side; a geogrid interface integral with the top side and comprising: an apron having an outer periphery that is adjacent to the first side, the front side, and the second side, the apron having an inner periphery spaced from the outer periphery; and a channel adjacent to and extending along the inner periphery of the apron, the channel having an open top; and a vertical interlock system integral with the rigid foam body and comprising: a top side interlocking structure associated with the top side and comprising, from the channel to the rear side, a first plurality of ridges each parallel to the front side and having a front-rear depth of Wk, each of the first plurality of ridges spaced from each other by a gap having a front-rear depth of Wg; and a bottom side interlocking structure associated with the bottom side and comprising, from the front side to the rear side, a second plurality of ridges each parallel to the front side and having the front-rear depth of Wk, each of the second plurality of ridges spaced from each other by a gap having the front-rear depth of Wg.

In accordance with another aspect, there is provided a male-type connector for horizontally interlocking a plurality of stackable interlocking support blocks, the male-type connector comprising: a proximal head; a distal head; a neck extending between the proximal head and the distal head; a first threaded female receptacle in the proximal head and dimensioned to receive a respective threaded fastener; and a second threaded female receptacle in the distal head and dimensioned to receive a respective threaded fastener.

Various examples are described.

BRIEF DESCRIPTION OF THE FIGURES

Examples will now be described more fully with reference to the accompany drawings, in which.

DETAILED DESCRIPTION OF THE EXAMPLES

The present application is directed to stackable interlocking support blocks formed of rigid foam, such as an expanded polystyrene (EPS) product, a polyisocyanurate product, and/or an extruded polystyrene (XPS) product, for forming single- or multi-course support systems for assembling hardscape patios and/or stairs, and to patio and stair systems including such single- or multi-course support systems along with multiple concrete blocks adjacent to and/or supported thereby.

For many years, landscape contractors have elevated the grades on a property using grade separation techniques such as filling and constructing retaining walls. Traditionally, grades have been elevated, to create raised patios or landings, using common gravel fill in conjunction with some type of retaining wall or slope stabilization system.

While raised patios can be constructed of wood, steel, or other materials, one common method of constructing raised patios involves using precast concrete retaining wall blocks or natural stone blocks to create a patio perimeter, and filling the space inside the perimeter with compacted gravel fill. For example, in the case of a raised patio adjacent to an existing building such as a residence, a square or rectangular box may be formed with blocks by stacking the blocks to form walls on three sides, with a fourth side of the box being provided by the residence itself. The interior of the formed box is then typically filled with compacted gravel, and blocks are positioned adjacent to each other in a layer within the box that is atop the compacted gravel, to form the upper surface of the patio.

Figure 1:
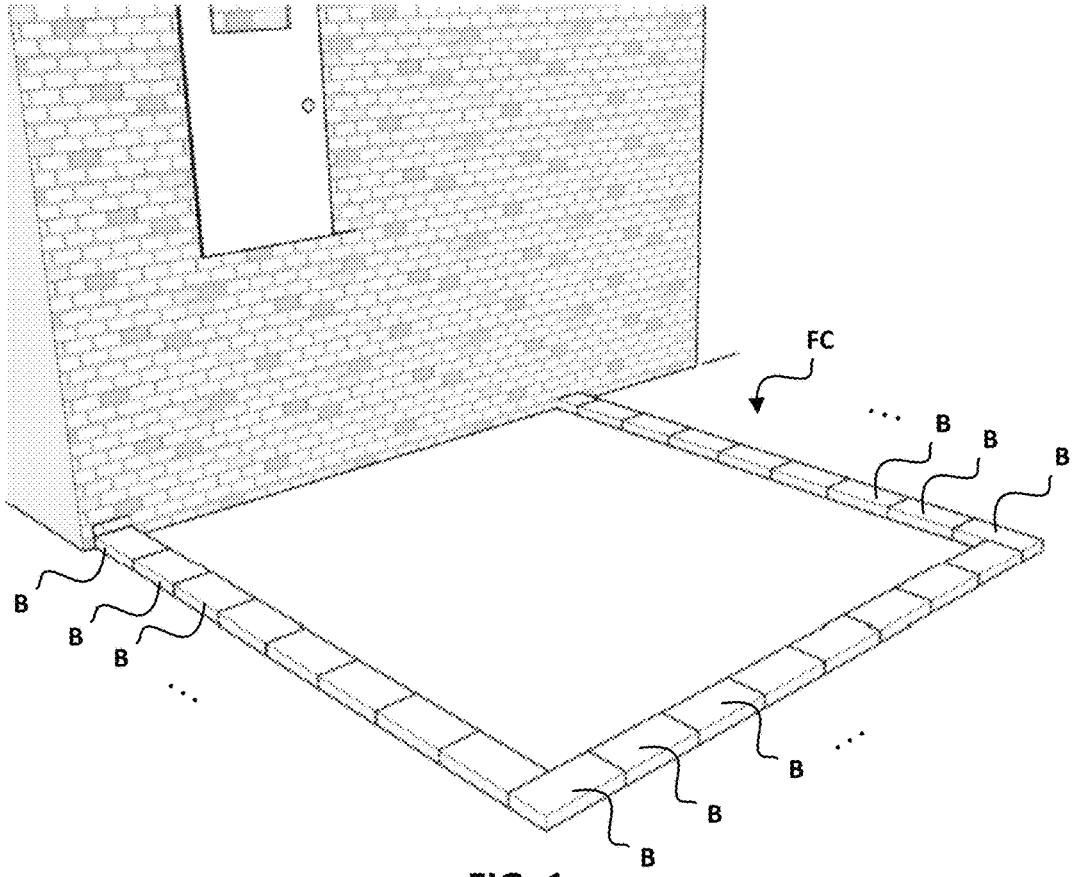
FIG. 1 (Prior Art)
FIG. 1 is a front perspective view of a building and a first, or base, course of retaining wall blocks for a raised patio being constructed adjacent to the building, in accordance with the prior art.
Figure 2:
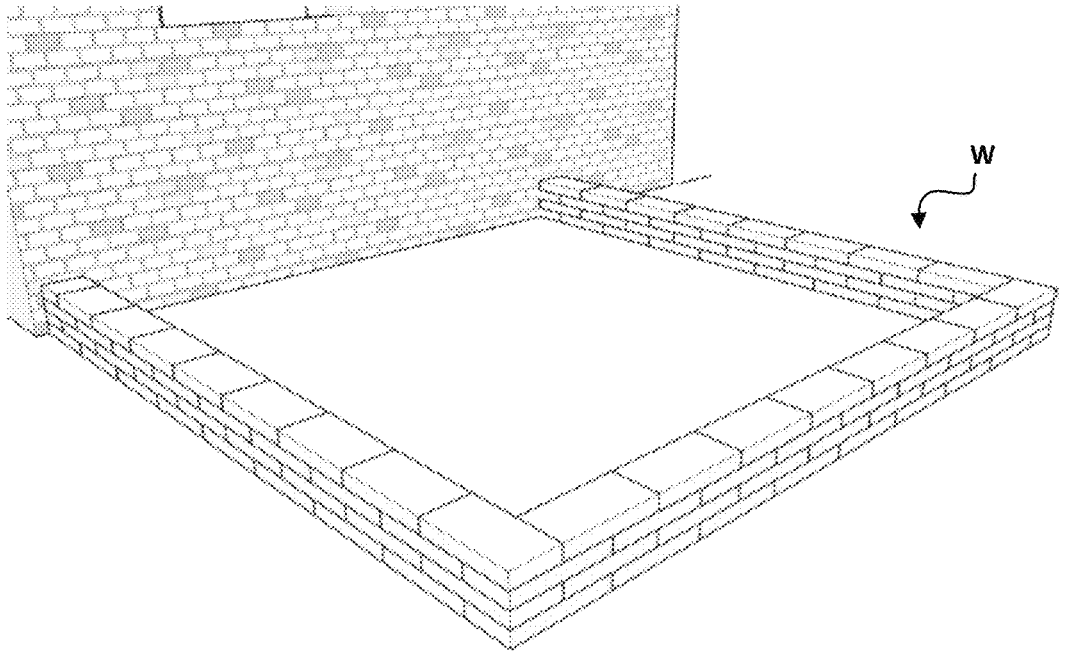
FIG. 2 (Prior Art)
FIG. 2 is a front perspective view of the building of FIG. 1 along with additional courses of retaining wall blocks for the wall of a raised patio being constructed adjacent to the building, in accordance with the prior art.
Figure 3:
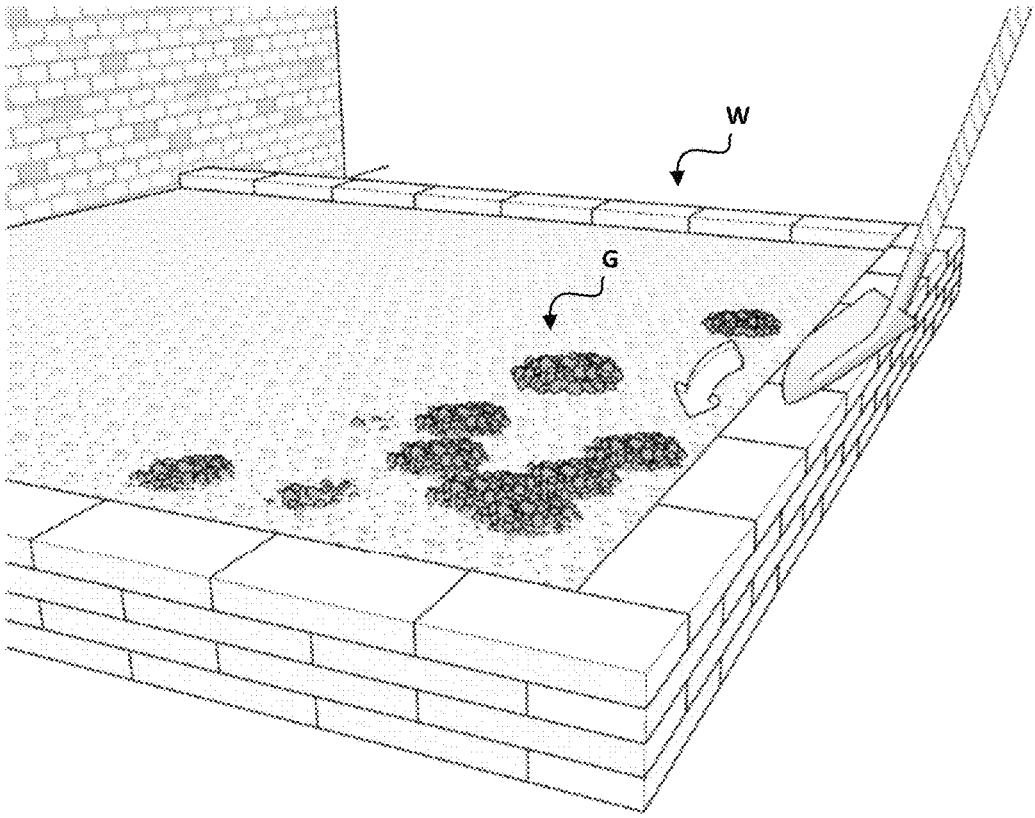
FIG. 3 (Prior Art)
FIG. 3 is a front perspective view of the building and wall of FIG. 2, with a box formed by the building and the wall being filled with backfill material such as gravel, in accordance with the prior art.
Figure 4:
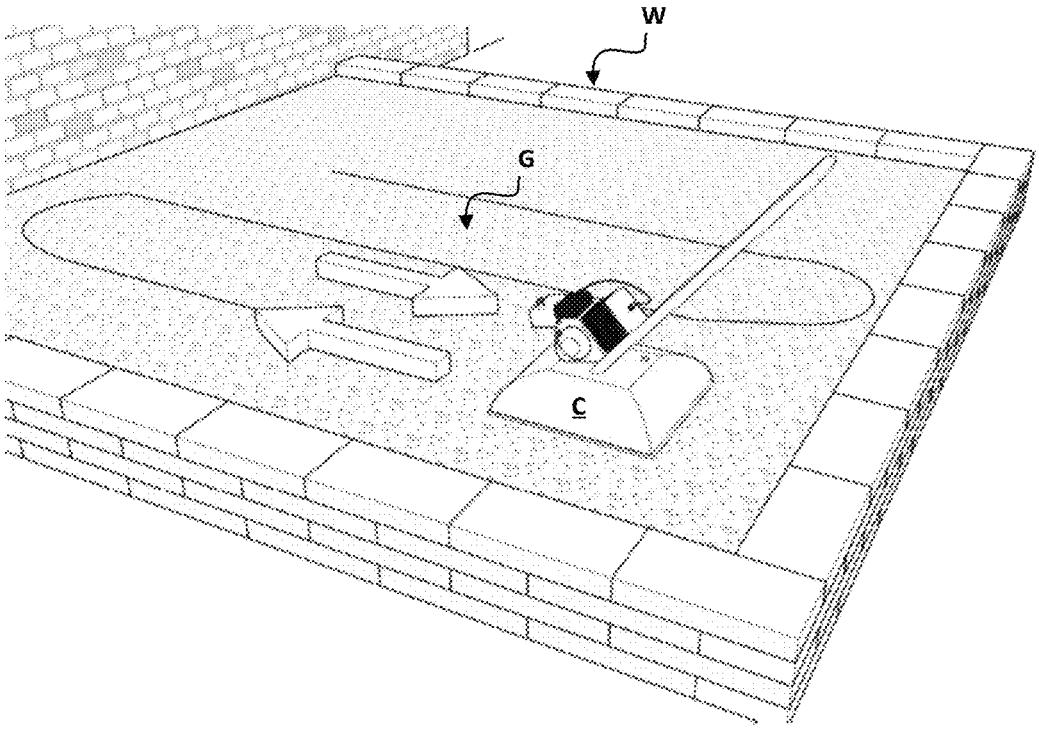
FIG. 4 (Prior Art)
FIG. 4 is a front perspective view of the building and wall of FIG. 3, with the backfill material in the box being progressively compacted, in accordance with the prior art.

FIG. 1 is a front perspective view of a building and a first (or "base") course FC of retaining wall blocks B, formed by levelling and aligning the retaining wall blocks B to form a box with the building, in accordance with the prior art. Once the base course FC is in place, additional courses can be stacked atop the base course and progressive courses to form a wall W of desired height, as shown in the front perspective view of FIG. 2. It is generally recommended in the hardscape construction industry to not stack retaining wall blocks B to more than 0.6 m (meters) before backfilling and compacting within the wall W. For this, gravel backfill is placed into the interior of the box to create the "fill" that raises the grade, as shown in the perspective view of FIG. 3. Typically, this process involves transporting the gravel G to the wall W with machines and/or manually using, for example, a wheelbarrow. The gravel G is placed within the wall W and compacted as thoroughly as possible. This is typically done with a mechanical plate compactor C, and in lifts of 150 mm-200 mm at a time, to ensure the required density is achieved, as shown in the perspective view of FIG. 4. Backfilling and compacting is often a very time-consuming and labor-intensive process. This is particularly so when the perimeter walls are already partially-constructed (as shown in the figures), because access to the interior of the wall W by machines for transporting and thoroughly compacting is restricted.

Figure 5:
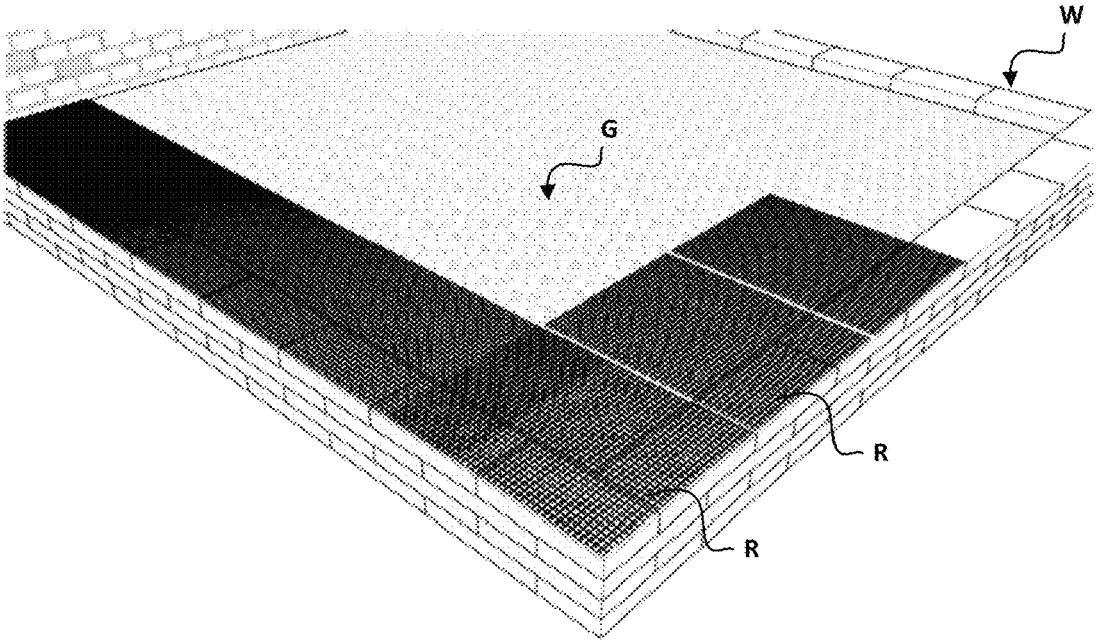
FIG. 5 (Prior Art)
FIG. 5 is a front perspective view of the building and wall of FIG. 4, with the topmost course of the wall and a portion of the backfill material in the box being covered with a geogrid material, in accordance with the prior art.

Furthermore, it may be the case that retaining wall blocks B are not themselves sufficiently large/heavy to, when stacked, resist movement outwards due to the lateral pressure imparted by the gravel G to the inside surface of the wall W. For aid with resistance of such lateral pressure, it is typical to use a geogrid material to reinforce the wall W, thus creating a geogrid-reinforced segmental retaining wall. Geogrid material is a flexible mesh material that has a very high tensile strength. During installation, the geogrid material is extended atop the topmost course of the partially-built retaining wall W, covered by one or more courses of retaining wall blocks B, and pulled taut inwardly a distance atop the current level of gravel G. It is typical to extend geogrid material back a distance equal to 60-70% of the wall height H. The geogrid material is thereafter covered in the interior of the wall with additional compacted gravel G. The geogrid serves to tie the wall W back into the gravel G, thus creating a composite mass. Installation of pieces of geogrid R atop a fourth course of wall W and gravel G is shown in the perspective view of FIG. 5.

Figure 6:
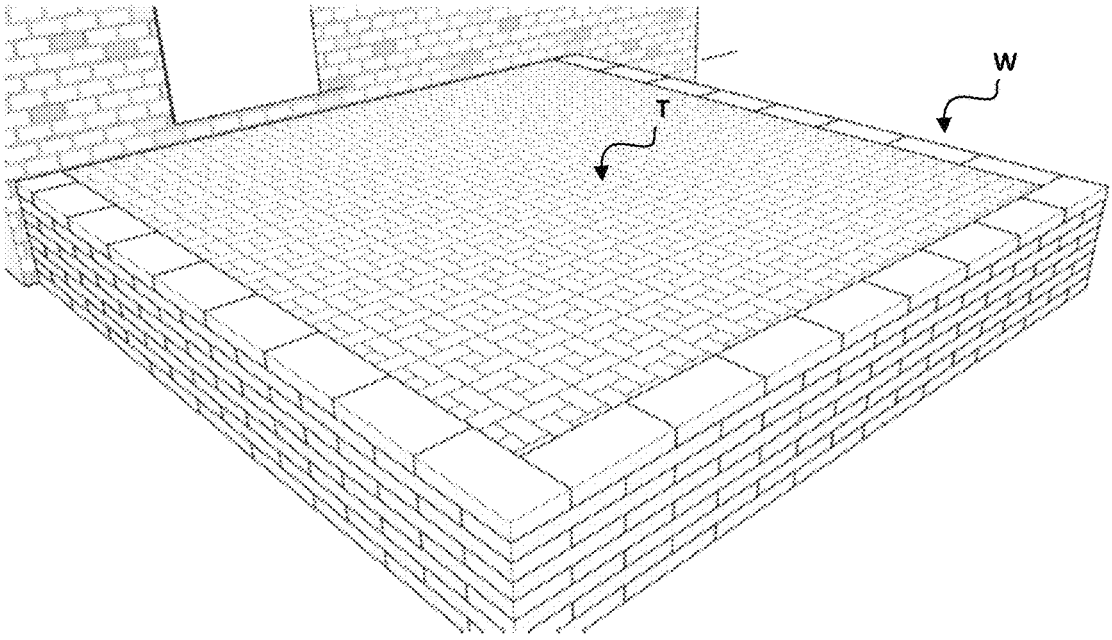
FIG. 6 (Prior Art)
FIG. 6 is a front perspective view of the building and completed raised patio, with additional courses of the wall having been placed atop the geogrid material, additional backfill material having placed atop the geogrid material and compacted, and the top surface of the raised patio having been formed from paving stones placed atop the compacted backfill material, in accordance with the prior art.

The process of stacking blocks, backfilling and compacting the gravel fill material, and laying geogrid layers continues until the desired grade/elevation of patio is achieved. With each course of retaining wall block for the wall W, compaction of the gravel G (or whatever material is used for fill) must be carefully conducted to ensure the proper density that will avoid settling/sinking over time. Finally, the top surface T of the patio area is typically finished with paving stones, as shown in the perspective view of FIG. 6. Construction of hardscape steps may be similarly conducted.

While methods for constructing raised patios and steps such as that described above are very common, they do present a number of drawbacks. For example, the volume of fill required for a raised patio area can be significant and, in many cases, the logistics and labor involved in moving what could be tons of gravel fill material into place are considerable. In particular, for a residential construction project, the gravel fill is typically dumped in front of the residence, on the street and/or the front lawn. This takes up a great deal of space and may require special permits or even temporary traffic control measures. If access to the construction site is limited, which is common in residential subdivisions, the large volumes of gravel fill can only be moved small amounts at a time, using wheelbarrows or small excavation equipment. Moving many cubic meters of gravel fill material in this manner is time-consuming and labor-intensive, and is accordingly expensive.

Furthermore, because with the method described herein perimeter walls are partially constructed prior to the backfill material being placed and compacted within the interior of the space, access to the interior space for putting the backfill material inside is limited by the walls themselves. Often, machines cannot be used to place the backfill material and spread it throughout, requiring that this be done manually. Again, this contributes to the very time consuming and labour intensive nature of such methods.

Still further, compaction of the backfill material is crucial to the stability and long-term integrity of the raised patio. Compaction should be conducted in accordance with industry specifications, and be based on the type of material being used, compaction equipment, optimum water content, and lift thickness. However, some aspects of the important process of compaction may not be conducted properly by a given contractor, resulting in the required density of the backfill material not being achieved. As a result, over time, the backfill material can undergo settlement, resulting in turn in an uneven patio surface and/or structural integrity issues.

In addition, the gravel fill material being of significant weight can, when placed onsite, affect the foundation soils and place significant pressure against the existing structure adjacent to which the raised patio is to be constructed. It is quite common, particularly in new construction of residential homes, for the soil surrounding the foundation walls of the homes to not be "engineered fill", in that it is not placed and compacted carefully as should be done. As a result, when the additional weight of a raised patio (i.e. potentially tons of gravel fill material as well as the weight of the blocks themselves) is placed on these relatively loosely-placed foundation soils, the overall structure will typically undergo additional settlement until the house foundation soils are compressed sufficiently to resist further movement. Again, this can result in a change in the required elevation of the patio, leading to trip hazards, an excessive step height for entering the residence, differential settlement and/or an uneven walking/stepping surface. Furthermore, in addition to the vertical force, the gravel fill applies a lateral force to the wall of the building adjacent to which it is being constructed. As raised patios are often added following the construction of the house, this additional lateral load tends not to have been accounted for by the house designer, and could cause foundation or other problems to arise.

It is an object of an aspect of this description to obviate or mitigate one or more of the above-described disadvantages of raised patio and step construction.

In the present description, particular configurations of stackable interlocking support blocks formed of rigid foam and having density and size sufficient to underfill and support a patio surface and/or stairs made of concrete or stone blocks, are described and shown in interaction to form a multi-course support system for constructing hardscape raised patios and stairs. In the present description, each of these stackable interlocking support blocks formed of rigid foam will be referred to as a modular structural fill block, or "MSFB". Multiple MSFBs may be arranged together, as will be described, as a single or multi-course fill and support system that will be referred to in this description as a modular structural fill system, or "MSFS". A patio system and/or a stair system may therefore include a respective MSFS integrated with a plurality of hardscape blocks, such as concrete or stone blocks. In general, the MSFB and the MSFS's formed from multiple of the MSFB can be used instead of much or all of the gravel or other traditional backfill material, while additionally obviating or mitigating one or more of the above-described disadvantages.

In an example, and as will be described in more detail, the MSFB is a modular unit that is designed to be stacked and interlocked both vertically and horizontally (or "laterally") with other like MSFBs to create a functionally solid, lightweight, and rigid MSFS for elevating the existing grades on a worksite.

U.S. Pat. No. 8,662,787 to Sawyer et al. discloses a paving system for paving or flooring includes a top layer of a plurality of paving elements, and an underlayment support layer of a polymeric material configured into panels. The panels are suitable to support the paving elements, the panels having a generally planar support surface and a recovery characteristic such that a deformation from a concentrated compressive load applied for a short duration returns the support surface to a generally planar condition. The patent describes using flat panels to be laid in a single horizontal layer to replace the typical amount of base material using to construct a paving stone patio. Such flat panels are specifically taught to be used only in a single layer for the purpose of actually reducing any required base thickness, and as such are not suitable for applications that require raising grade or elevation, vertical interlocking, or the like.

Similarly, U.S. Pat. No. 8,827,590 to Sawyer et al. discloses a paving system for paving or flooring includes a top layer of a plurality of paving elements, and an underlayment support layer of a polymeric material configured into panels. The panels are suitable to support the paving elements, the panels having a generally planar support surface. However, this patent also teaches that flat panels are to be used only in a single horizontal layer for the purpose of actually reducing required base thickness, and as such are also not suitable for applications that require raising grade or elevation, vertical interlocking, or the like.

Figure 7:
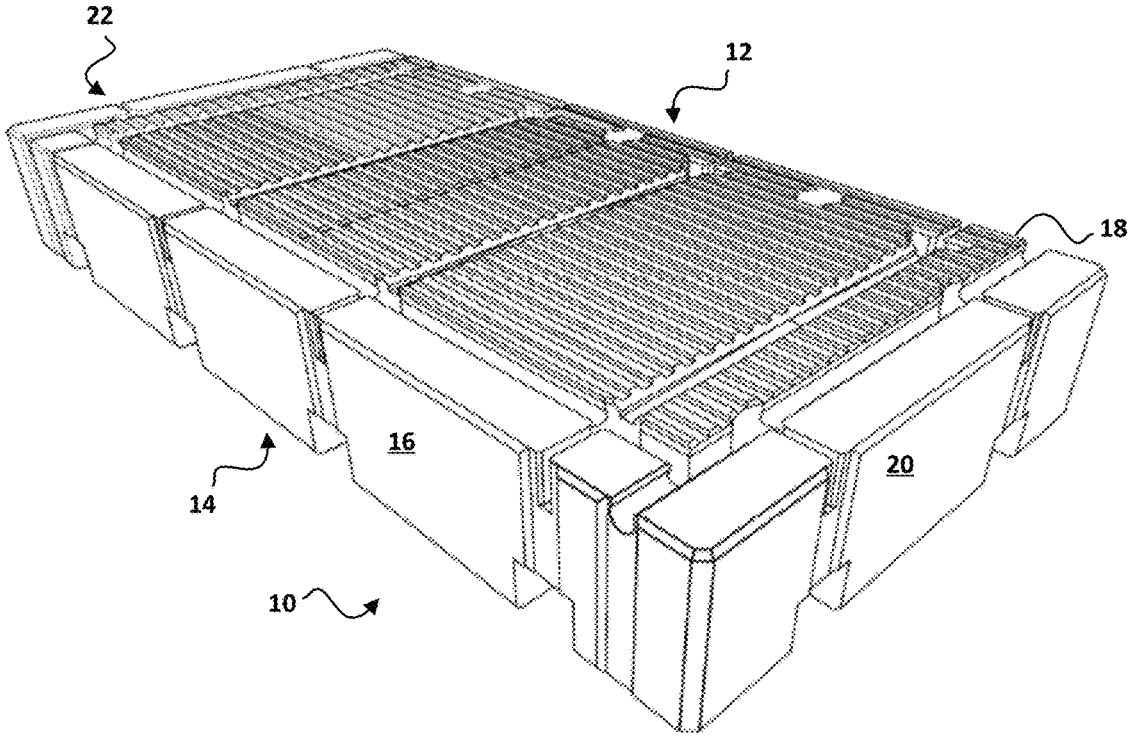
FIG. 7 is a front perspective view of a modular structural fill block (or "MSFB"), in accordance with an aspect of the present description.
Figure 8:
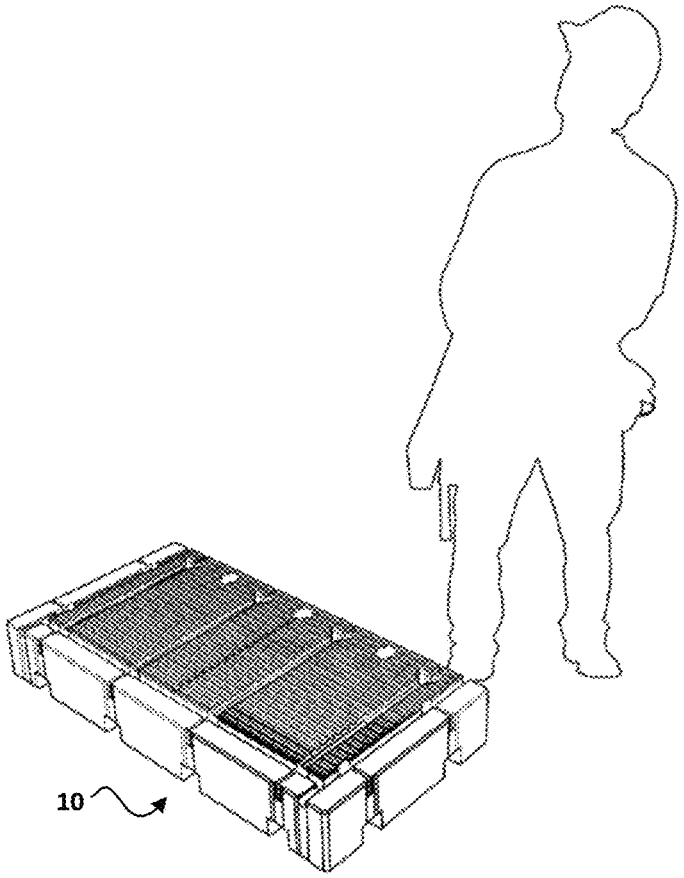
FIG. 8 is a front perspective view of the MSFB of FIG. 7 shown next to a person for a perspective of size, in accordance with an aspect of the present description.
Figure 9:
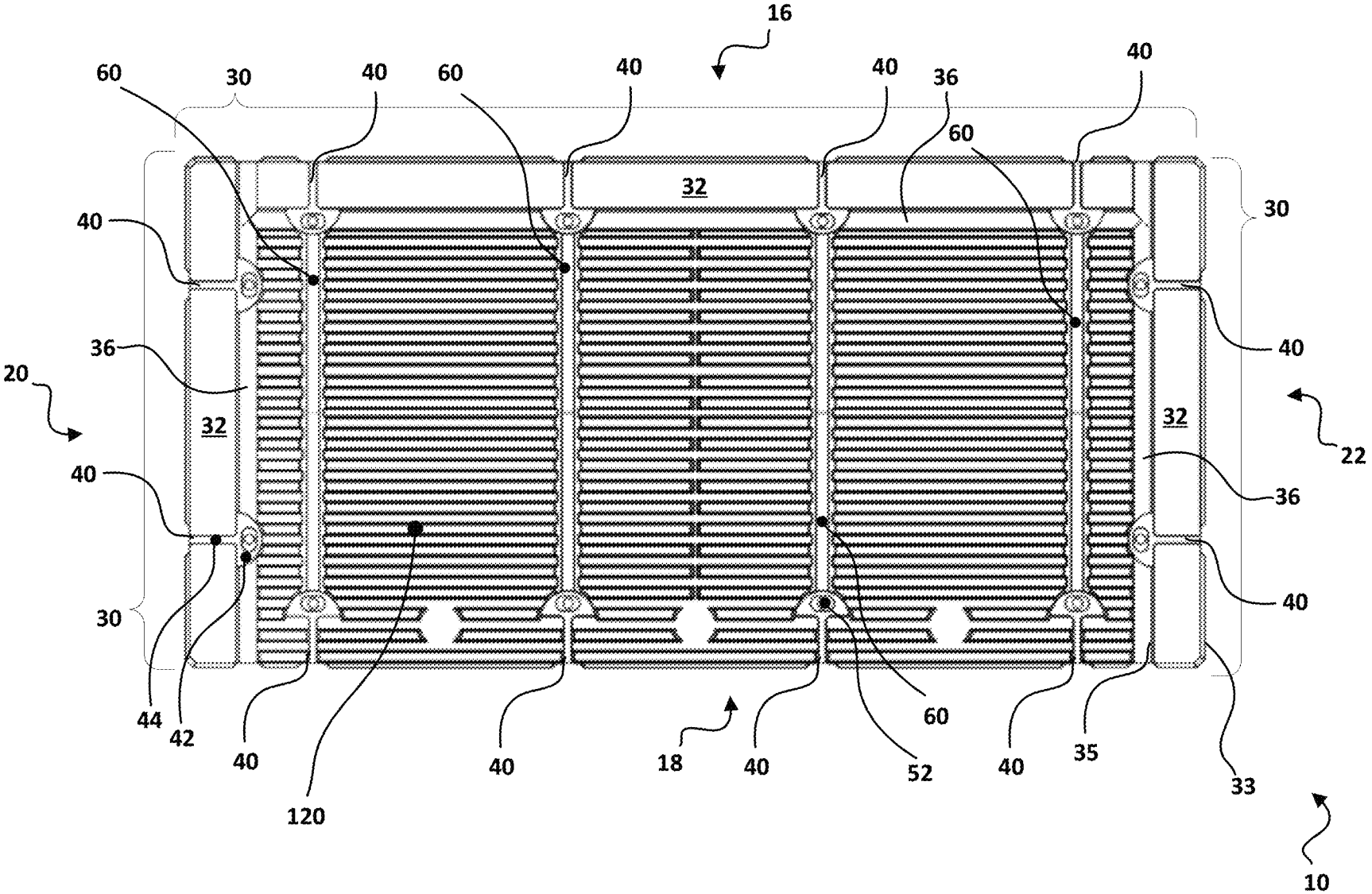
FIG. 9 is a top view of the MSFB of FIG. 7.
Figure 10:
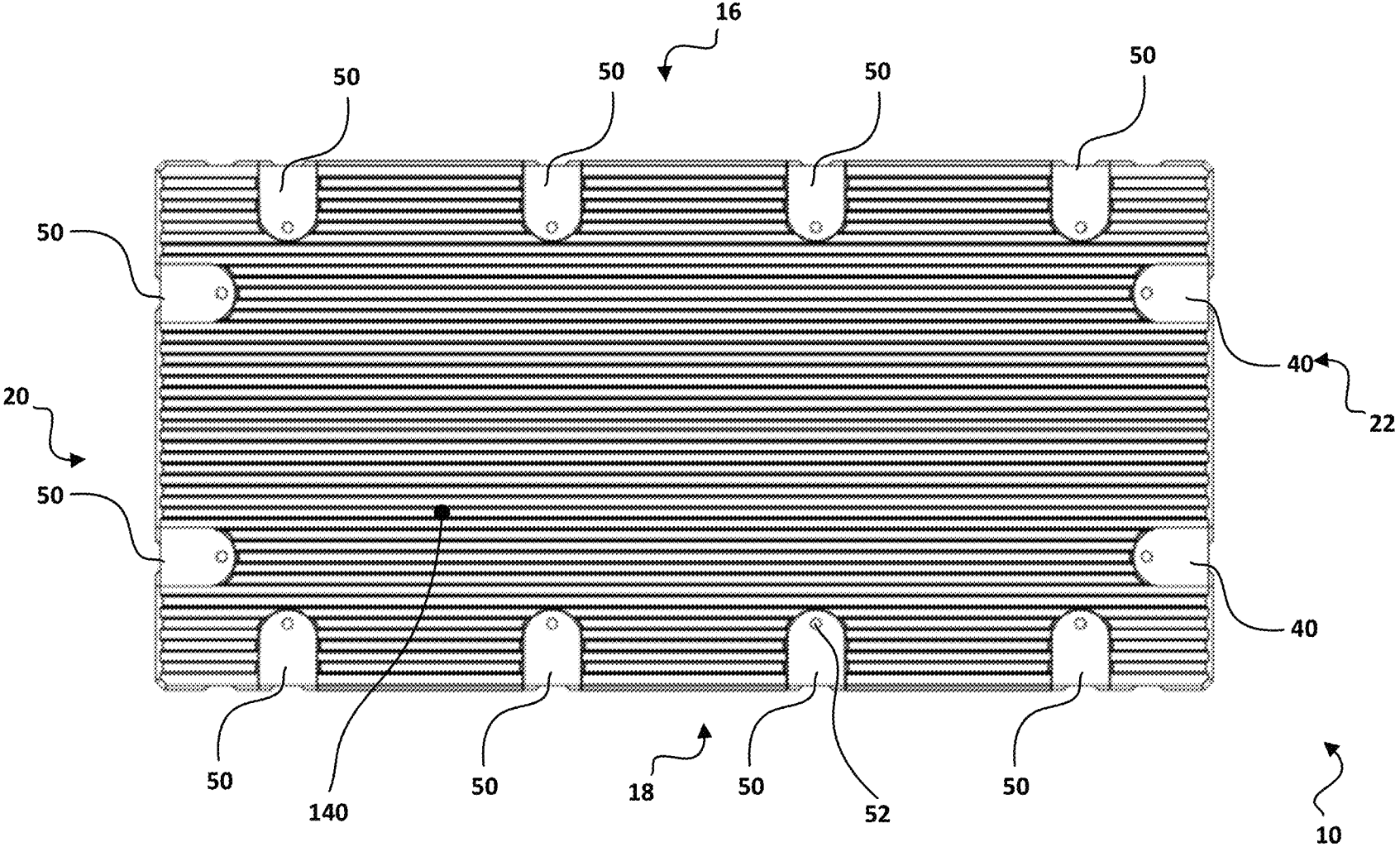
FIG. 10 is a bottom view of the MSFB of FIG. 7.
Figure 11:
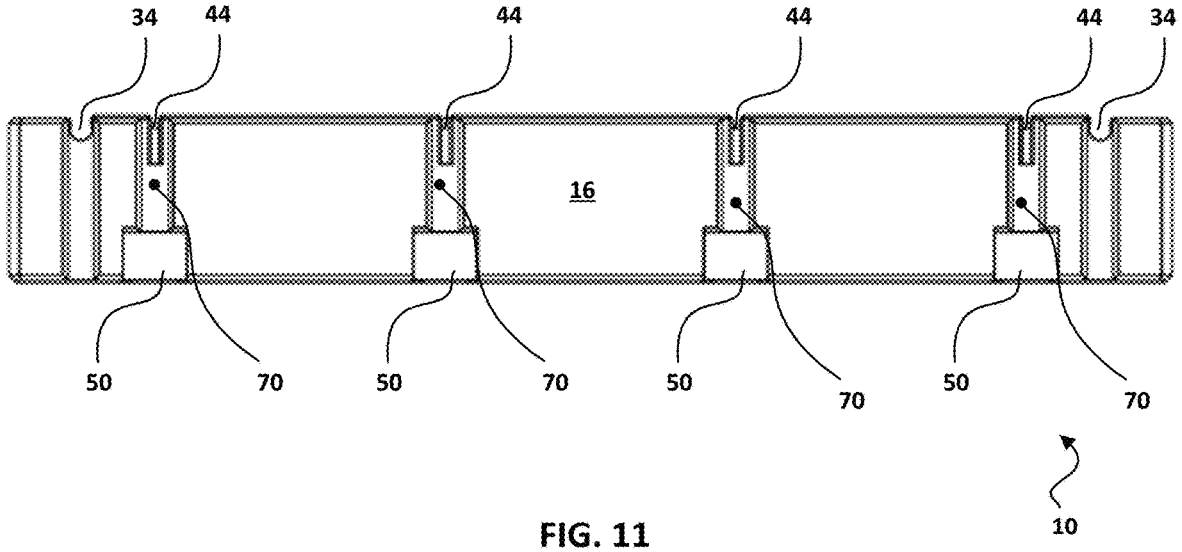
FIG. 11 is a front view of the MSFB of FIG. 7.
Figure 12:
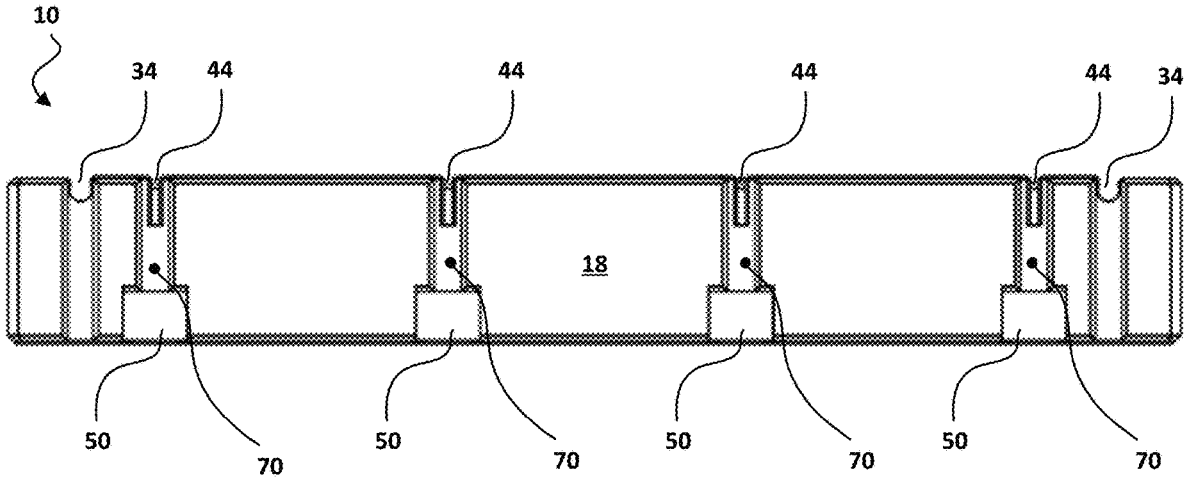
FIG. 12 is a rear view of the MSFB of FIG. 7.
Figure 13:
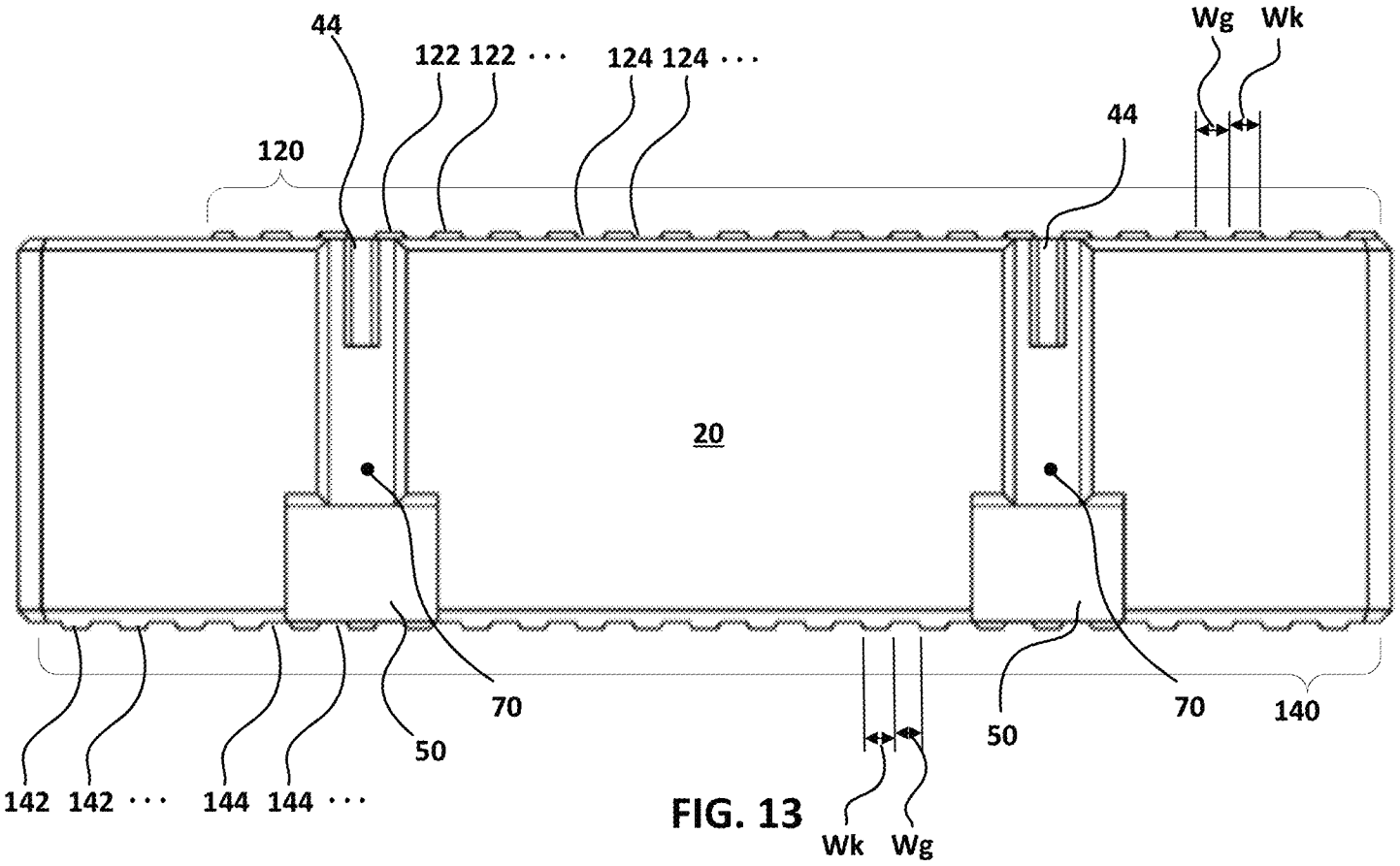
FIG. 13 is a first side (left side) view of the MSFB of FIG. 7.
Figure 14:
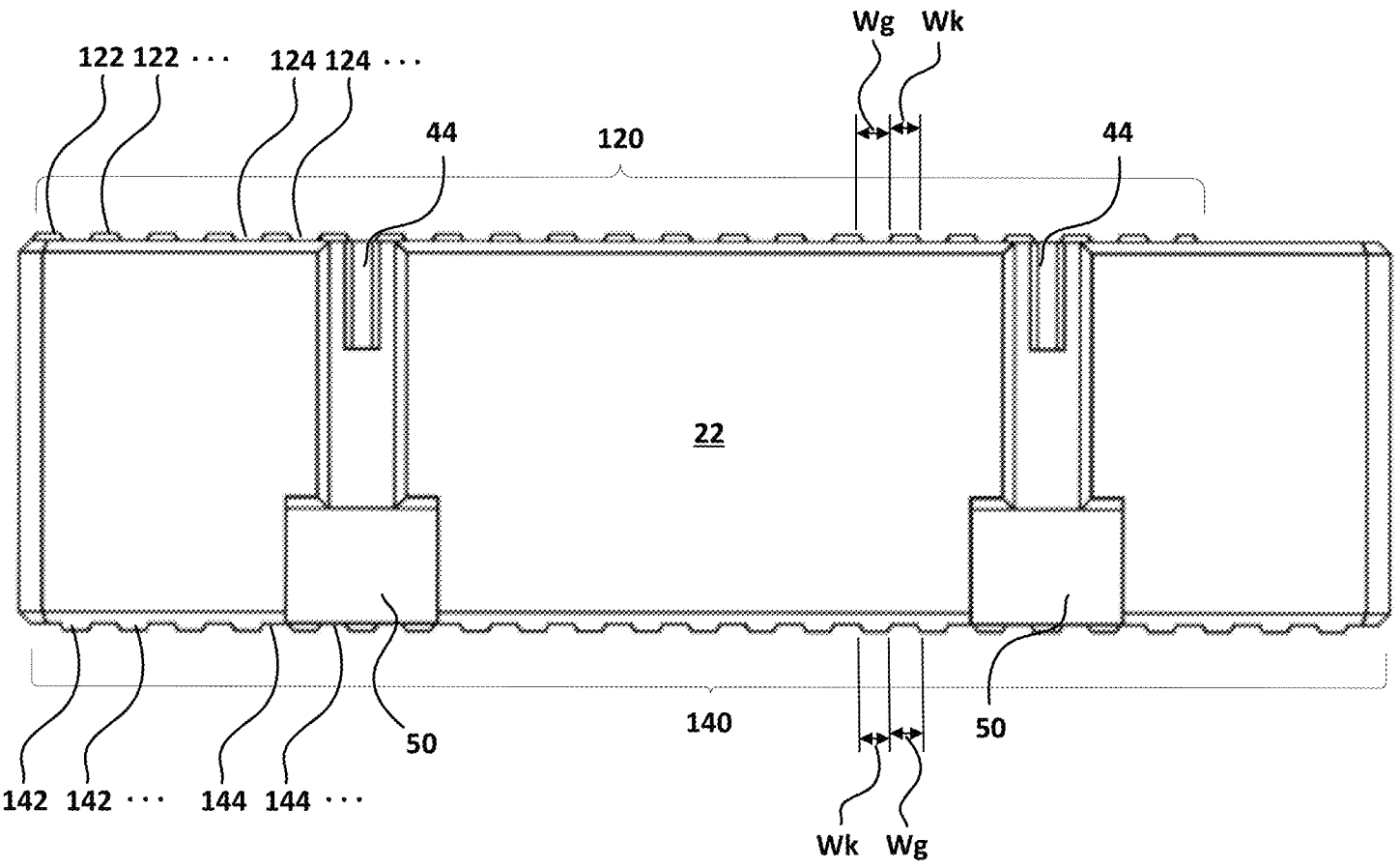
FIG. 14 is a second side (right side) view of the MSFB of FIG. 7.

FIG. 7 is a front perspective view of a MSFB 10, according to an example, and FIG. 8 is a front perspective view of the MSFB 10 shown as generally sized in relation to a typical person. FIG. 9 is a top view of MSFB 10, FIG. 10 is a bottom view of MSFB 10, FIG. 11 is a front view of MSFB 10, and FIG. 12 is a rear view of MSFB 10. Furthermore, FIG. 13 is a first side (left side) view of MSFB 10, and FIG. 14 is a second side (right side) view of MSFB 10.

In this example, MSFB 10 includes a rigid foam body having a top side 12 and a bottom side 14 opposite top side 12, a front side 16 and a rear side 18 opposite front side 16, and a first (left) side 20 and a second (right) side 22 opposite first side 20. In this example, the rigid foam body is formed of high density expanded polystyrene (EPS), cut and/or molded with the features described herein.

In this example, a geogrid interface 30 is integral with top side 12. Geogrid interface 30 includes an apron 32 for horizontally supporting a portion of a section of geogrid on top side 12, and a channel 34 for receiving a portion of a section of geogrid as well as for receiving one or more retaining component, such as one or more steel pipes or plastic pipes or dowel, atop the portion of the section of geogrid, for retaining the portion of the section of geogrid within channel 36, as will be described.

In this example, apron 32 has an outer periphery 33 that is adjacent to first side 20, front side 16, and second side 22, and an inner periphery 35 that is spaced from outer periphery 33 thereby to provide apron 32 with an inside-outside width. More particularly, apron 32 includes a left apron portion adjacent to first side 20 and extending between front side 16 and rear side 18, a right apron portion adjacent to second side 22 and extending between front side 16 and rear side 18, and a front apron portion adjacent to front side 16 and extending between the left apron portion and the right apron portion.

In this example, channel 36 is adjacent to inner periphery 35 of apron 32 and has an open top sized and shaped both to receive from the top and retain the portion of the section of geogrid and the retaining components. In this example, each of apron 32 and channel 36 extend only along front side 16, first side 20, and second side 22, and do not extend along rear side 18. In particular, channel 36 includes a left channel portion extending along the left apron portion at least from rear side 18 to the front apron portion. It can be seen that in this example the left channel portion actually extends through the front apron portion all of the way to front side 16. Channel 36 also includes a right channel portion extending along the right apron portion at least from rear side 18 to the front apron portion. It can be seen that, like the left channel portion, in this example the right channel portion extends through the front apron portion all of the way to front side 16. Channel 36 also includes a front channel portion extending along the front apron portion at least from the left channel portion to the right channel portion. It can be seen that the front channel portion, in this example, does not extend past the right channel portion to second side 22. It can also be seen that the front channel portion, in this example, does not extend past the left channel portion to first side 20.

In this example, a vertical interlock system is integral with the rigid foam body, and is positioned and arranged to enable two like MSFBs 10 to vertically interlock with each other so that, when interlocked, they cannot be moved in a frontward-rearward direction with respect to each other. The vertical interlock system includes both a top side interlocking structure 120 and a bottom side interlocking structure 140. Top side interlocking structure 120 is associated with top side 12, and includes, from channel 36 to rear side 18, a first plurality of parallel ridges 122 each parallel to front side 16 and having a front-rear depth of Wk. Each of the first plurality of ridges 122 is spaced from each other by a gap 124 having a front-rear depth of Wg. Bottom side interlocking structure 140 is associated with bottom side 14, and includes, from front side 16 to rear side 18, a second plurality of parallel ridges 142 each parallel to front side 16 and having the front-rear depth of Wk. Each of the second plurality of ridges 142 is spaced from each other by a gap 144 having the front-rear depth of Wg. It will be appreciated that Wk is just slightly smaller than Wg so that ridges 122 and 142 may fit into respective gaps 124 and 144 of adjacent like MSFBs 10 when stacked so as to vertically interlock. It will also be appreciated that, in this example, ridges 122 align vertically with gaps 144, and gaps 124 align vertically with ridges 142, so that like MSFBs 10 can be stacked directly and in vertical alignment atop each other in a manner that also provides vertical interlock.

It will be appreciated that the ridges 122 extend above top side 12 to a greater height than does apron 32. The differential in height and shape between apron 32 and the top of ridges 122 enable apron 32 to receive and horizontally support a portion of a section of geogrid sandwiched between two vertically-interlocked like MSFBs 10, as will be described. However, while apron 32 is available as part of this geogrid interface, and while top side interlocking structure 120 of the vertical interlock system extends across a sufficiently-large region of top side 12 to provide suitable interlocking with the bottom side interlocking structure 120 of an adjacent like MSFB 10, the height differential renders the support of any other materials, such as concrete blocks for steps, to be uneven. It will be appreciated that, in this example as shown, each of ridges 122 has a flat/horizontal top useful for supporting a patio stone or step stone or other block without unduly deforming. Furthermore, each of ridges 122, 142 and gaps 124, 144 has sloped walls useful for easing interlocking during patio and/or stair construction and for reducing interactions between sharp edges that could otherwise break off.

In this example, MSFB 10 provides apron 32 on along only three of the four sides of top side 12, allowing ridges 122 to extend all the way to the fourth of the four sides of top side 12. Because of this, when MSFB 10 is oriented and positioned for supporting a concrete block—such as a step block for stairs—directly (i.e., without a layer of fill material such as gravel in between) atop MSFB 10, that concrete block can be sufficiently horizontally-supported atop ridges 122 of MSFB 10 across its full span. This, rather than spanning across the lower-height apron 32 and only being supported partially atop higher-height ridges 122, leading to uneven support of the concrete block. It will be appreciated that, in alternative examples of an MSFB, an apron could extend along all four sides of top side 12, with the potential advantage being that such an MSFB could be positioned equally in any orientation with respect to the concrete blocks of a wall being build adjacent to the MSFB, but such an MSFB may not be suited for fully horizontally supporting all concrete blocks that may be placed directly atop of it and span between multiple similar MSFBs, for example for step stones being placed directly thereon for steps.

In this example, MSFB 10 also includes multiple female-type lateral interlock interfaces 40 associated with a respective one of front side 16, rear side 18, first side 20, and second side 22, and extending partially into the rigid foam body from top side 12. In this example, each female-type lateral interlock interface 40 extends about 50 mm into the rigid block body from top side 12. Female-type lateral interlock interfaces 40 are positioned for receiving a male-type connector (see FIGS. 17 and 18, for example), such that each male-type connector is received in two female-type lateral interlock interfaces of two adjacently-arranged MSFBs 10 thereby to laterally interlock the two MSFBs 10. In this example, there are two (2) female-type lateral interlock interfaces 40 associated with each of first side 20 and second side 22, and four (4) female-type lateral interlock interfaces 40 associated with each of front side 16 and rear side 18. It will be appreciated that, in a given installation, not all of the female-type lateral interlock interfaces 40 along a given side 20, 22, 16, 18 are required to receive corresponding male-type connectors for a lateral interlock. If a degree of lateral interlock is required between two adjacent MSFBs 10, then an installer may choose to put a male-type connector into just one of the female-type lateral-interlock interfaces 40 of each of the MSFBs 10. It will be appreciated that additional lateral interlock will accrue from use of additional male-type connectors in respective female-type lateral interlock interfaces 40. In alternative examples, a given side may have as few as one (1) female-type lateral interlock interface 40 or more than two (2) or four (4) female-type lateral interlock interfaces 40.

In this example, each female-type lateral interlock interface 40 includes a head socket 42 positioned so as to be spaced from the respective side, and a neck socket 44 extending from the head socket 42 to the respective side. In this example, head socket 42 has a semi-circular periphery so as to have an arched portion of a periphery facing away from the respective side, and a linear portion of the periphery extending between two ends of the arched portion and along the respective side. The neck socket 44 extends from the midpoint of the linear portion of head socket 42 to the respective side. Female-type lateral interlock interface 40, in this example, may be regarded as having a half "dog-bone" shape. Variations are possible, in that different shapes of female-type lateral interlock interface—such as T-shapes or other shapes—that receive a correspondingly shaped male-type connector, may be implemented.

In this example, each female-type lateral interlock interface 40 associated with front side 16 of MSFB 10 is in lateral alignment with a female-type lateral interlock interface 40 associated with rear side 16 of MSFB 10. That is, laterally-aligned in that each of the laterally-aligned female-type lateral interlock interface 40 is the same distance from first side 20 and the same distance from second side 22 as its counterpart. Similarly, each female-type lateral interlock interface 40 associated with first side 20 of MSFB 10 is in lateral alignment with a female-type lateral interlock interface 40 associated with second side 22 of MSFB 10. That is, laterally-aligned in that each of the laterally-aligned female-type lateral interlock interface 40 is the same distance from front side 16 and the same distance from rear side 18 as its counterpart. The lateral-alignment enables MSFBs 10 in a same course to be placed adjacent to each other and in alignment with each other to enable lateral alignment of those female-type lateral interlock interfaces 40 that face each other when the MSFBs 10 are so positioned, ultimately to enable a male-type connector to be simultaneously received in both of the adjacent MSFBs 10.

In this example, there are cavities 50 in the rigid foam body, with each cavity being in vertical alignment with a respective one of the female-type lateral interlock interfaces 40. Each cavity 50 extends partly into the rigid foam body from bottom side 14, and is open to both bottom side 14 and a respective one of front side 14, rear side 16, first side 20, and second side 22. As will be described, each cavity 50 is dimensioned to be open to a respective side a sufficient amount to allow a head of a male-type connector to pass into it from the respective side. In this way, the head can enter into cavity 10 so it can be positioned in vertical alignment with a respective female-type lateral interlock interface 40 of an adjacent MSFB 10 in a lower course into which it is to be received. That is, due to cavities 50, the lateral interlocking of two MSFBs 10 in a same course can be done even if there is an MSFB 10 in a subsequent course sitting atop of one of the two MSFBs 10 in the lower course into which the male-type connector needs to be received. In this example, each cavity 50 has an arched inner wall, planar side walls and a planar top wall extending from the arched inner wall.

Figure 21:
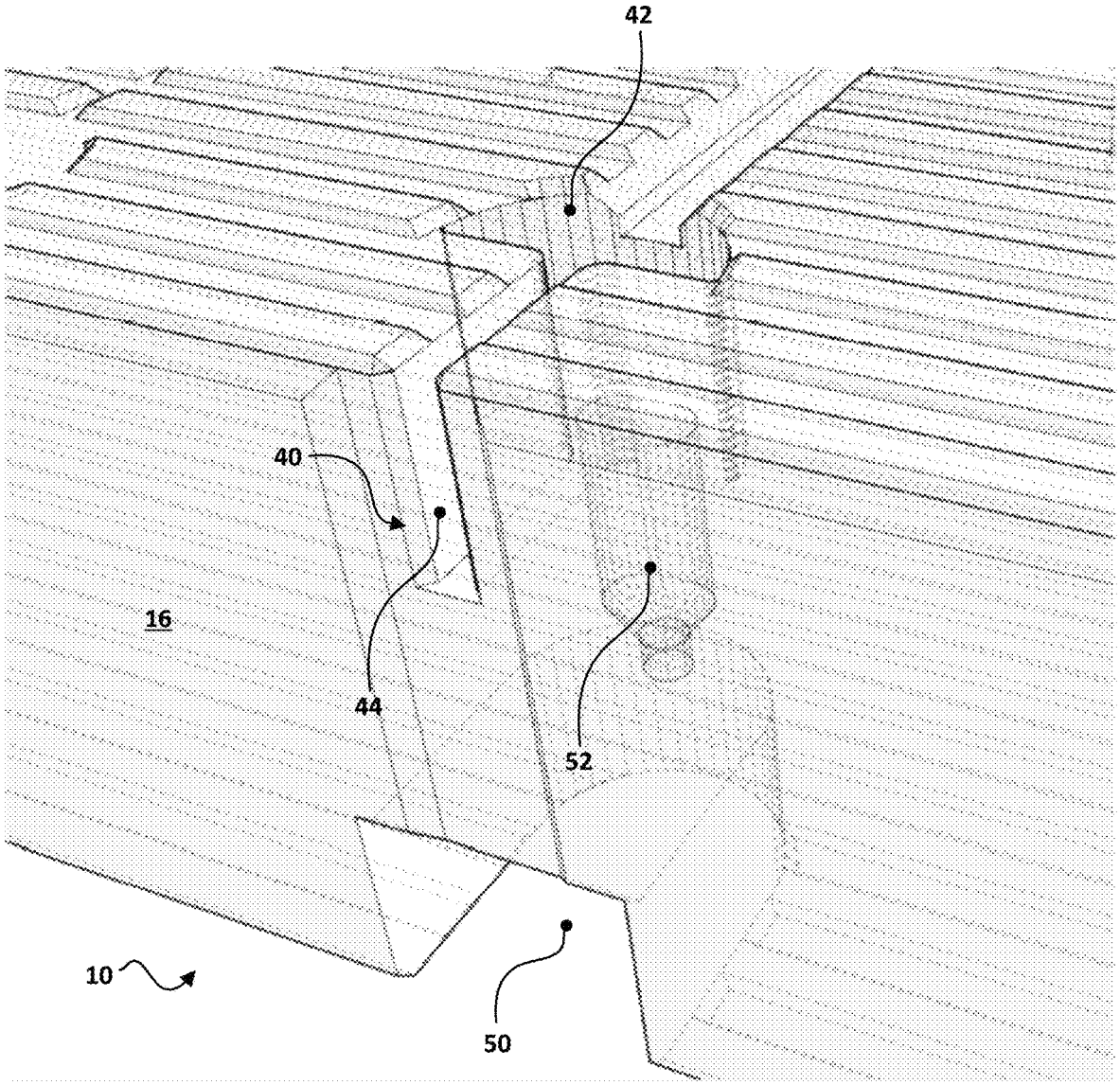
FIG. 21 is a magnified and partially-transparent rear perspective view of the MSFB of FIG. 7 showing a shaft extending downwards through the interior of the MSFB and open to a respective cavity which is, in turn, open to the bottom side of the MSFB.

Turning ahead to FIG. 21, a further aspect is depicted. In particular, FIG. 21 is a magnified and partially-transparent rear perspective view of a portion of MSFB 10, showing a shaft 52 open to and extending downwards from a bottom floor of head portion 42 of female-type lateral interlock interface 40, through the interior of MSFB 10, and opening through a ceiling of a respective cavity 50. Cavity 50 is, in turn, open to bottom side 14 of MSFB 10. As such, shaft 52 is open to bottom side 14 so that any moisture in or entering head portion 42 can be guided downwards through shaft 52 to drop into cavity 50, and thereafter may contact the base layer of an installation (i.e., the ground) to be drained into the base layer, or enter into ridges 122 of a like MSFB 10 of a lower course to be conveyed along ridges 122 towards other components of the lower course MSFB 10. Moisture thereby does not have to remain in a given female-type lateral interlock interface 40, and can ultimately be conveyed via the features of the lower and subsequently lower MSFBs 10 and ultimately out from between MSFBs 10. An opening to one of shafts 52 is also shown in the bottom of one of the head portions 42 in FIG. 9, and an opposite opening to one of shafts 52 is shown in the ceiling of one of the cavities 50 in FIG. 10.

Each of shafts 52 may alternatively be employed to receive/retain other structural elements, such as a threaded steel rod, for use in construction.

As shown and as denoted in particular in FIG. 9, MSFB 10 also includes, in this example, open-topped conduits 60 associated with top side 12. Each of open-topped conduits 60 extends along top side 12 between female-type lateral interlock interfaces 40, and may be thought of as cutting across ridges 122. Each of open-topped conduits 60 is open to, and this in fluid communication with, gaps 124 between ridges 122, so that moisture entering into gaps 124 may be conveyed out of gaps 124 towards conduits 60. In turn, conduits 60 may convey the moisture towards and into respective female-type lateral interlock interfaces 40, and the moisture may be conveyed from the female-type lateral interlock interfaces 40 into respective shafts 52 and downwards as described herein.

As shown and as denoted in particular in FIGS. 11, 12, 13, and 14, MSFB 10 also includes, in this example, open-topped conduits 70 associated with respective ones of front side 16, rear side 18, first side 20, and second side 22. Each of open-topped conduits 70 extends from top side 12 to bottom side 14 and is in fluid communication with a respective neck socket 44 so that fluid entering into any female-type lateral interlock interface 40 may, in addition to flowing downward through a respective shaft 52, flow downward at the periphery of the rigid foam block through a respective one of open-topped conduits 70.

In this example, the length of the MSFB 10 across top side 12 is 1.2 m (meters) which is about 4 ft (feet) and the width of the MSFB 10 across the top side is 0.6 m which is about 2 ft. It will be appreciated that the width is a function of the length so that MSFB 10 can be installed perpendicular to, or parallel to, another like MSFB 10, as described herein. In this example, therefore, the length of MSFB 10 is twice the width of MSFB 10. Furthermore, in this example, the thickness of MSFB 10 (i.e., the distance from top side 12 to bottom side 14) is 150 mm (millimeters). Regarding thickness, in examples the thickness of an MSFB is at least 150 mm in order to ensure that the MSFB has overall stiffness and rigidity. For example, if a rigid foam body of an MSFB is too thin for its length and width, it may crack along its length or width during transportation, handling, installation, or use. It will be appreciated that segmented retaining wall units—concrete blocks—that are arranged in conjunction with the MSFBs to form raised patios and/or stairs, typically have heights in the range of 150 mm to 300 mm.

In examples, the height of an MSFB is usefully related in some way to the height of the retaining wall blocks with which it is to be used. For example, the height of the MSFB may be equal to the height of the retaining wall blocks with which it is to be used, or may be equal to twice the height of the retaining wall blocks with which it is to be used, or may be equal to half the height of the retaining wall blocks with which it is to be used. In this way, a certain number of whole MSFBs can reach the same height as a certain same or different number of whole retaining wall blocks.

However, in the event that retaining wall units have heights less than 150 mm, then in order as described to preserve stiffness and rigidity of the MSFBs having lengths and widths as set forth above, the height of the MSFBs should be an integer-greater-than-one multiple of the height of the retaining wall units. For example, if the retaining wall units are only 85 mm in height, then instead of forming an MSFB 10 to have a height of 85 mm, the MSFB 10 could be formed to have a height of 170 mm (2 times the height of the retaining wall units), or 255 mm (3 times the height of the retaining wall units), or some other integer multiple of the height of the retaining wall units greater than one (1).

A rigid foam body formed from high density EPS, or formed from a similar material, is far more self-supporting and shape-preserving while being far lower weight, than a similar volume of gravel. For example, MSFB 10 having an EPS rigid foam body with a length of 1.2 m, a width of 0.6 m and a thickness of 150 mm would have a significantly lower weight than the same volume of typical fill gravel. It may be that a unit weight of gravel would be about 130 pounds per cubic foot (lb/cu.ft) whereas a unit weight of EPS could be 1.4 lb/cu.ft. It will be appreciated that MSFB 10 being self-supporting and shape-preserving significantly reduces, and may eliminate, lateral loads being imparted to laterally-adjacent objects such as other like MSFBs, concrete blocks with which they are to be used to form patios and/or steps, and the like. Furthermore, the significant weight difference for the same volume of fill and compaction resistance provided by MSFB 10 as compared with gravel, greatly reduces downward vertical loads being imparted to the ground or other underlying surface, leading to far less pressure against the ground and in turn, against the foundation of a building.

It will be appreciated that MSFB 10 may be used with other like MSFBs 10 in various configurations to construct hardscape raised patios and/or stairs or may be used in other applications such as for elevated walkways. In the present description, applications in the construction of raised patios will be explained in particular detail, as will applications in the construction of stairs.

MSFB 10 includes a vertical interlock system that is integral with the rigid foam body. As will be described, the vertical interlock system enables MSFB 10 to vertically interlock with like MSFBs 10 on adjacent courses of a multi-course support system. The relative dimensions of features of the vertical interlock system are provided to enable MSFB 10 to be stacked in various configurations, to accommodate the placement and support of concrete and/or stone hardscape components as will be described.

A brief description of the construction of a raised patio using multiple MSFBs 10 to fill most of the volume underneath a top layer of patio stones, instead of a full gravel fill, and making use of geogrid material, follows here.

In this example, a perimeter wall of the raised patio is partially constructed using concrete blocks B, and with no backfill material.

Figure 15:
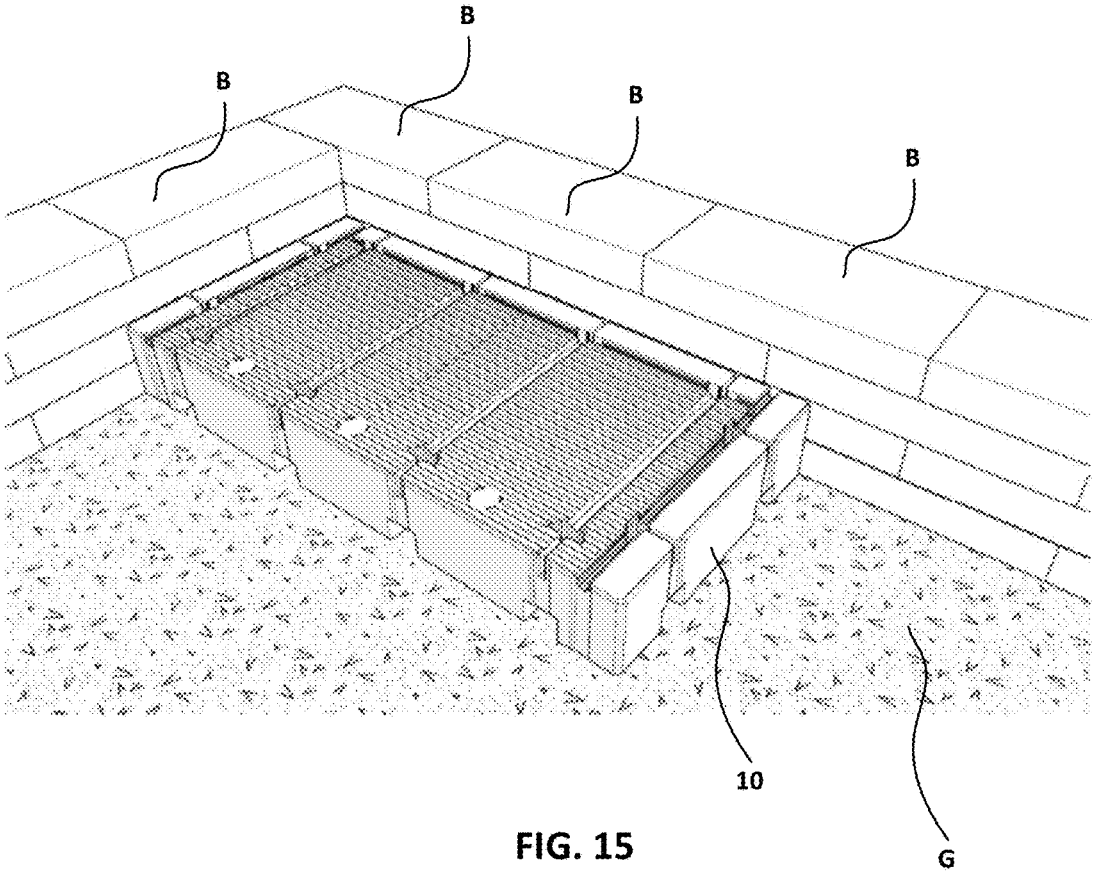
FIG. 15 is a rear perspective view of an MSFB such as that in FIG. 7 positioned against courses of concrete blocks in a partially-constructed raised patio.

FIG. 15 is a rear perspective view of MSFB 10 positioned atop a thin (e.g. about 150 mm thick) base/stabilizing layer of leveled and compacted gravel G and in a corner against courses of concrete blocks B in a partially-constructed raised patio. Only a few of the concrete blocks B are marked as such just to keep from cluttering the figure. MSFB 10 is positioned in a corner formed by four courses of blocks B, and is oriented so that its upward-facing apron 32 along front side 12 and first side 20 extends adjacent to blocks B. In this example, the height of MSFB 10 corresponds to the height of two (2) courses of the blocks B.

Figure 16:
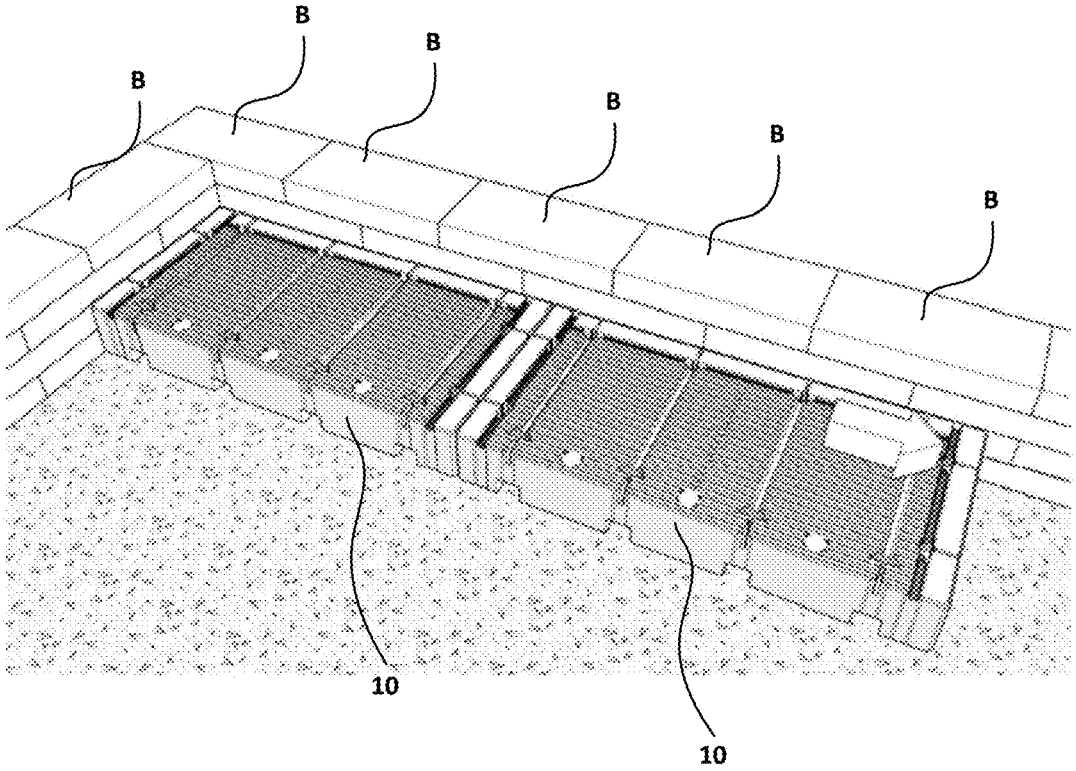
FIG. 16 is a rear perspective view of two MSFBs such as that of FIG. 7 positioned adjacent to each other and both against courses of concrete blocks in a partially-constructed raised patio.

The first course of MSFBs 10 continues to be placed. FIG. 16 is a rear perspective view of the second of now two MSFBs 10 positioned atop the thin based/stabilizing layer of gravel G and both adjacent to each other and against courses of concrete blocks B in a partially-constructed raised patio. MSFBs 10 are oriented so that their respective upward-facing aprons 32 along front side 12 and first side 20 extend adjacent to blocks B. It will be appreciated that during this first row and first course placement, MSFBs 10 are intentionally not laterally interlocked with each other. It has been found that, during installation, MSFBs 10 are advantageously maintained independent of each other to allow for levelling/adjustment of individual MSFBs 10 without necessarily impacting the levelling/adjustment of adjacent MSFBs 10.

When continuing to lay out the MSFB 10, it is useful that the perimeter rows, which are adjacent to the exterior wall of the patio, are constructed first and the space within the interior is left open until the perimeter rows are completed. The reason for this is to aid in protecting the MSFBs 10 from debris and crushing of the ridges 122 due to an installer walking on top of it as rows are being laid. As such, the MSFB 10 has been designed to allow male-type connectors 90 to be placed between adjacent MSFBs 10 even after those adjacent MSFBs 10 are stacked atop of each other, as will be shown.

Various prior art products, such as the above-described Sawyer patents, are configured such that the very placement of a unit adjacent to another unit requires that they be laterally interlocked. This has been found by the present inventor to be a limiting factor in certain installation scenarios. This is because the inextricable interlocking of adjacent blocks makes it difficult or impossible to make adjustments to a single unit at a time, for example by moving it individually or changing its level individually, as any adjustment of a unit that is interlocked with another will accordingly adjust the other. In contrast, each MSFB 10 is large enough that it may require some adjustment over its length or width as it is put into place. As described herein, it is not mandatory that MSFBs 10 be interlocked as they are placed adjacent to each other, such that if desired MSFBs 10 can be placed and levelled as independent units and, once individually positioned and leveled, may thereafter be laterally interlocked.

Figure 17:
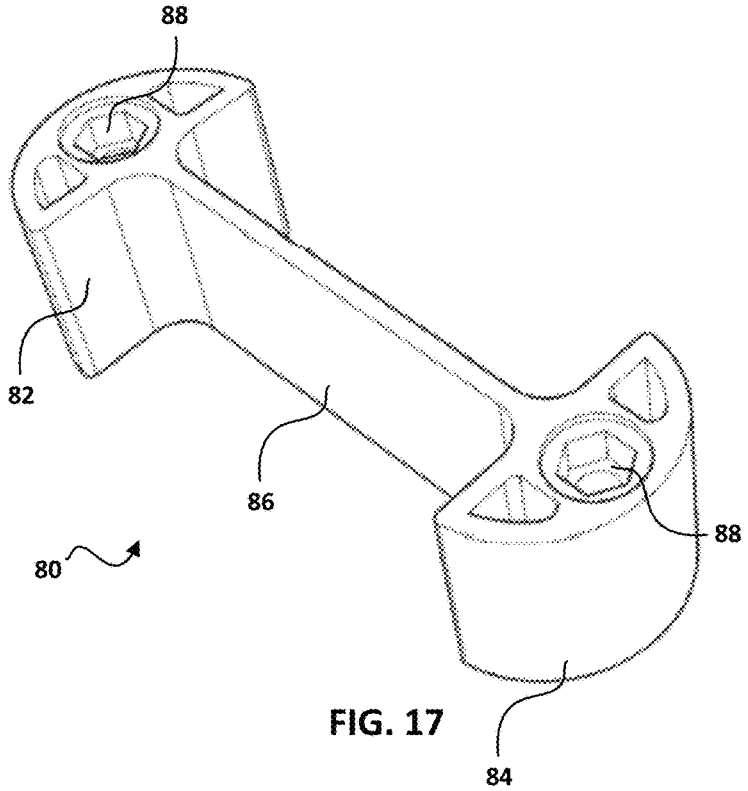
FIG. 17 is a top perspective view of a male-type connector for horizontally interlocking adjacent MSFBs such as that of FIG. 7.
Figure 18:
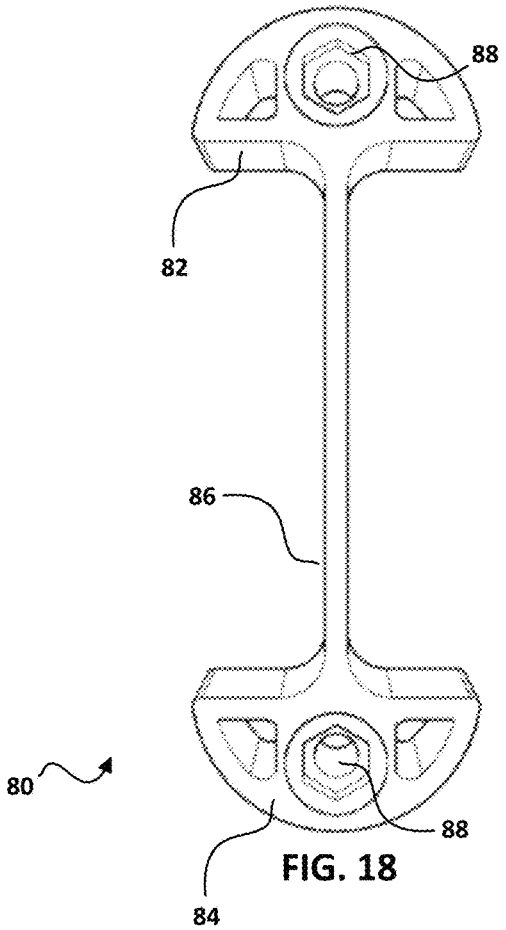
FIG. 18 is a top plan view of the male-type connector of FIG. 17.

FIG. 17 is a top perspective view of a male-type connector 80 for horizontally interlocking laterally-adjacent pairs of MSFBs 10, according to an example. FIG. 18 is a top plan view of male-type connector 80. In this example, male-type connector 80 includes a proximal head 82, a distal head 84, and a neck 86 or web extending between proximal head 82 and distal head 84. Male-type connector 80 is formed of a rigid material, such as a plastic material, and is of sufficient thickness and material to withstand a degree of lateral and torsional stress without breaking or bending very easily, so as to hold two MSFBs 10 together as will be described. In this example, in order to be used with MSFBs 10, each of proximal head 82 and distal head 84 is dimensioned to be received and retained within a respective head socket 42 of a respective female-type lateral interlock interface 40 (see, for example, FIG. 21). Furthermore, neck 86 is dimensioned to be received and retained within the respective neck sockets 44 of both of the respective female-type lateral interlock interfaces 40. Male-type connector 80, in this example, may be regarded as having a "dog-bone" shape, such that proximal head 82 and distal head 84 are mirror images of one another across neck 86. In this example, male-type connector 80 has a top to bottom height of about 50 mm, so that it can be pressed into respective female-type lateral interlock interfaces of MSFBs 10 to seat therein without extending above top side 12. As such, proximal head 82 and distal head 84 each have a semi-circular periphery.

In this example, each of proximal head 82 and distal head 84 includes, extending from its top facing side (the side seen in the figures) towards the bottom, a threaded female receptacle 88 that is itself dimensioned to receive a corresponding threaded fastener (not shown). Threaded female receptacle 88 may be useful for receiving the threaded fastener that attaches a first end of a strap or bar to male-type connector 80 while male-type connector 80 is received within a respective female-type lateral interlock interface 40. The opposite end of such a strap or bar can be attached to blocks B of an intermediate course of a wall adjacent to the MSFB 10 into which male-type connector 80 is received. The attachment of a strap or bar may provide reinforcement that inhibits the wall from falling or being rotated away from the MSFB 10, particularly due to the influence of a significant rotational force imparted to the wall by, for example, lateral pressure against a railing attached to an extending from the wall.

Figure 19:
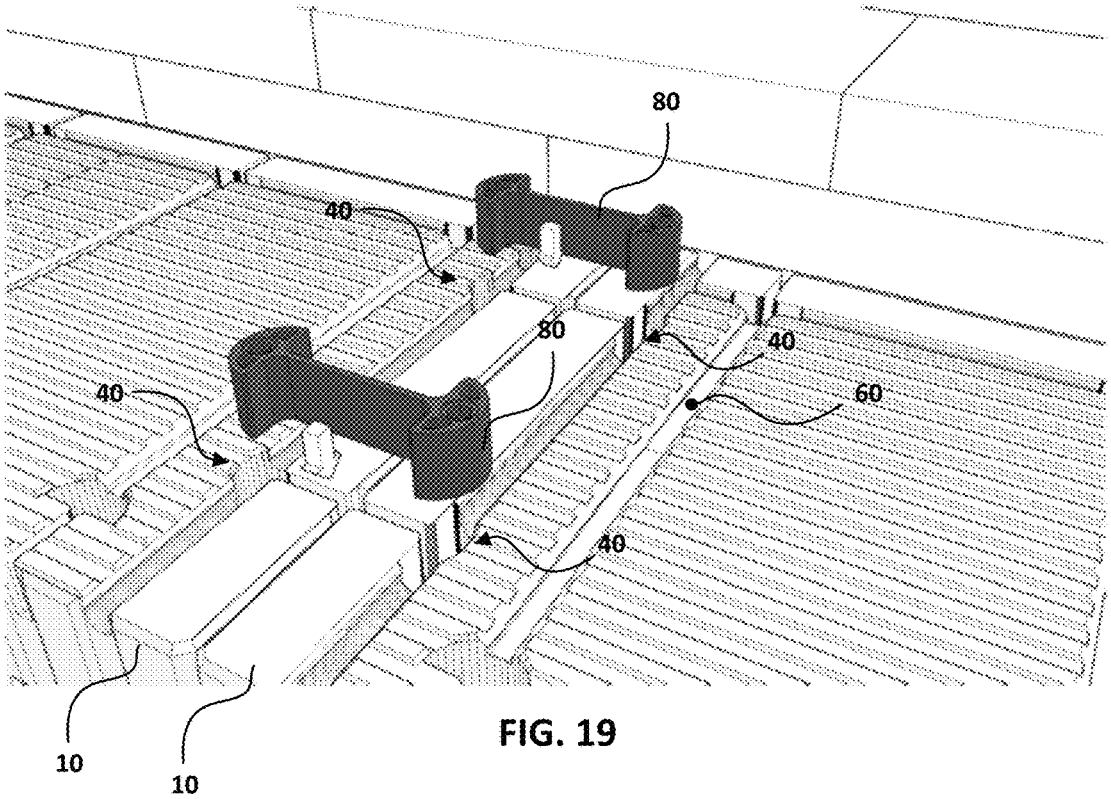
FIG. 19 is an enlarged rear perspective view of portions of two MSFBs positioned adjacent to each other as in FIG. 16, with two of the male-type connectors of FIG. 18 positioned to be inserted into respective female-type lateral interlock interfaces of the two MSFBs thereby to horizontally interlock the two MSFBs.
Figure 20:
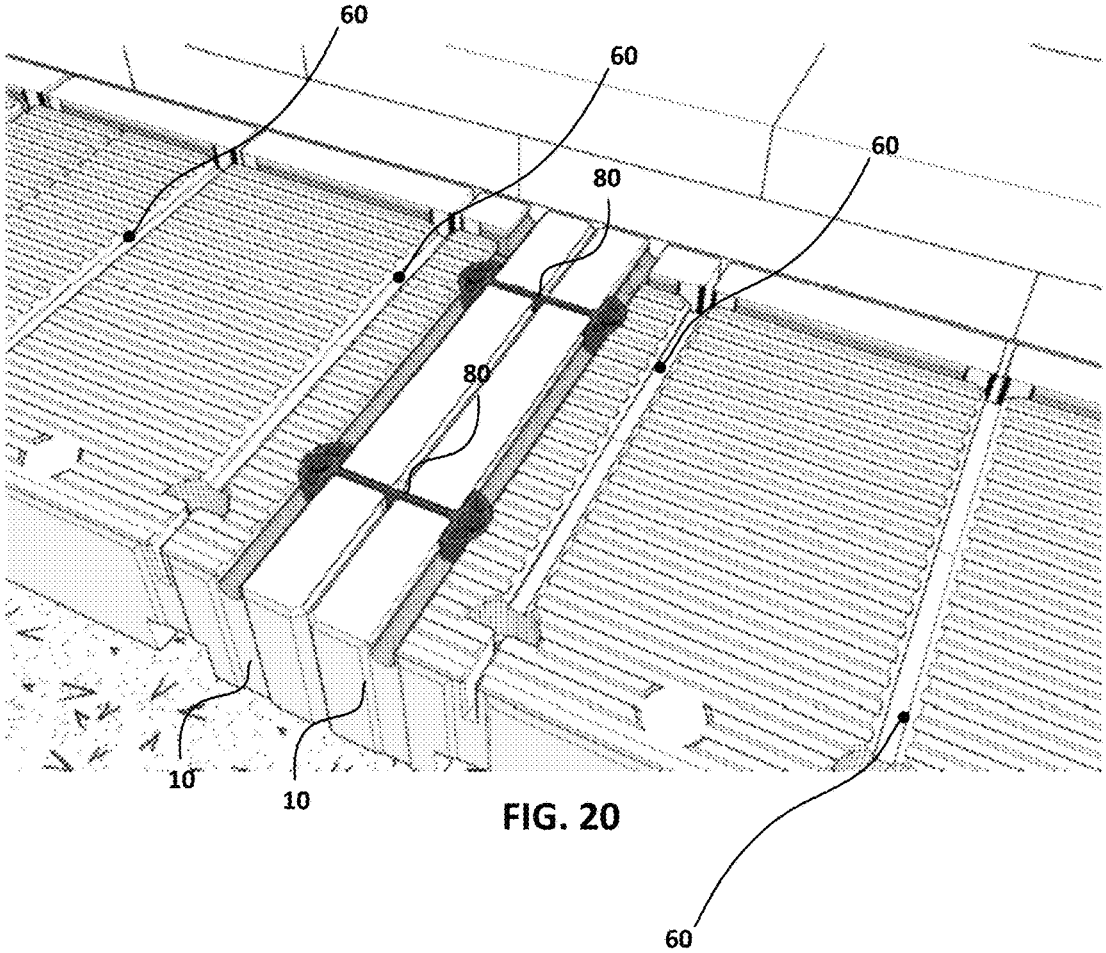
FIG. 20 is an enlarged rear perspective view of portions of two MSFBs positioned adjacent to each other as in FIG. 16, with two of the male-type connectors of FIG. 18 having been inserted into respective female-type lateral interlock interfaces of the two MSFBs thereby to horizontally interlock the two MSFBs.

FIG. 19 is an enlarged rear perspective view of portions of two MSFBs 10 positioned adjacent to each other as in FIG. 16, with two of the male-type connectors 80 positioned above to be inserted into respective female-type lateral interlock interfaces 40 of the two MSFBs 10 thereby to horizontally interlock the two adjacent MSFBs 10. FIG. 20 is an enlarged rear perspective view of portions of two MSFBs 10 positioned adjacent to each other as in FIG. 16, with two of the male-type connectors 80 having since been inserted into respective female-type lateral interlock interfaces 40 of the two MSFBs 10 thereby to horizontally interlock the two MSFBs 10. It will be appreciated that such horizontal/lateral interlocking would typically be done only once each of the two MSFBs 10 were individually positioned, oriented and leveled to the satisfaction of the installer. The fit between male-type connector 80 and female-type lateral interlock interfaces 40 is very snug, so that the female-type lateral interlock interfaces 40 and a respective male-type connector 80 are very closely fitted together, ultimately so that the adjacent MSFBs 10 are connected so as to behave thereafter as a single unit.

Figure 22:
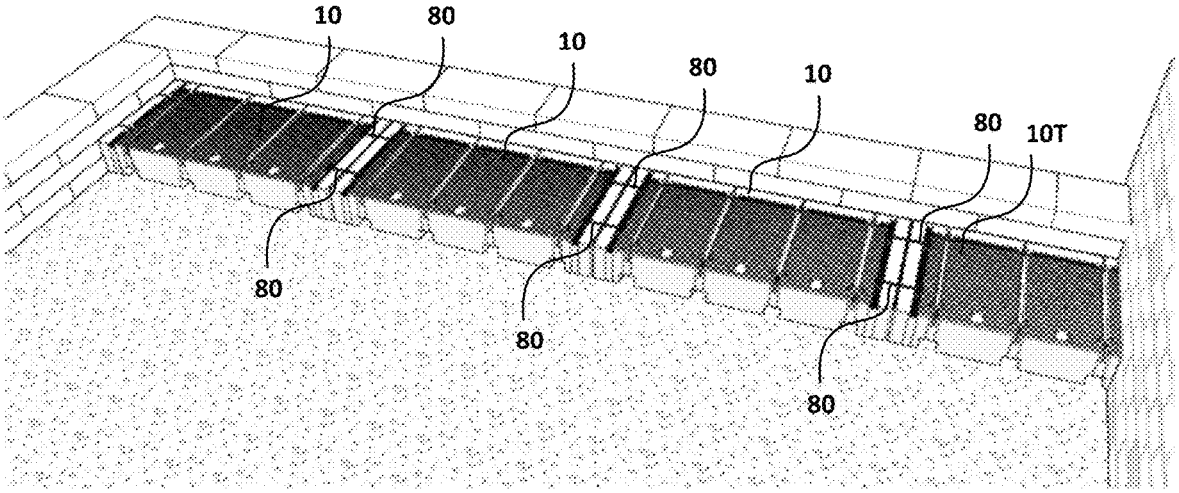
FIG. 22 is a rear perspective view of multiple full MSFBs such as that of FIG. 7 and a truncated MSFB, positioned in a single row adjacent to each other and against courses of concrete blocks in a partially-constructed raised patio, each MSFB being horizontally interlocked with adjacent ones of the other MSFBs using the male-type connectors of FIG. 17.

FIG. 22 is a rear perspective view of multiple full MSFBs 10 and a truncated MSFB 10T, positioned in a single row adjacent to each other and against courses of concrete blocks B in a partially-constructed raised patio. Truncated MSFB 10T is simply an MSFB 10 that has been cut to size onsite during installation simply to fit into place in the row between the adjacent MSFB 10 and the wall of the building. It can be seen that each MSFB 10 is horizontally (i.e. laterally) interlocked with adjacent ones of the other MSFBs 10 using male-type connectors 80.

Figure 23:
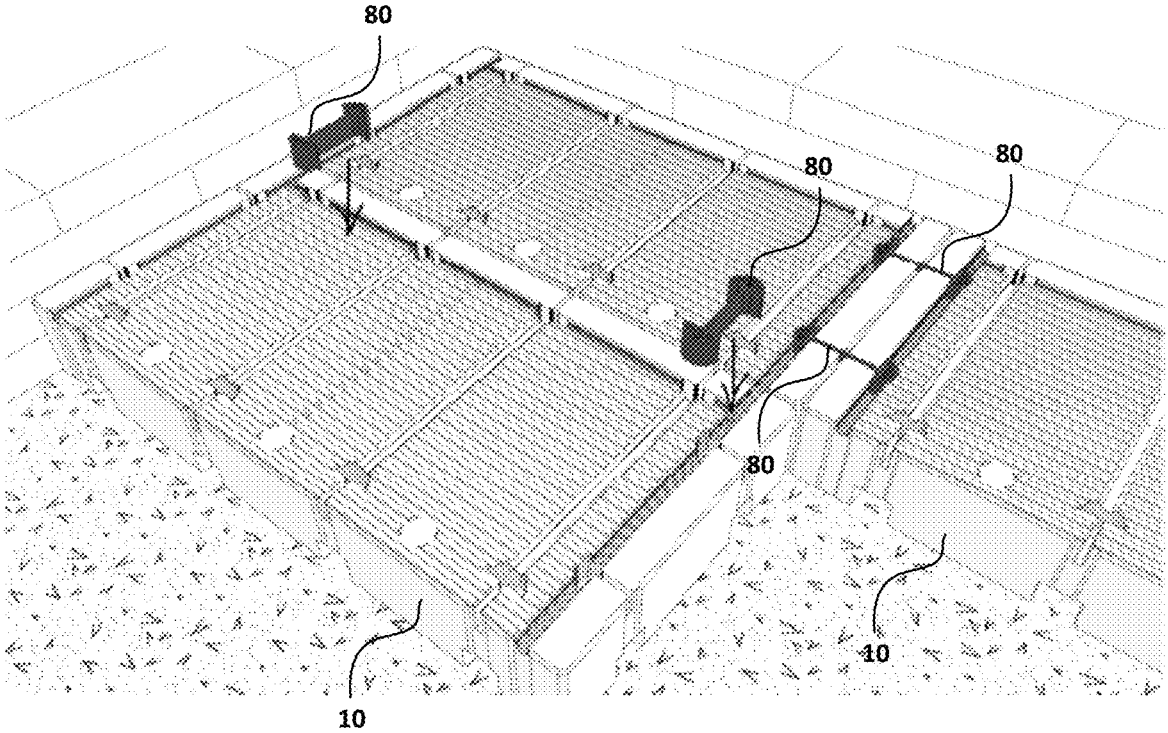
FIG. 23 is a rear perspective magnified view of multiple MSFBs such as that of FIG. 7, two of which in the figure are positioned in a first row adjacent to one another other and a third of which is positioned at the beginning of a second row on the same course, the multiple MSFBs being positioned against courses of concrete blocks in a partially-constructed raised patio, each MSFB in the first row being horizontally interlocked with adjacent ones of the other MSFBs using the male-type connectors of FIG. 17 and male-type connectors being positioned to horizontally interlock the MSFB in the second row with one of the MSFBs of the first row.

FIG. 23 is a rear perspective magnified view of multiple MSFBs 10, two of which in the figure are positioned in a first row adjacent to one another other and a third of which is positioned at the beginning of a second row on the same course. The multiple MSFBs 10 are positioned against courses of concrete blocks B in the partially-constructed raised patio. Each MSFB 10 in the first row is horizontally interlocked with adjacent ones of the other MSFBs 10 using male-type connectors 80. Also, male-type connectors 80 are positioned to horizontally interlock the MSFB 10 in the second row with an aligned one of the MSFBs 10 of the first row.

Figure 24:
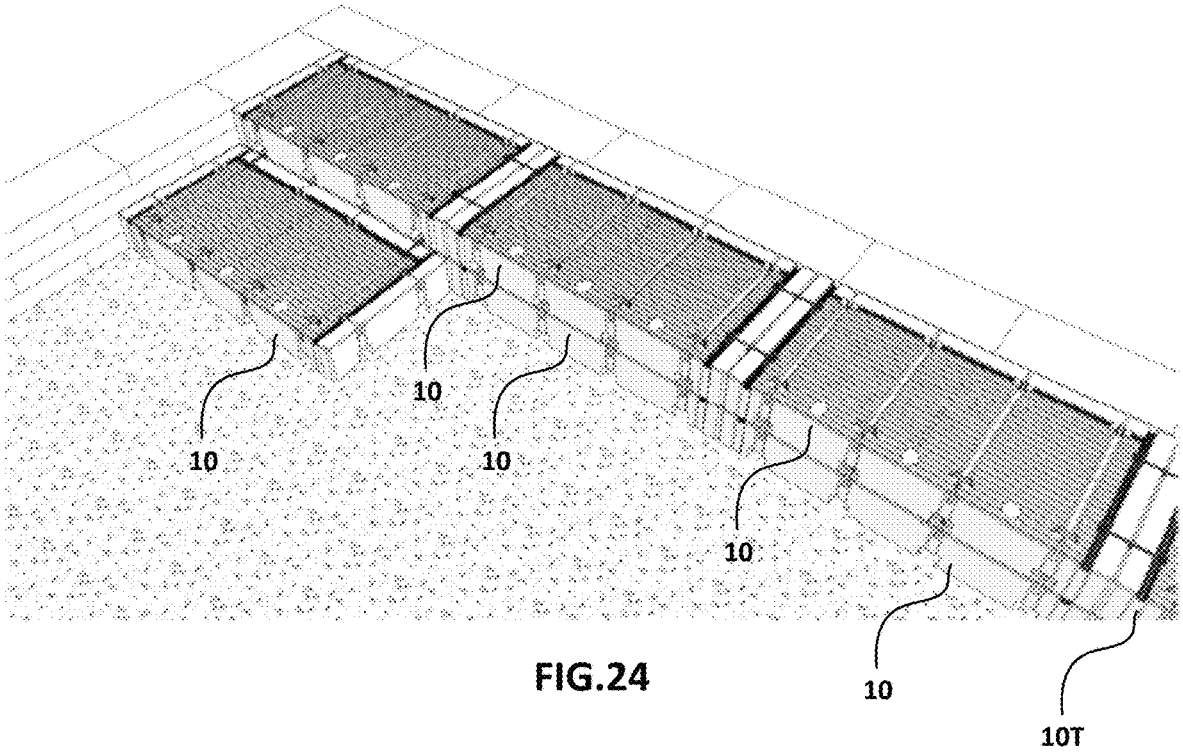
FIG. 24 is a rear perspective view of multiple full MSFBs such as that of FIG. 7 and a truncated MSFB, positioned in a single row adjacent to each other in a first course, multiple full MSFBs positioned in another single row adjacent to each other in a second course atop the first course, an MSFB at the beginning of a second row on the first course, each MSFB in a given course being horizontally interlocked with adjacent ones of the other MSFBs using the male-type connectors of FIG. 17.

FIG. 24 is a rear perspective view of multiple MSFBs 10 positioned in a single row adjacent to each other in a first course, multiple full MSFBs 10 positioned in another single row adjacent to each other in a second course atop the first course, and an MSFB 10 at the beginning of a second row on the first course. Each MSFB 10 in a given course is horizontally interlocked with adjacent ones of the other MSFBs 10 using male-type connectors 80. In this case, only one additional course is placed, but an installer could choose to place more. The reason to stack these courses as soon as possible is to prevent debris and contamination from getting in between MSFBs 10 and preventing the ridges/gaps 122/142 interlocking improperly and the MSFBs 10 not sitting properly on top of each other. It will be appreciated that the installer has easy access to this perimeter course without having to walk on top of any MSFBs 10, thereby avoiding damage or contamination.

Figure 25:
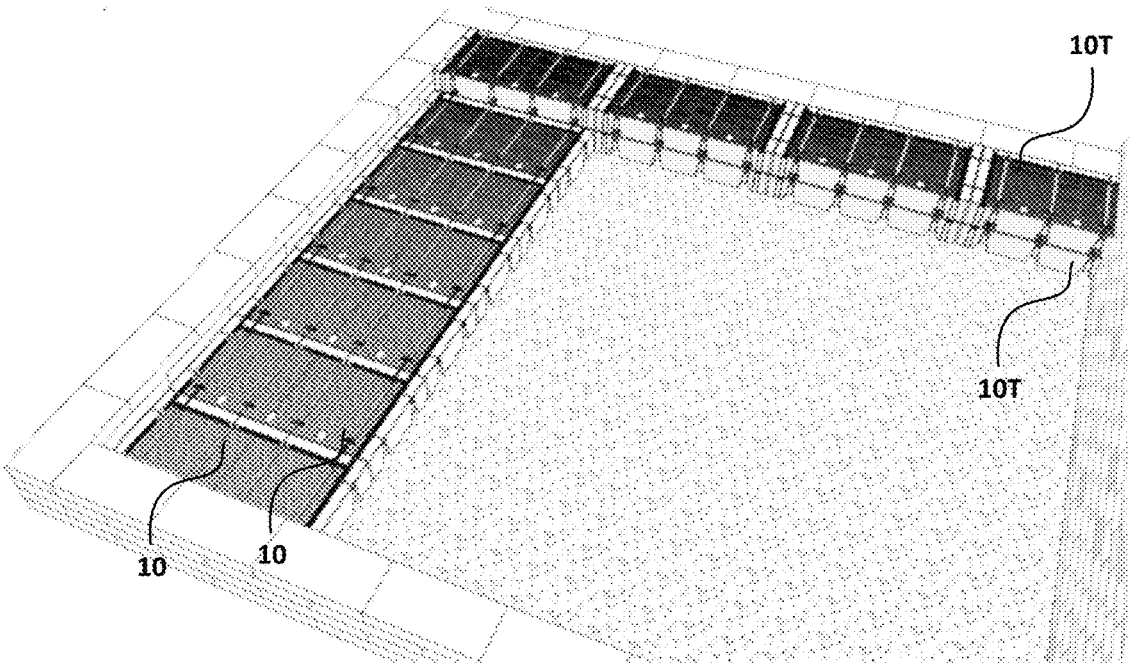
FIG. 25 is a rear perspective view of multiple full MSFBs such as that of FIG. 7 and a truncated MSFB, positioned in a single row adjacent to each other in a first course, multiple full MSFBs and a truncated MSFB positioned in another single row adjacent to each other in a second course atop the first course, and MSFBs extending along a first column on the first course, each MSFB in a given course being horizontally interlocked with adjacent ones of the other MSFBs using the male-type connectors of FIG. 17.

FIG. 25 is a rear perspective view of multiple full MSFBs 10 and a truncated MSFB 10T, positioned in a single row adjacent to each other in a first course, multiple full MSFBs 10 and a truncated MSFB 10T positioned in another single row adjacent to each other in a second course atop the first course, and MSFBs 10 extending along a first column on the first course. Each MSFB 10/10T in a given course is, or is to be, horizontally interlocked with adjacent ones of the other MSFBs 10/10T using the male-type connectors 80.

Figure 26:
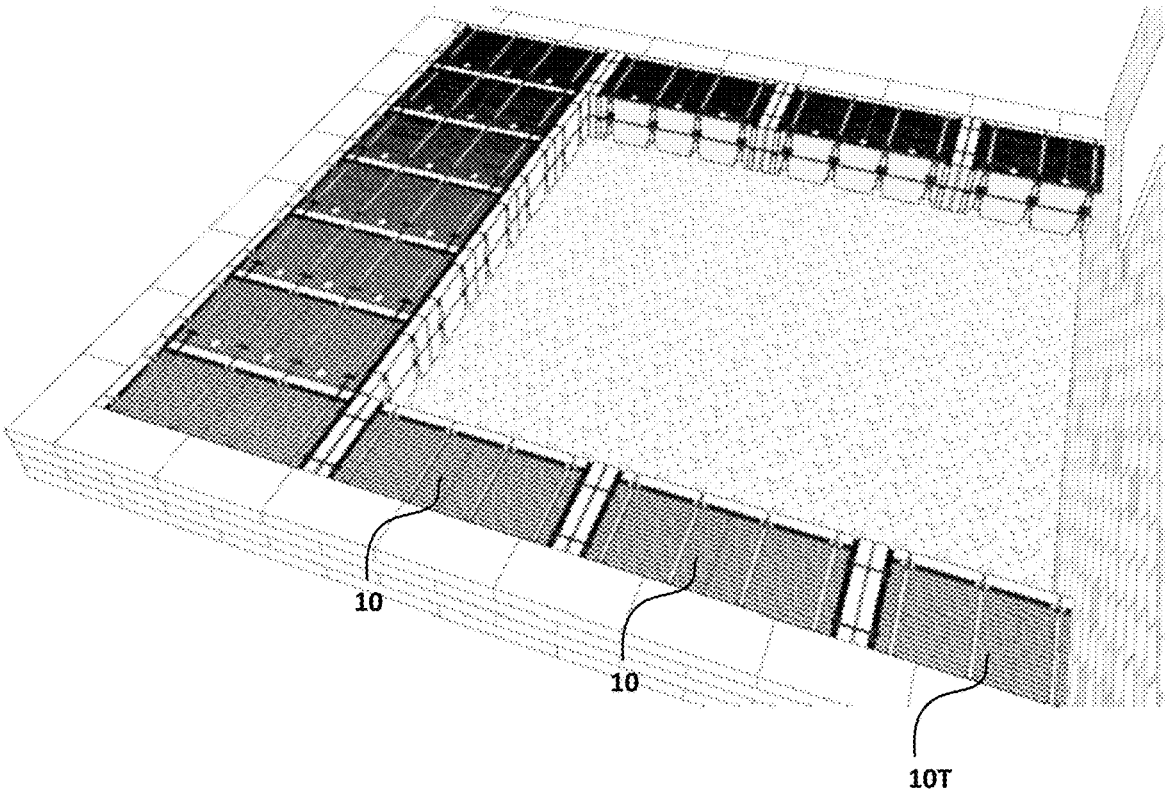
FIG. 26 is a rear perspective view of multiple courses of MSFBs adjacent to the periphery of the partially-constructed patio.

FIG. 26 is a rear perspective view of multiple courses of MSFBs 10/10T adjacent to the periphery of the blocks of the partially-constructed patio.

Figure 27:
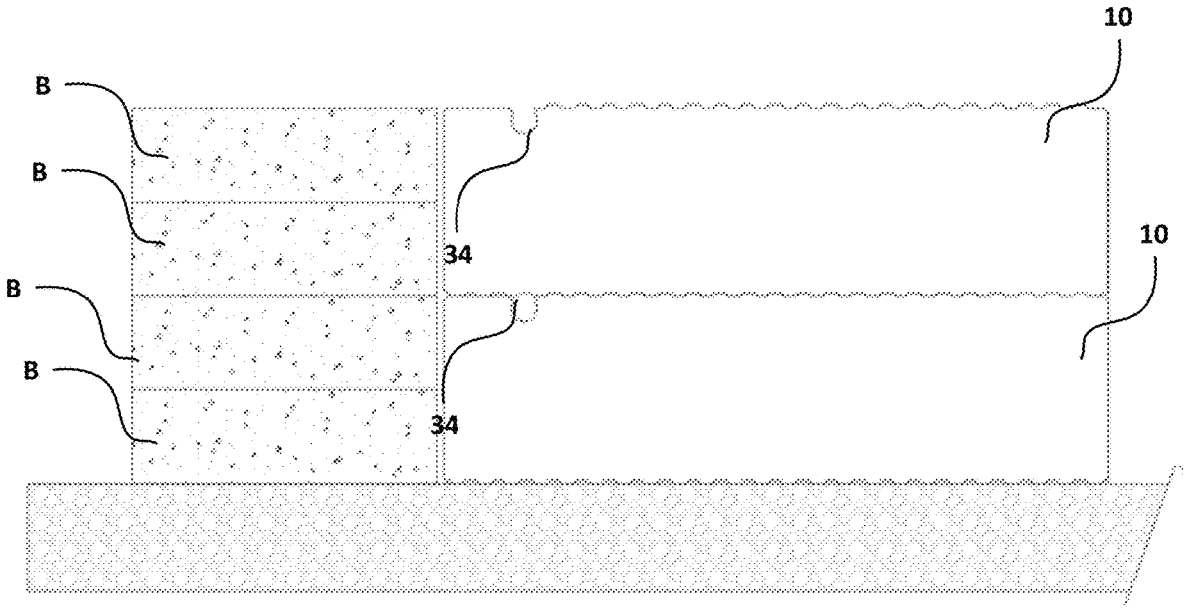
FIG. 27 is a left side cross-sectional view of a portion of a partially-constructed raised patio with two courses of MSFBs such as that in FIG. 7 and four courses of concrete blocks.

FIG. 27 is a left side cross-sectional view of a portion of a partially-constructed raised patio with two courses of MSFBs 10 and four courses of concrete blocks. Channel 34 of each MSFB 10 can be seen relative to other components in this cross-sectional view.

It will be appreciated that certain building codes/standards require that geogrid material be positioned at four (4) courses of blocks from bottom (or, for other codes/standards, at some other number of blocks from bottom), and the wall thereafter built upwards from that point. Unlike gravel backfill, MSFBs 10 do not apply any lateral earth pressure to the blocks B of the wall. However, structurally the blocks still need to be integrated with the mass of the MSFBs 10 for two main reasons; 1) to restrict any potential movement or rotation of the block facing column due to settlement of the gravel base or foundation soil it is bearing on, and 2) to resist seismic forces that may exist in some locations. In a seismic event, the block facing column is acted on by horizontal and vertical ground motion forces. The inertia of the blocks creates forces that drive the column away from the MSFBs Units. These are therefore required to be restrained.

Figure 28:
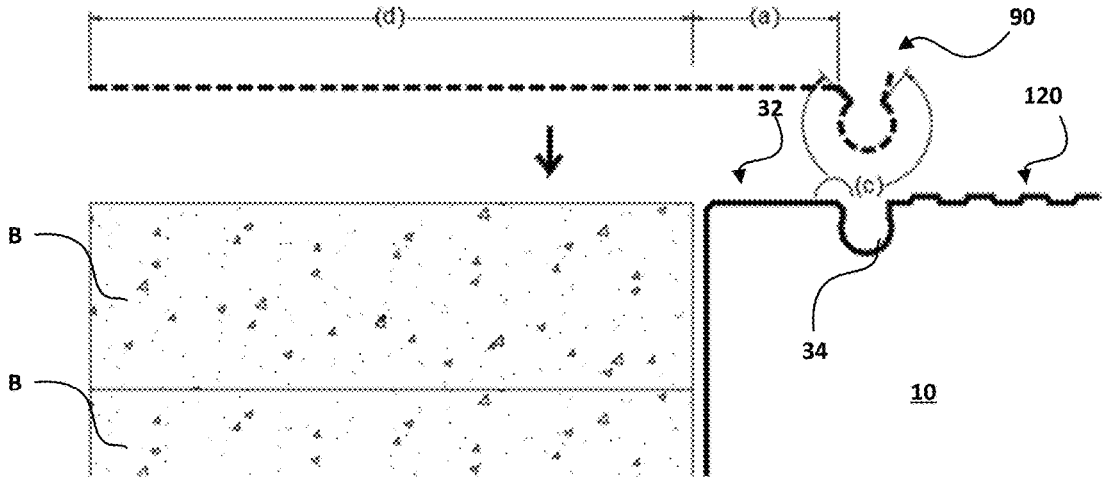
FIG. 28 is a magnified partial left side cross-sectional view of a portion of a partially-constructed raised patio showing a section of geogrid sized and configured to be retained within an open-topped channel of an MSFB.

FIG. 28 is a magnified partial left side cross-sectional view of a portion of a partially-constructed raised patio showing a section of geogrid material 90 sized and configured to be retained within an open-topped channel 34 of an MSFB 10. Geogrid material 90 has a width sufficient to be supported atop a block B of an intermediate course and a portion of apron 32, as well as received and retained within channel 34. More particularly, an segment (d) of geogrid material 90 extends more or less in a plane from the outside extent of block B to its inside extent, a segment (a) of geogrid material 90, continuous with segment (d), extends more or less in the plane from the outside extent of MSFB 10 to the edge of channel 34, and a segment (c) of geogrid material 90, continuous with segment (a), extends more or less in a plane before being a portion of it is curved to fit into channel 34 to be retained within channel 34. It will be appreciated, and as will be described, segment (d) will be sandwiched between the uppermost block B in FIG. 28 and another block B (not shown) to be placed atop. Segment (a) will be sandwiched between the MSFB 10 shown in FIG. 28 and another MSFB 10 (not shown) to be placed atop. Segment (c) will, for the most part, be retained within channel 34 but an end portion of segment (c) will also be sandwiched between the MSFB 10 shown in FIG. 28 and the other MSFB 10 (not shown) to be placed atop.

Figure 29:
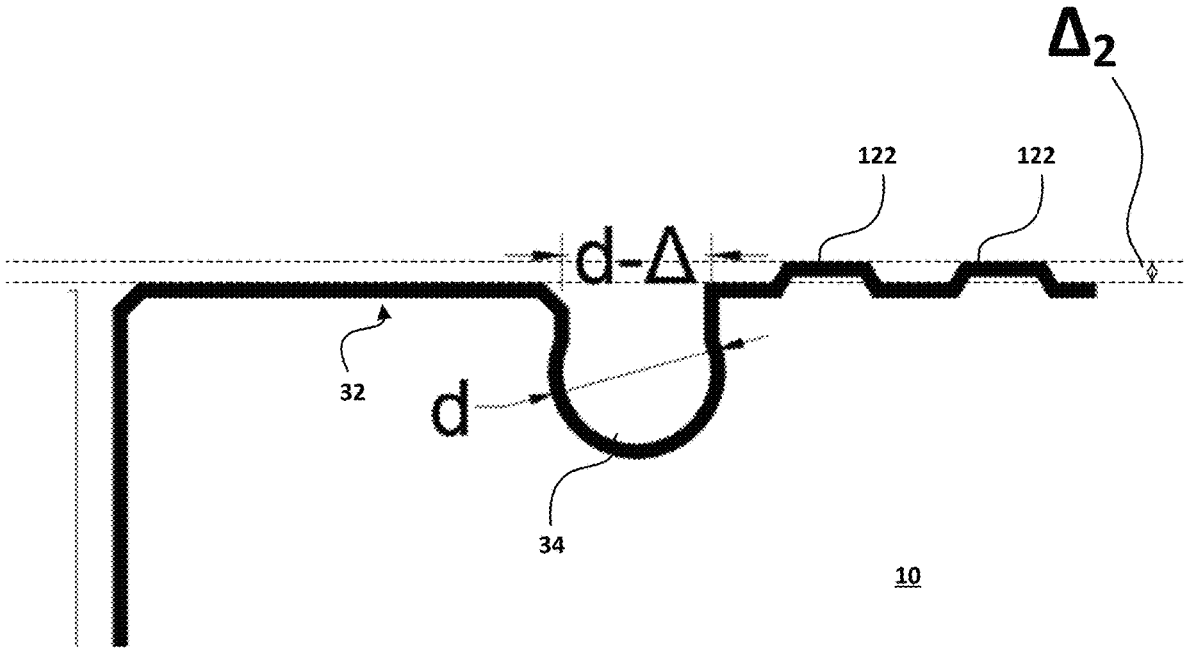
FIG. 29 is a magnified partial left side cross-sectional view of a portion of an MSFB showing relative dimensions of features of the open-topped channel, according to an example.

FIG. 29 is a magnified partial left side cross-sectional view of a portion of an MSFB 10 showing relative dimensions of features of open-topped channel 34, according to an example. In this example, channel 34 is semi-circular in cross section and the mouth of channel 34 has a width that is slightly narrower than the maximum width (i.e. maximum diameter d) of channel 34. That is, a width of d-Δ. By providing a slightly smaller mouth width, a retaining component such as the steel or plastic pipe or dowel can be pressed over segment (a) of geogrid material and into channel 34, forcing the mouth slightly open and then, as the retaining component and the corresponding segment (a) of geogrid material is seated into channel 34, the mouth resumes its original size. As the rigid foam body can be deformed slightly but is resilient, the resuming of the mouth to its original, smaller, size, acts to retain the retaining component and the segment (a) within channel 34.

Also shown in FIG. 29 is a differential $\Delta_2$ in the height (shown with dashed lines) to which apron 32 reaches (lowermost dashed line) and the height to which the flat tops of ridges 122 reach (uppermost dashed line).

Figure 30:
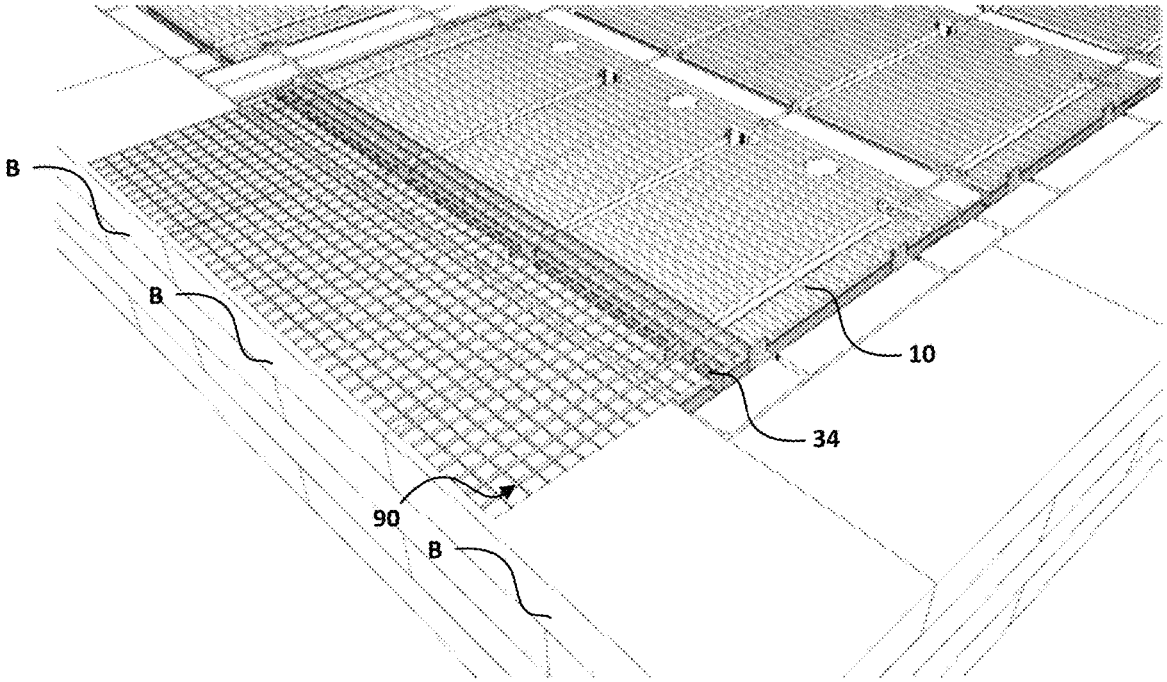
FIG. 30 is a front perspective view of a portion of a partially-constructed raised patio showing a section of geogrid being positioned over a course of concrete blocks and over a front portion of the top of an MSFB.

FIG. 30 is a front perspective view of a portion of a partially-constructed raised patio showing a section of geogrid material 90 being positioned over a course of concrete blocks B and over a front portion of the top of an MSFB 10.

Figure 31:
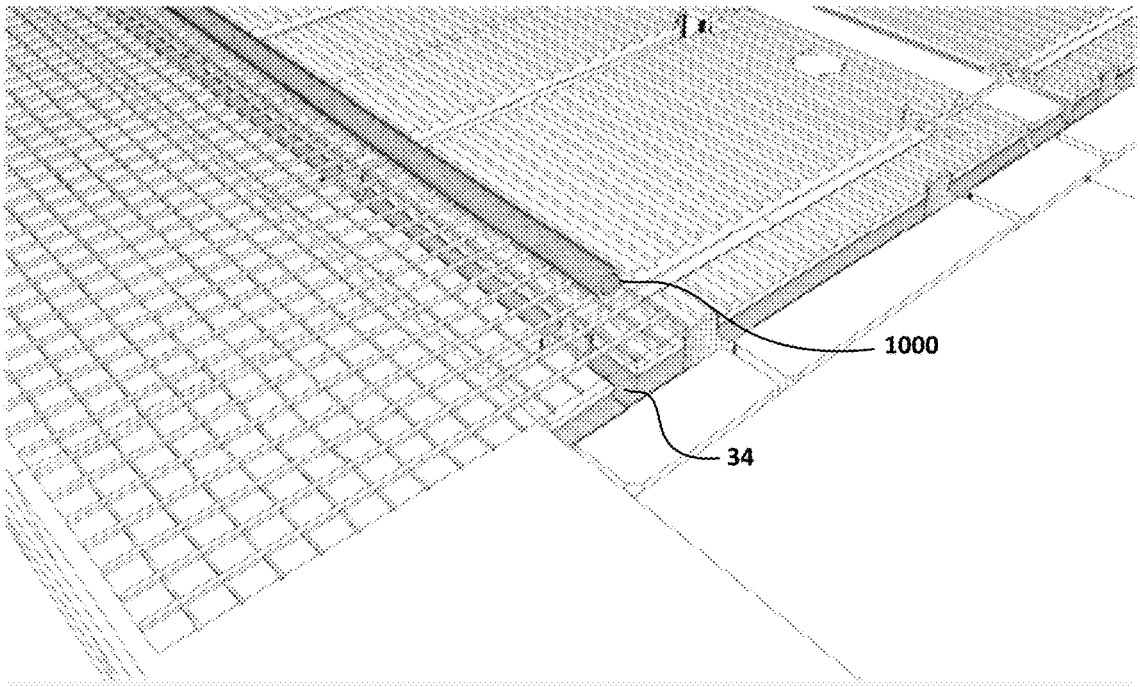
FIG. 31 is a magnified front perspective view of the portion of the partially-constructed raised patio of FIG. 30, showing a cylindrical pipe positioned above the geogrid in alignment with an open-topped channel of the MSFB in preparation for lodging a section of the geogrid within the open-topped channel.

FIG. 31 is a magnified front perspective view of the portion of the partially-constructed raised patio of FIG. 30, showing a cylindrical pipe 1000 as the retaining component being positioned above the geogrid material 90 in alignment with the open-topped channel 34 of MSFB 10 in preparation for lodging segment (a) of geogrid material 90 within open-topped channel 34.

Figure 32:
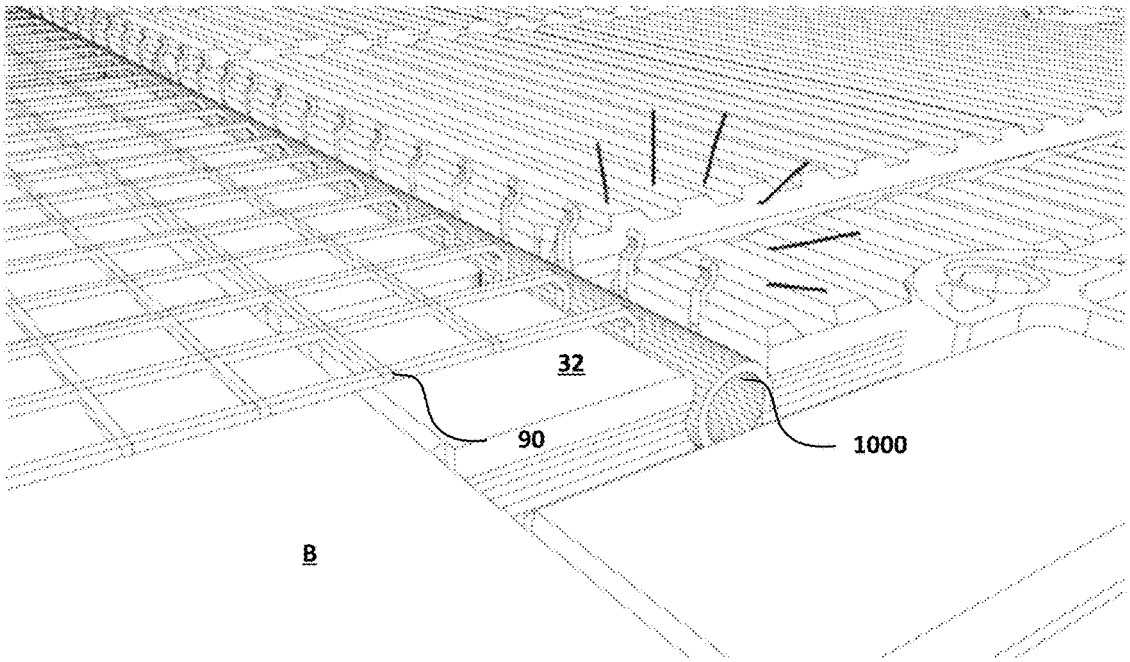
FIG. 32 is a magnified front perspective view of the portion of the partially-constructed raised patio of FIG. 31, showing the cylindrical pipe having been forced downwards to push a section of the geogrid into the open-topped channel of the MSFB to retain the section of the geogrid in the open-topped channel.

FIG. 32 is a magnified front perspective view of the portion of the partially-constructed raised patio of FIG. 31, showing the cylindrical pipe 1000 having been forced downwards to push section (a) of geogrid material 90 into open-topped channel 34 of MSFB 10 to retain section (a) of geogrid material 90 in open-topped channel 34.

Figure 33:
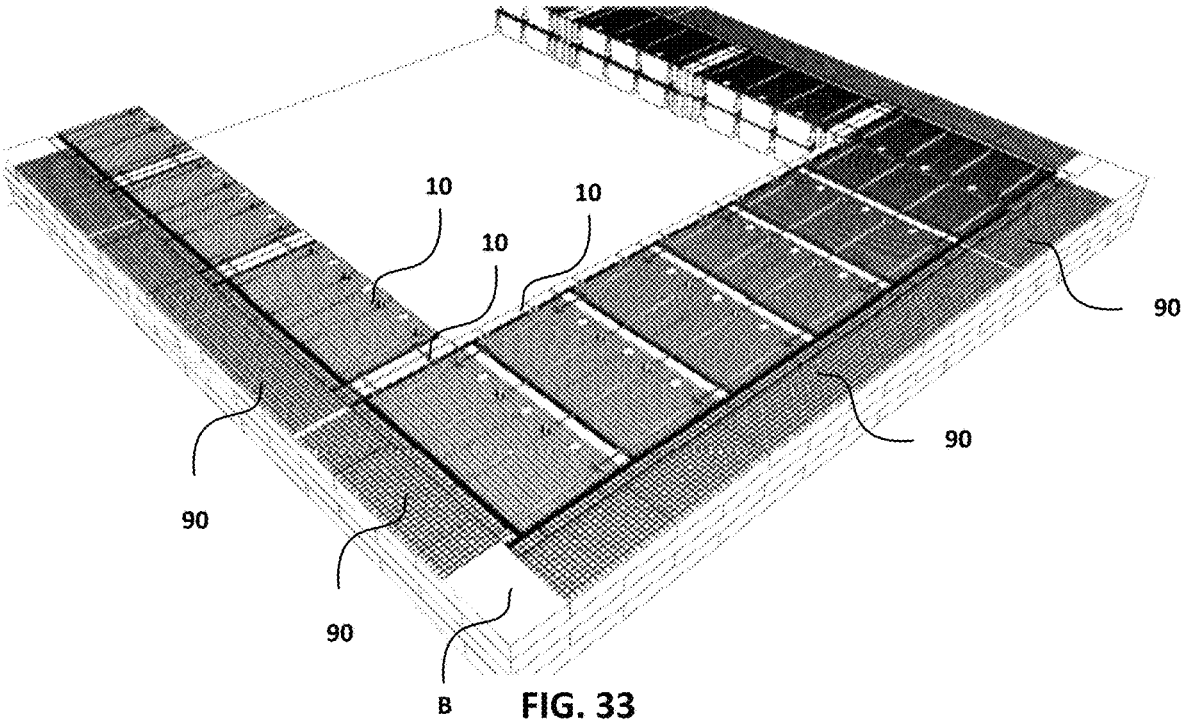
FIG. 33 is a front perspective view of a partially-constructed raised patio with sections of geogrid extending across a course of the concrete blocks and having been retained within respective open-topped channels of respective MSFBs.

FIG. 33 is a front perspective view of a partially-constructed raised patio with sections of geogrid material 90 extending across a course of the concrete blocks B and having been retained within respective open-topped channels 34 of respective MSFBs 10.

Figure 34:
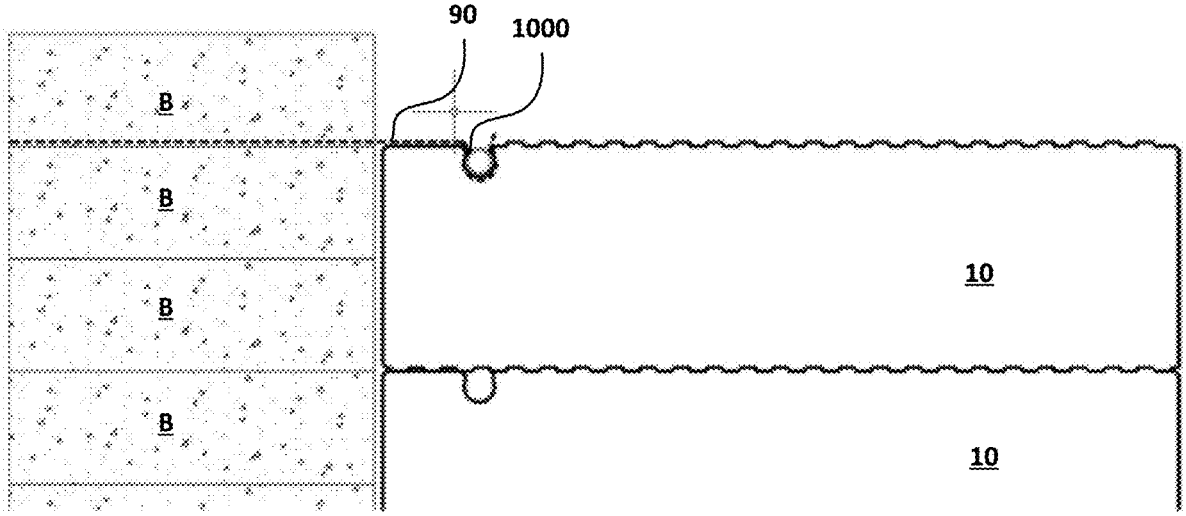
FIG. 34 is a left side cross-sectional view of a portion of a partially-constructed raised patio showing a section of geogrid positioned over a course of concrete blocks and retained in the open-topped channel of an MSFB, and a further course of concrete blocks placed atop the geogrid in alignment with the course below.

FIG. 34 is a left side cross-sectional view of a portion of a partially-constructed raised patio showing a section of geogrid material 90 positioned over a course of concrete blocks B and retained in the open-topped channel 34 of a respective MSFB 10, and a further course of concrete blocks B placed atop the segment (d) of geogrid material 90 in alignment with the course below.

Figure 35:
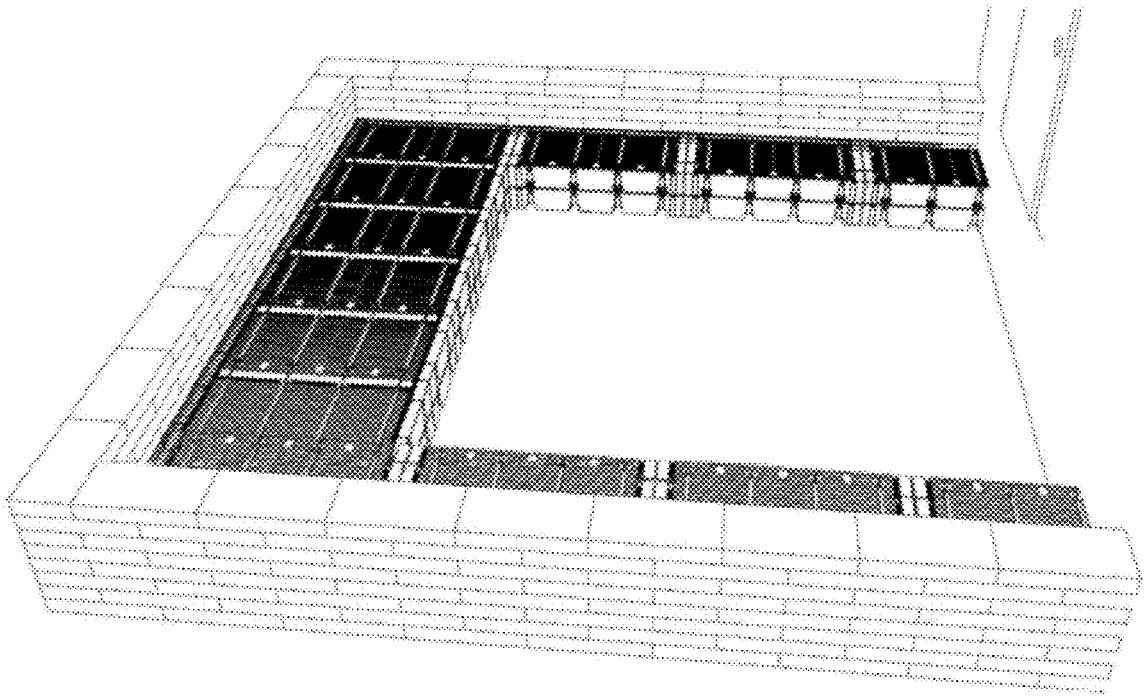
FIG. 35 is a rear perspective view of a partially-constructed raised patio showing successive courses of concrete blocks positioned atop geogrid in alignment with courses below.

FIG. 35 is a rear perspective view of a partially-constructed raised patio showing successive courses of concrete blocks B positioned atop geogrid material 90 in alignment with courses below.

Figure 36:
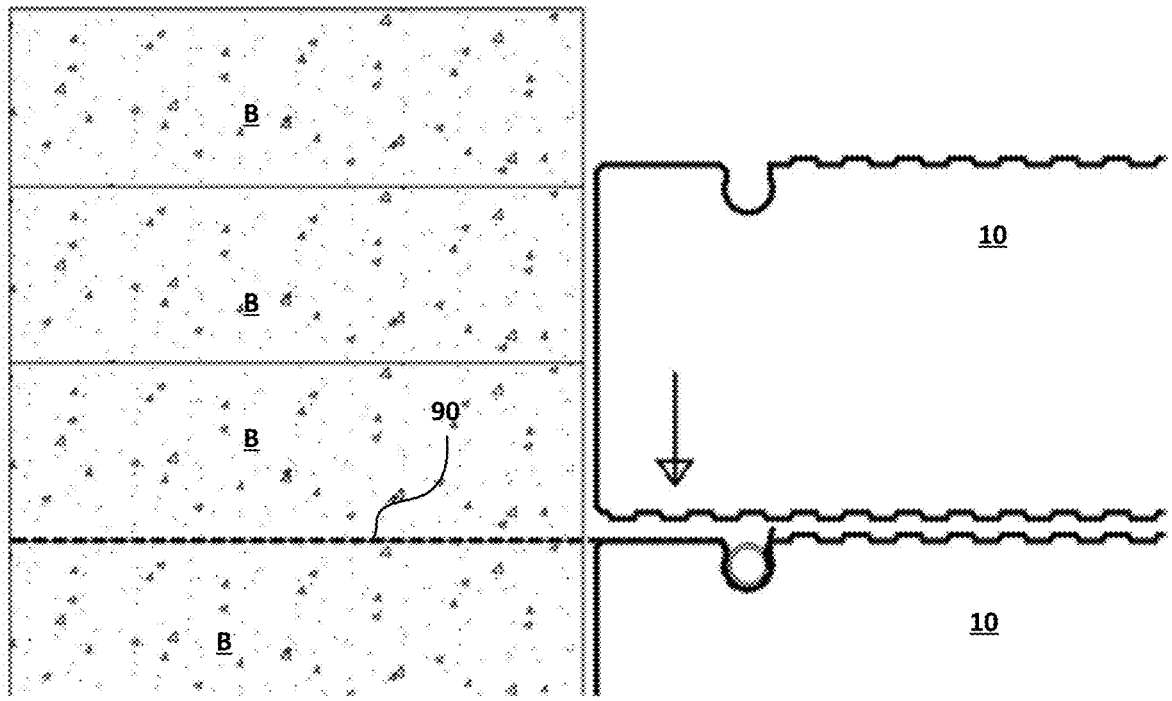
FIG. 36 is a left side cross-sectional view of a portion of a partially-constructed raised patio showing a section of geogrid positioned over a course of concrete blocks and retained in the open-topped channel of an MSFB, three further courses of concrete blocks placed atop the geogrid in alignment with the courses below, and another like MSFB positioned to be placed atop the MSFB in which the geogrid is being retained.

FIG. 36 is a left side cross-sectional view of a portion of a partially-constructed raised patio showing a section of geogrid material 90 positioned over a course of concrete blocks B and retained in the open-topped channel 34 of an MSFB 10. Also shown are three further courses of concrete blocks B placed atop the geogrid material 90 in alignment with the courses below, and another like MSFB 10 positioned to be placed atop the MSFB 10 in which the geogrid material 90 is being retained.

Figure 37:
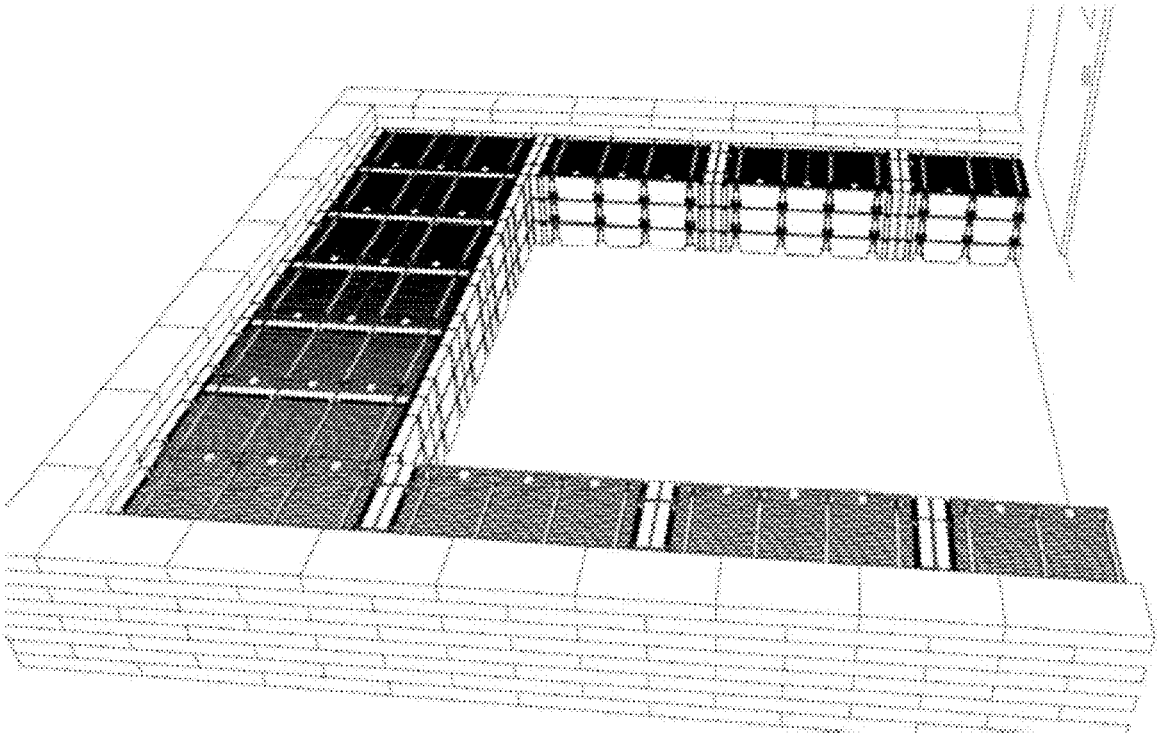
FIG. 37 is a rear perspective view of a partially-constructed raised patio showing successive courses of MSFBs positioned atop and in alignment with MSFBs in lower courses.

FIG. 37 is a rear perspective view of a partially-constructed raised patio showing successive courses of MSFBs 10 positioned atop and in alignment with MSFBs 10 in lower courses.

Figure 38:
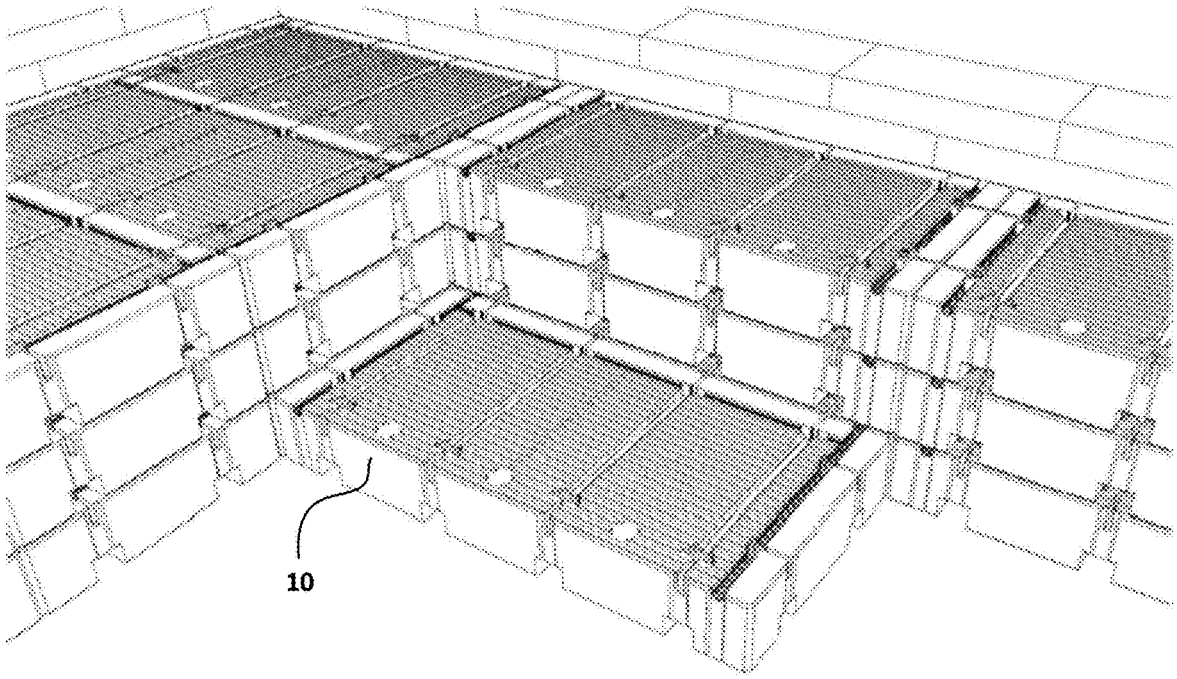
FIG. 38 is a rear perspective view of a portion of a partially-constructed raised patio showing an MSFB being positioned adjacent to other MSFBs to continue a second row of a first course.

FIG. 38 is a rear perspective view of a portion of a partially-constructed raised patio showing an MSFB 10 being positioned adjacent to other MSFBs 10 to continue a second row of a first course.

Figure 39:
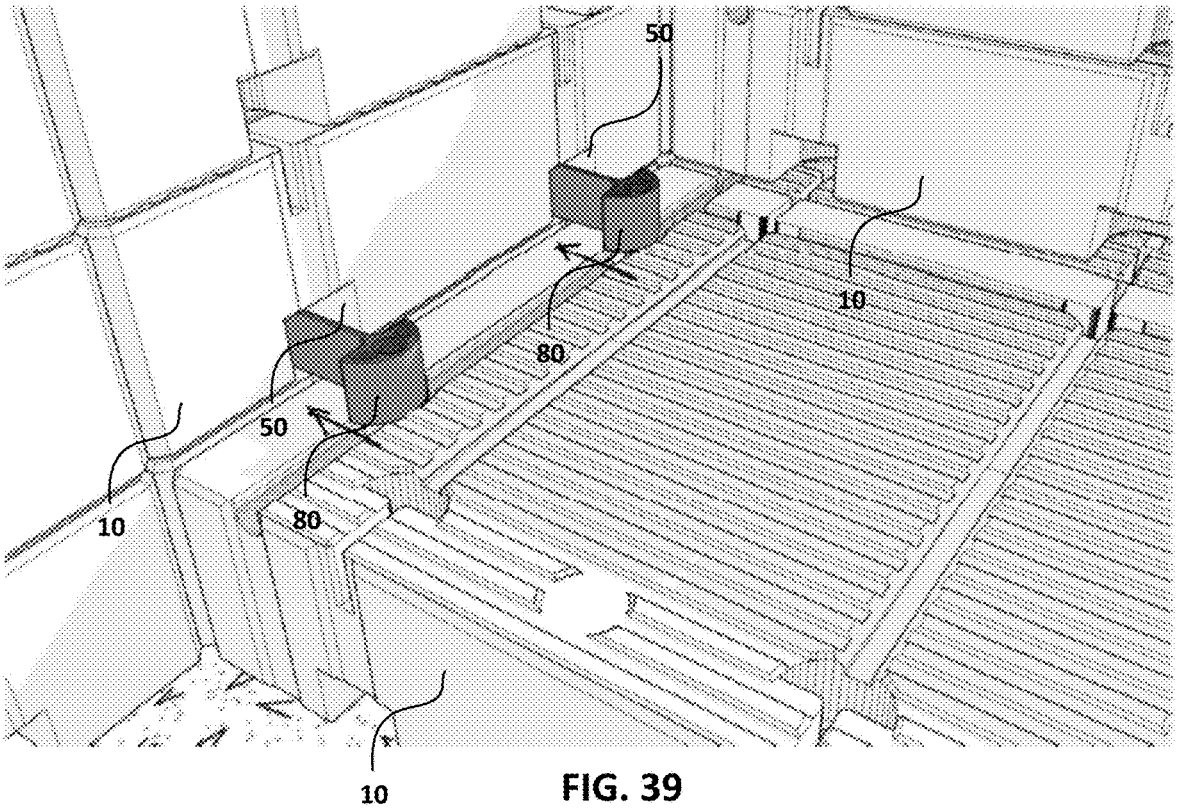
FIG. 39 is a magnified rear perspective view of the MSFB positioned adjacent to other MSFBs to continue the second row of the first course of FIG. 38, with male-type connectors being positioned into respective cavities of MSFBs in a higher course of MSFBs so as to be positioned to be inserted into female-type lateral interlock interfaces of the MSFB and an adjacent MSFB in the same course.

FIG. 39 is a magnified rear perspective view of the MSFB 10 positioned adjacent to other MSFBs 10 to continue the second row of the first course of FIG. 38. In this view, male-type connectors 80 are being positioned into respective cavities 50 of MSFBs 10 in a higher course of MSFBs 10 so as to be positioned to be inserted into female-type lateral interlock interfaces 40 of the MSFB 10 and an adjacent MSFB 10 in the same course.

Figure 40:
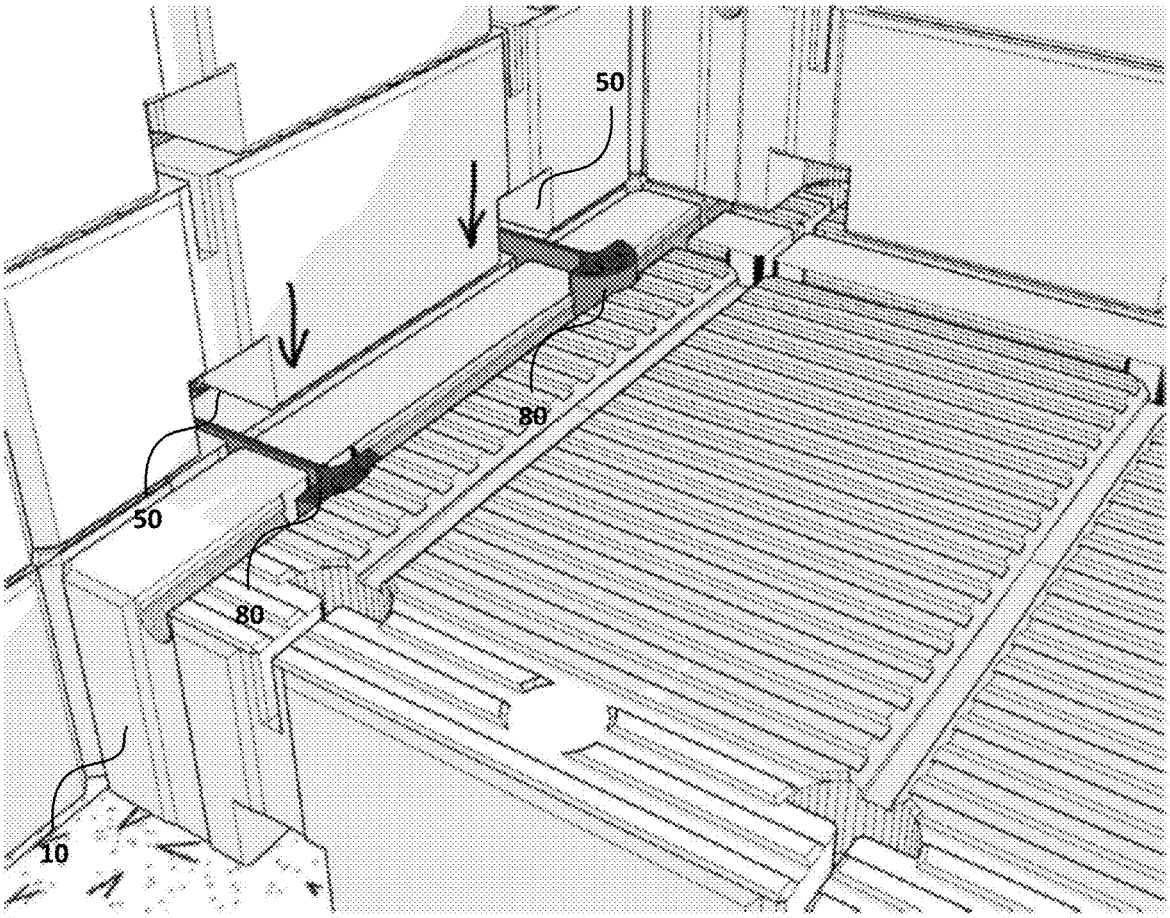
FIG. 40 is a magnified rear perspective view of the MSFB positioned adjacent to other MSFBs to continue the second row of the first course of FIG. 39, with the male-type connectors having been inserted through respective cavities of MSFBs in the higher course of MSFBs and then inserted into the female-type lateral interlock interfaces of the MSFB and an adjacent MSFB in the same course.

FIG. 40 is a magnified rear perspective view of the MSFB 10 positioned adjacent to other MSFBs 10 to continue the second row of the first course of FIG. 39. The male-type connectors 80 have since been inserted through respective cavities 50 of MSFBs 10 in the higher course of MSFBs 10 and then inserted into the female-type lateral interlock interfaces 40 of the MSFB 10 and an adjacent MSFB 10 in the same course.

Figure 41:
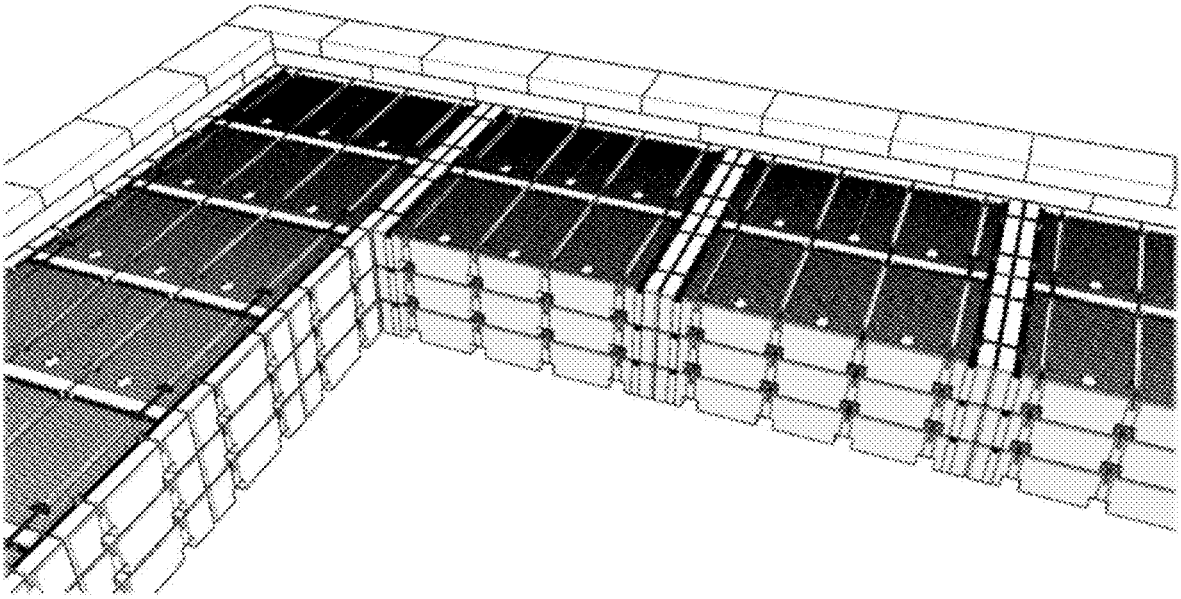
FIG. 41 is a rear perspective view of a portion of a partially-constructed raised patio showing multiple courses of a second row of MSFBs having been positioned and horizontally-interlocked with adjacent MSFBs.

FIG. 41 is a rear perspective view of a portion of a partially-constructed raised patio showing multiple courses of a second row of MSFBs 10 having been positioned and horizontally-interlocked with adjacent MSFBs 10.

Figure 42:
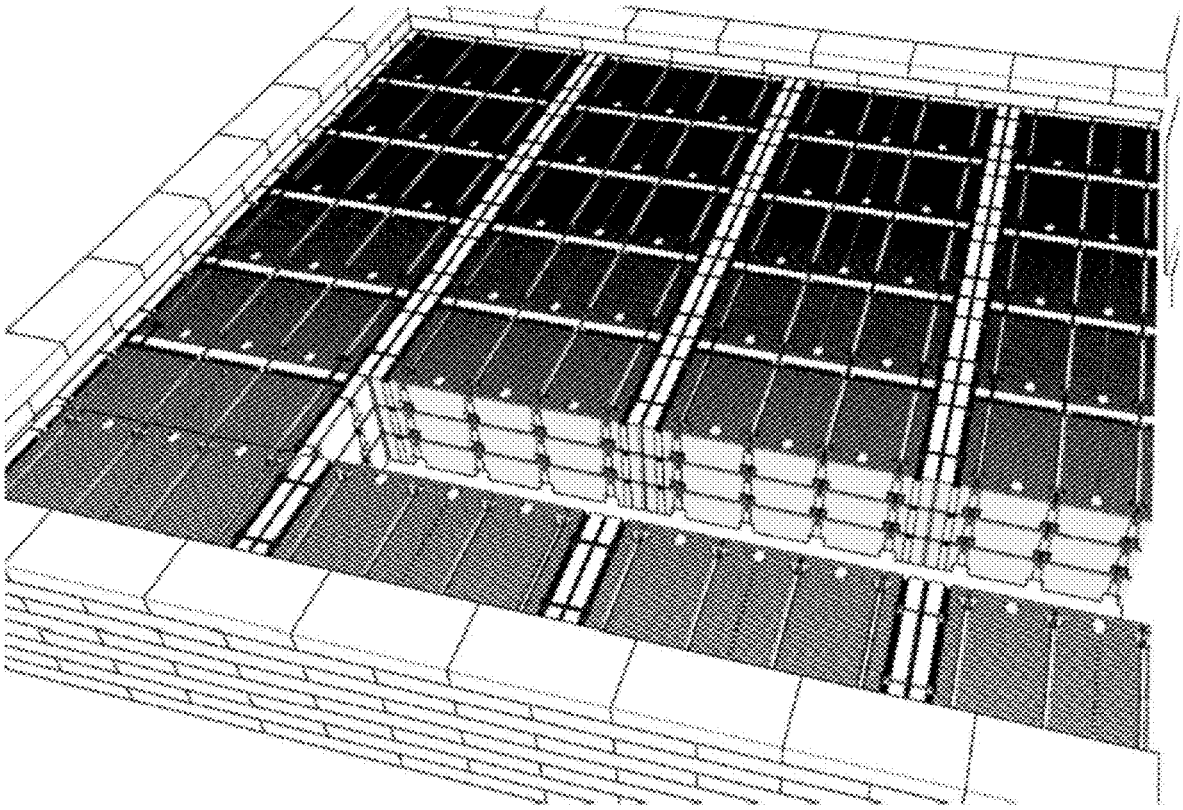
FIG. 42 is a rear perspective view of a portion of a partially-constructed raised patio showing multiple courses of second and subsequent rows of MSFBs having been positioned and horizontally-interlocked with adjacent MSFBs.

FIG. 42 is a rear perspective view of a portion of a partially-constructed raised patio showing multiple courses of second and subsequent rows of MSFBs 10 having been positioned and horizontally-interlocked with adjacent MSFBs 10.

Figure 43:
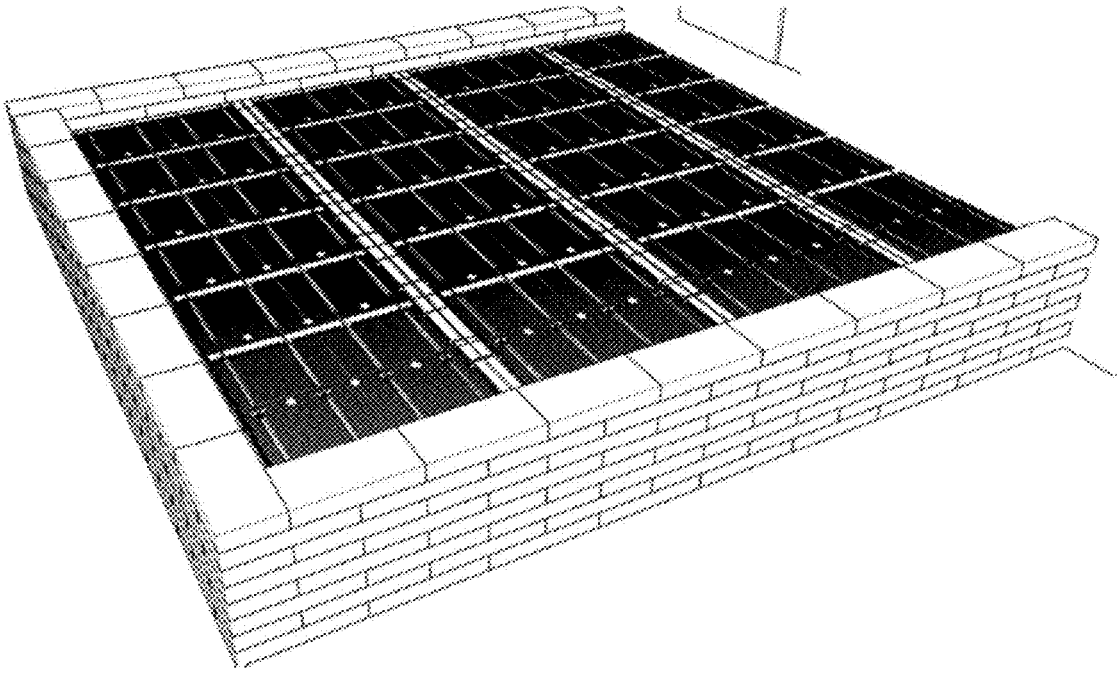
FIG. 43 is a side perspective view of a portion of a partially-constructed raised patio showing all courses of second and subsequent rows of MSFBs having been positioned and horizontally-interlocked with adjacent MSFBs.

FIG. 43 is a side perspective view of a portion of a partially-constructed raised patio showing all courses of second and subsequent rows of MSFBs 10 having been positioned and horizontally-interlocked with adjacent MSFBs 10.

Figure 44:
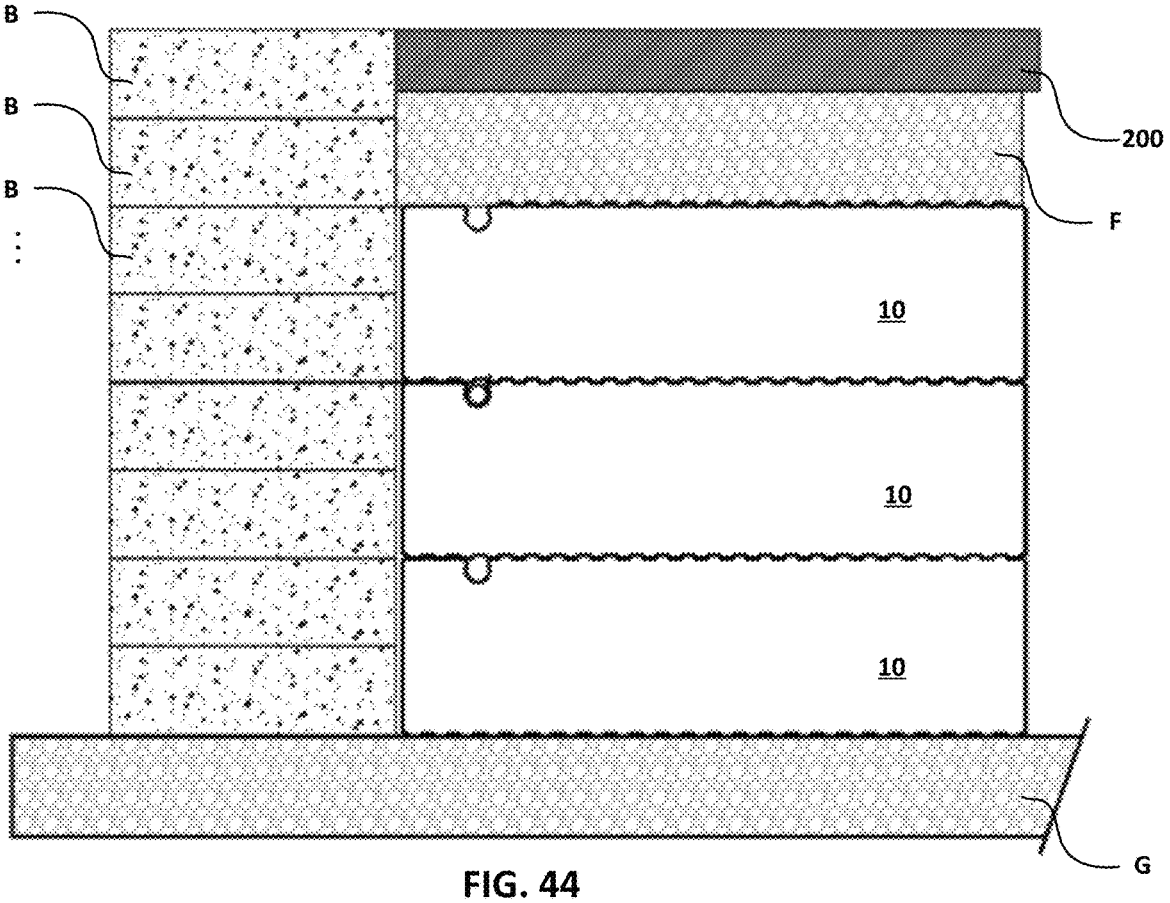
FIG. 44 is a left side cross-sectional view of a portion of a finished raised patio.

FIG. 44 is a left side cross-sectional view of a portion of a finished raised patio. The finished raised patio has a sufficient number of MSFBs 10 for the main volume of fill. A thin layer of gravel fill F has been placed and levelled atop the topmost layer of the MSFBs 10. On top of the levelled thin layer of gravel fill F is positioned paving stones 200 that are level with a topmost of blocks B. It will be appreciated that, if the number of courses since the course on which the geogrid material 90 was placed exceeds a threshold amount (such as four more courses), another treatment with geogrid material 90 and its retention in channels 34 and sandwiching between blocks B and subsequent MSFBs 10, may be required.

Figure 45:
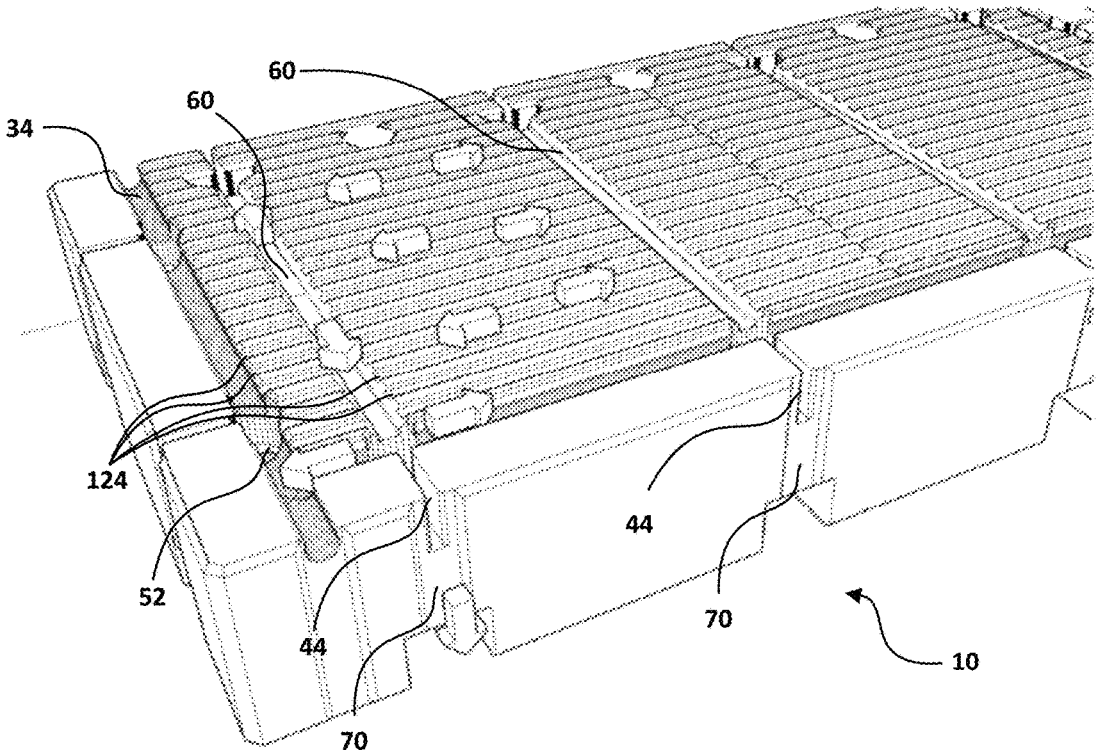
FIG. 45 is a front perspective view of the MSFB of FIG. 7, showing directions of moisture flow through ridges forming the vertical interlock system, open-topped channels, and neck sockets of female-type lateral interlock interfaces.
Figure 46:
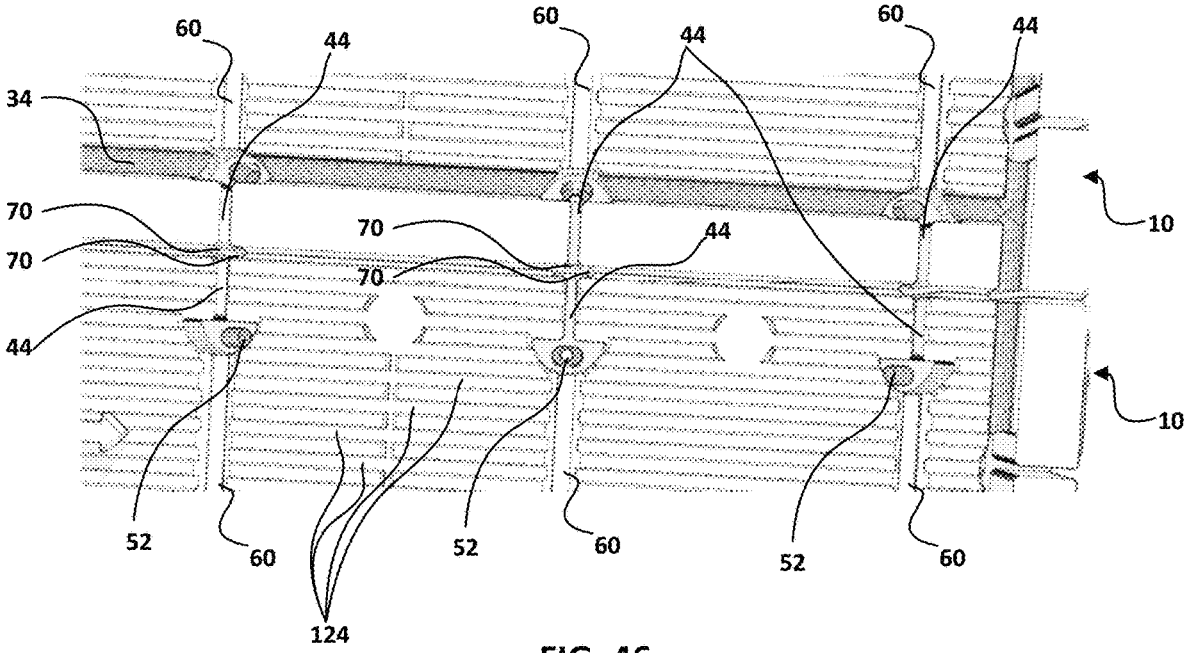
FIG. 46 is a partial top view of multiple of the MSFB of FIG. 7 positioned adjacent to one another.

It will be appreciated that paving stones 200, and more particularly structures of which paving stones 200 are a top part, do not render an overall patio to be impervious to moisture such as water entering the structures. Because of this, in this example, MSFB 10 itself includes structures for, and has structures that also do, draining of liquid that may come into contact with top side 12 of MSFB 10. FIG. 45 is a front perspective view of the MSFB of FIG. 7, showing—with arrows—directions of moisture flow in (a) gaps 124 between ridges 122 forming the vertical interlock system 120, as well as through (b) open-topped conduits 60, through (c) open-topped channel 34, through (d) neck sockets 44 of female-type lateral interlock interfaces 40, and through (d) shafts 52 and through (e) open-topped conduits 70. Also, FIG. 46 is a partial top view of multiple MSFBs 10 positioned adjacent to one another. Many of these features are created to be in fluid communication with one another in the sense that liquid in or on one of these features on top side 12 can flow into or onto another of these features so as to be conveyed outward and downward off of top side 12. For example, gaps 124 (only a few or which are referenced in FIGS. 45 and 46) are in fluid communication with channel 34 and with conduits 60, and conduits 60 are in fluid communication with nearby female-type lateral interlock interfaces 40, and head sockets 42 of the female-type lateral interlock interfaces 40 are in fluid communication with nearby shafts 52, and neck sockets 44 of the female-type lateral interlock interfaces 40 are in fluid communication with nearby open-topped conduits 70. Because of the structures being, in this sense, in fluid communication with one another in addition to having primary functions as described herein, it is less easy for liquids to pool on top side 12 in lieu of being conveyed off of top side 12. Furthermore, the open-topped conduits 70 of adjacent blocks, as shown in FIG. 46 in particular, face each other and thus do not block liquid from dropping down the sides of MSFBs 10 along these open-topped conduits 70.

Figure 47:
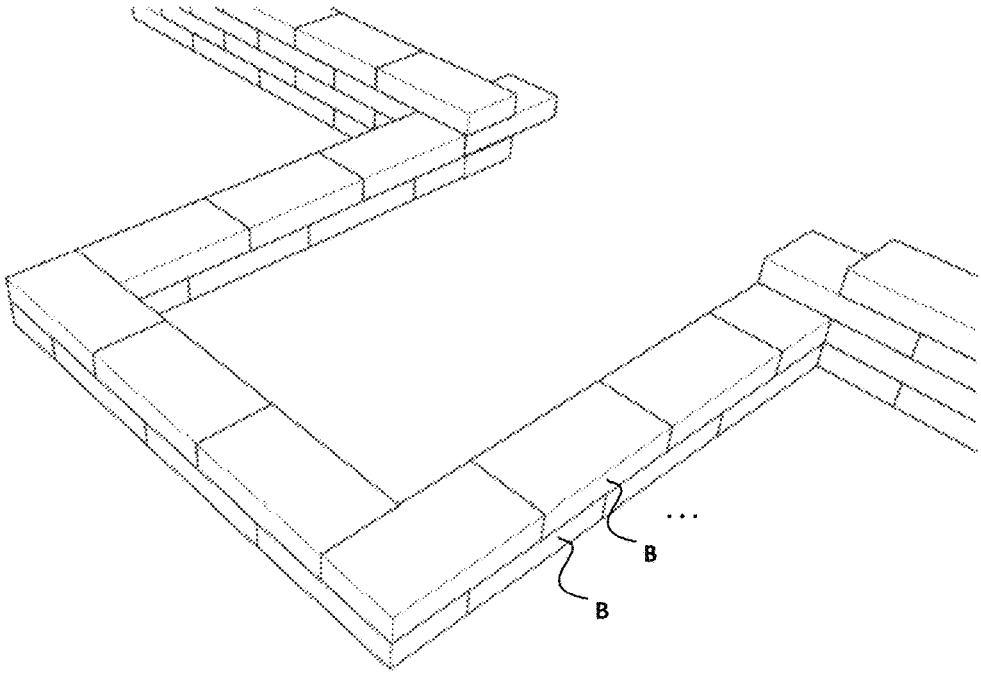
FIG. 47 is a front perspective view of partially-constructed steps.

It will be appreciated that, in additional to being useful for constructing raised patios, MSFBs 10 are useful for constructing exterior step/stair structures (or, "steps"). FIG. 47 is a front perspective view of partially-constructed steps. As is similar to the raised patio construction, a perimeter of the steps is constructed to a height of one (1) MSFB 10. In the example shown in FIG. 47, this is two courses of blocks B.

Figure 48:
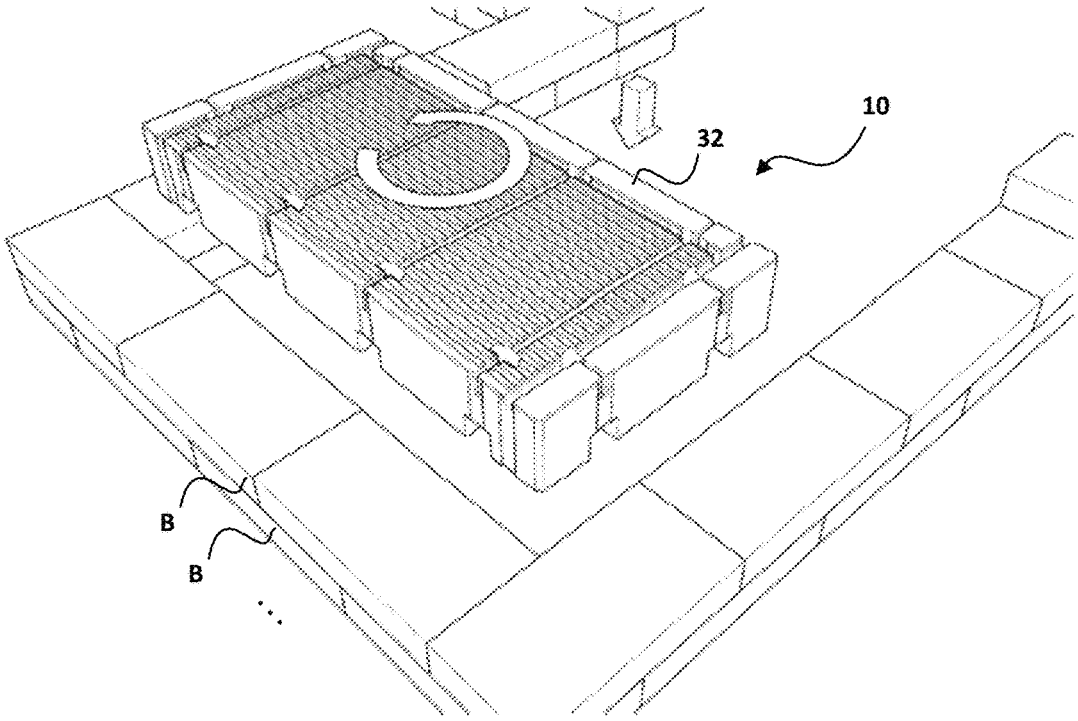
FIG. 48 is a front perspective view of the partially-constructed steps of FIG. 47, with an MSFB of FIG. 7 having been oriented for positioning adjacent concrete blocks of the partially-constructed steps.
Figure 49:
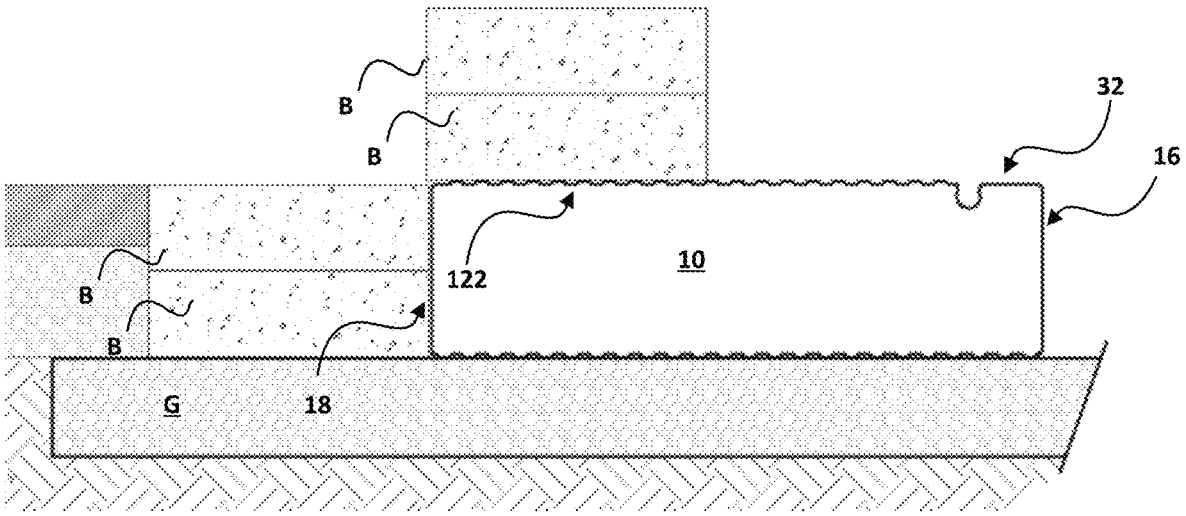
FIG. 49 is a left-side cross-sectional view of a portion of partially-constructed steps.

An MSFB 10 is placed within the perimeter formed by blocks B. However, for the steps, the first MSFB 10 is oriented at 180 degrees (as compared with for a raised patio) with respect to the blocks B so that the apron 32—being of a lesser height than ridges 124—is facing away from the front of the step structure rather than being adjacent to the front of step structure. FIG. 48 is a front perspective view of the partially-constructed steps of FIG. 47, with an MSFB 10 having been oriented for positioning adjacent concrete blocks B of the partially-constructed steps, and FIG. 49 is a left-side cross-sectional view of a portion of partially-constructed steps. In a raised patio application, in order to provide a sloping grade (1%-2%) to direct water off of the patio and away from the building, a gravel fill F is placed atop the topmost MSFB 10 to allow the installer to establish the slope using the gravel fill F. This gravel fill F also serves to fill in the difference in height between apron 32 and the top of ridges 122 at the top of the structure, so that patio stones are supported evenly across their span by the gravel fill F.

However, in the case of steps, because the step tread can be horizontal (i.e. without a sloping grade), step stones (shown as blocks B in FIG. 49 atop MSFB 10) can be installed directly into MSFB 10 without an intervening gravel fill F. If such a step stone were placed atop of MSFB 10 to be vertically aligned with front side 16, it would be supported by both apron 32 and ridges 122, which would cause it to be supported off-horizontal due to the height differential (see FIG. 29 in particular). Therefore, by providing an MSFB 10 in which apron 32 does not extend adjacent to rear side 18 along top side 12, ridges 122 can extend fully back to adjacent to rear side 18 along top side 12 thereby providing full horizontal support of that step stone across its span.

Figure 50:
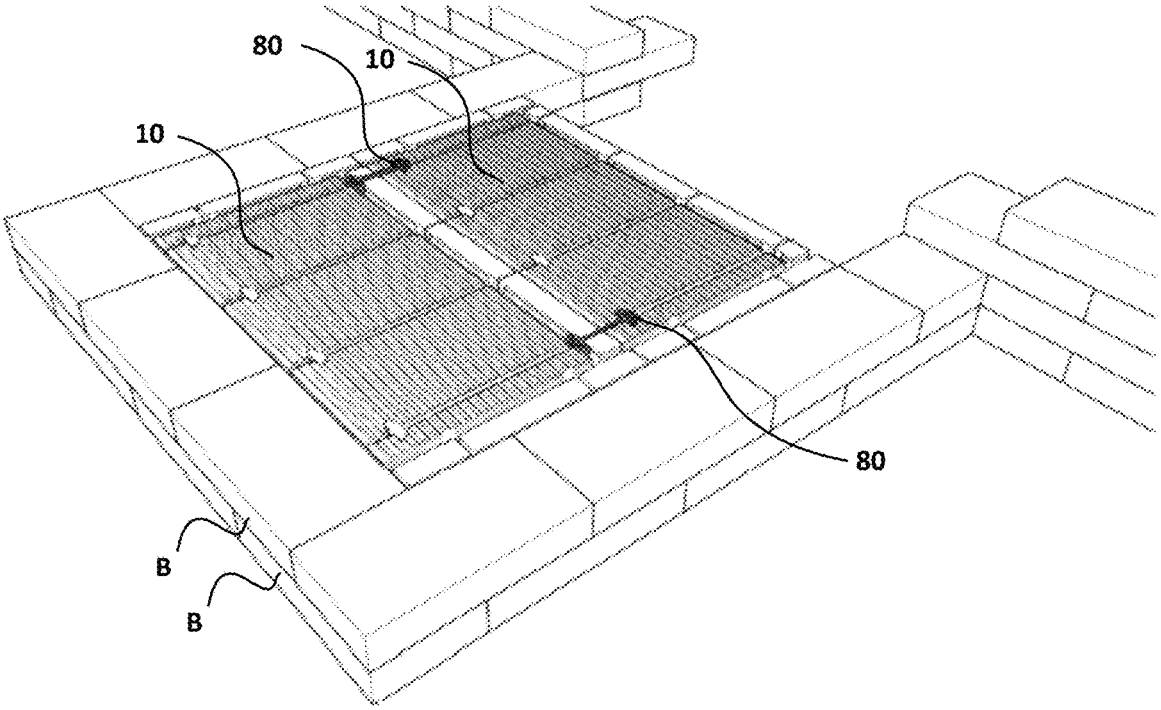
FIG. 50 is a front perspective view of the partially-constructed steps of FIG. 48, with two MSFBs of FIG. 7 having been oriented and placed adjacent to each other in a first course, as well as having been horizontally interlocked with one another.

FIG. 50 is a front perspective view of the partially-constructed steps of FIG. 48, with two MSFBs 10 having been oriented and placed adjacent to each other in a first course, as well as having been horizontally interlocked with one another using two male-type connectors 80.

Figure 51:
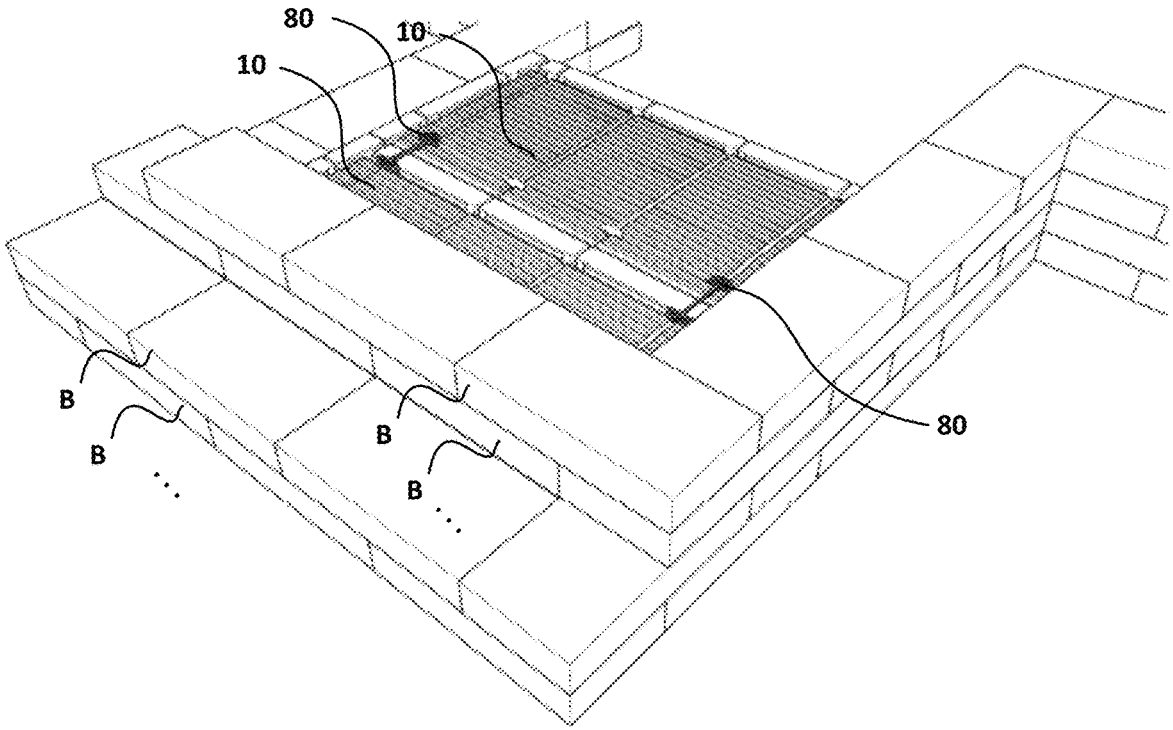
FIG. 51 is a front perspective view of partially-constructed steps, with additional courses of concrete blocks having been added in alignment with lower courses.

FIG. 51 is a front perspective view of partially-constructed steps, with additional courses of concrete blocks B having been added in alignment with lower courses and atop underlying MSFBs 10.

Figure 52:
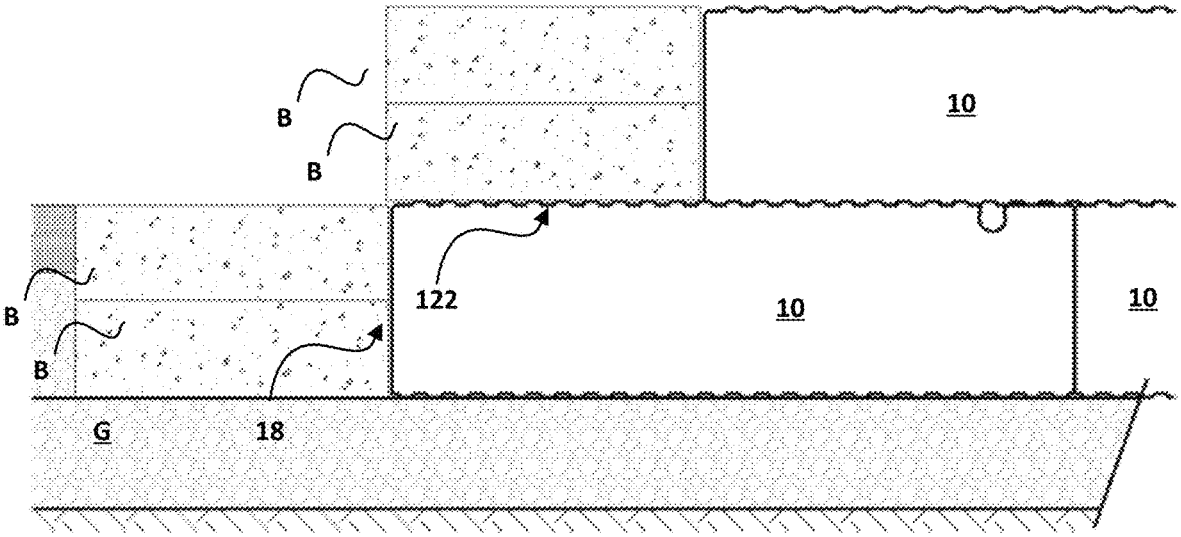
FIG. 52 is a left-side cross-sectional view of a portion of partially-constructed steps.

FIG. 52 is a left-side cross-sectional view of a portion of partially-constructed steps, having the additional course of MSFB 10 placed adjacent to the step stones, and having ridges 142 of the uppermost MSFB 10 received within corresponding gaps 124 of two lower-course MSFBs 10 thereby to provide a vertical interlock with both. It will be appreciated that the structures and positions of ridges and gaps 122/124/142/144 provides flexibility to an installer for providing varying steps sizes each of which can be accommodated while also enabling vertical interlock even between "offset" MSFBs 10 placed one atop the other.

Figure 53:
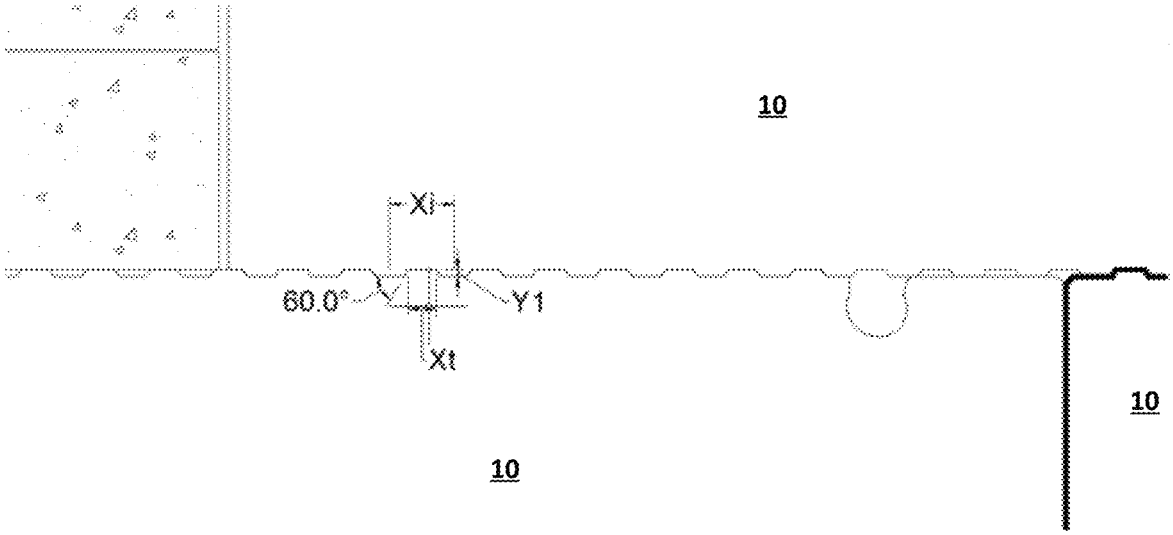
FIG. 53 is a magnified left-side cross sectional view of a portion of partially constructed steps, showing ridges of the vertical interlock system of the MSFB of FIG. 7.

Ridges 122/142 and their corresponding gaps 124/144 are sized and positioned to enable a "step back" increment that is compatible with the wall/patio or step system being constructed. For example, in one example a step increment is 25 mm to enable arrangements of typical or common step tread depths of between 250 mm-325 mm. It will be appreciated that various building codes allow less or more tread depth. As such, in this example, the spacing and geometry of ridges/gaps 122/142/124/144 are such that they provide interlock between MSFBs 10 in compatible increments, while ensuring the surface area of the tops of the ridges and their front-to-rear widths are sufficient to inhibit undue compression of the EPS material. FIG. 53 is a magnified left-side cross sectional view of a portion of partially constructed steps, showing ridges and gaps of adjacent MSFBs 10 in different courses interfacing with each other. Given a desired setback width Xi (whose typical value might be 25 mm), the bearing pad surface width (Xt) has to be sufficient to provide bearing resistance against the load of the step stones as well as pedestrian loads without crushing or compressing beyond about 1% to about 2%. These amounts are generally considered to be the serviceability limit of deformation of the EPS for the present applications. As such, a depth of Y1 (corresponding to $\Delta_2$ in FIG. 29) was determined based on an Xt width ratio of approximately 4:1. The sloping sides or ridges 122/142 are, in this example, approximately 60 degrees to maintain the width to depth ratio of the ridges to 4:1 when considering the increment Xt. It will be appreciated that ridges 122 continue to interlock with those ridges 142 of the adjacent unit behind the first unit as well as those of the first unit when the units are stepped back as shown in FIG. 52.

It may be desired or required that a layer of foam adhesive, not shown, be added between adjacent MSFBs 10 of different courses.

Figure 54:
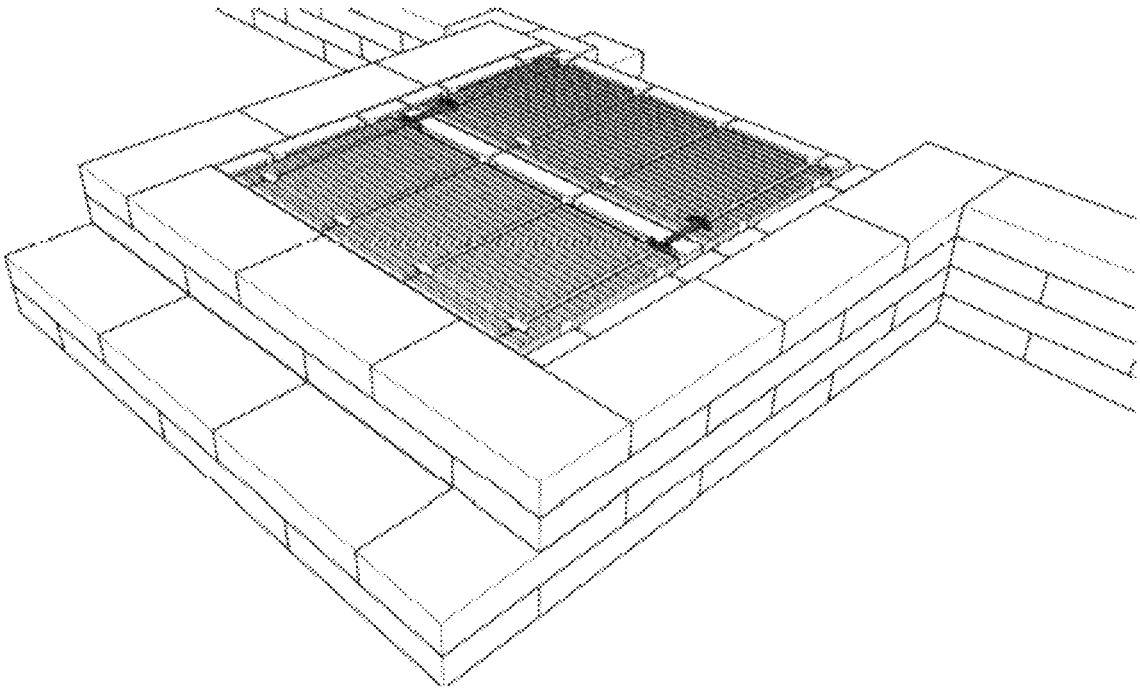
FIG. 54 is a front perspective view of partially-constructed steps of FIG. 51, with additional courses of MSFBs having been added in alignment with lower courses.
Figure 55:
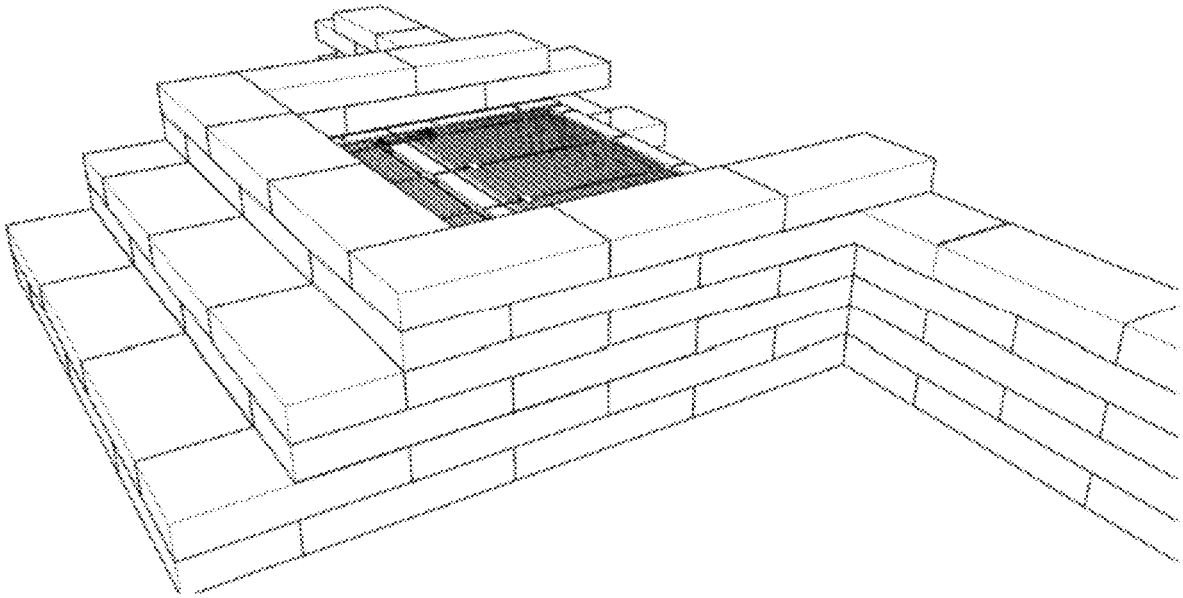
FIG. 55 is a front perspective view of partially-constructed steps, with additional courses of concrete blocks having been added in alignment with lower courses.

FIG. 54 is a front perspective view of partially-constructed steps of FIG. 51, with additional courses of MSFBs 10 having been added atop lower courses, showing the progressive construction of the steps. FIG. 55 is a front perspective view of partially-constructed steps, with still additional courses of concrete blocks B having been added in alignment with lower courses.

The process of constructing the outer perimeter of the steps and filling the volume within the perimeter with MSFBs 10 continues until a desired step height is reached.

Figure 56:
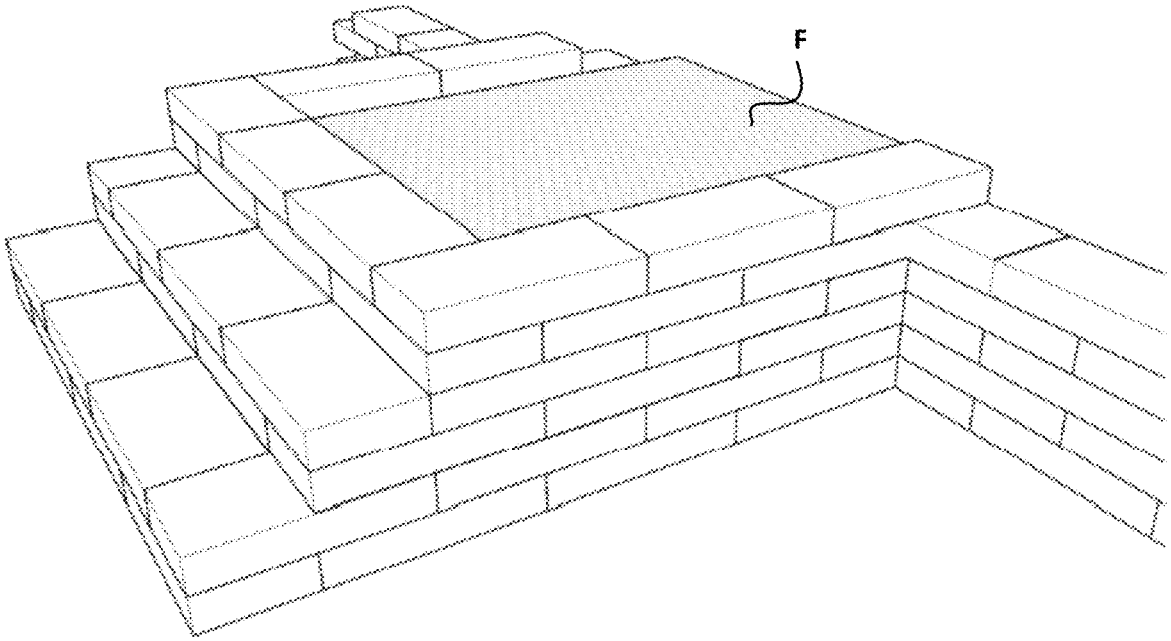
FIG. 56 is a front perspective view of partially-constructed steps, with a gravel fill having been added to the top of the topmost course of MSFBs and levelled.
Figure 57:
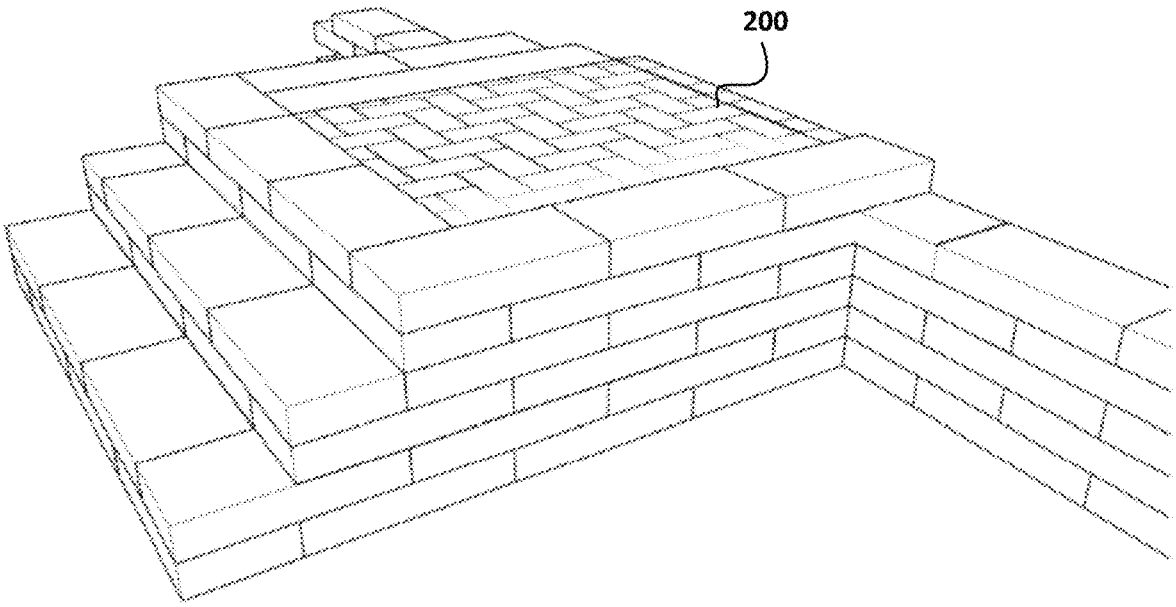
FIG. 57 is a front perspective view of finished steps, with patio stones having been placed atop the gravel fill.

For the last course, if there is required to be a landing at the top of the steps, a gravel fill F is used to create and grade the landing space, followed by paving stones 200. FIG. 56 is a front perspective view of partially-constructed steps, with the gravel fill F having been added to the top of the topmost course of MSFBs 10 and graded. FIG. 57 is a front perspective view of finished steps, with patio/paving stones 200 having been placed atop the gravel fill F.

Figure 58:
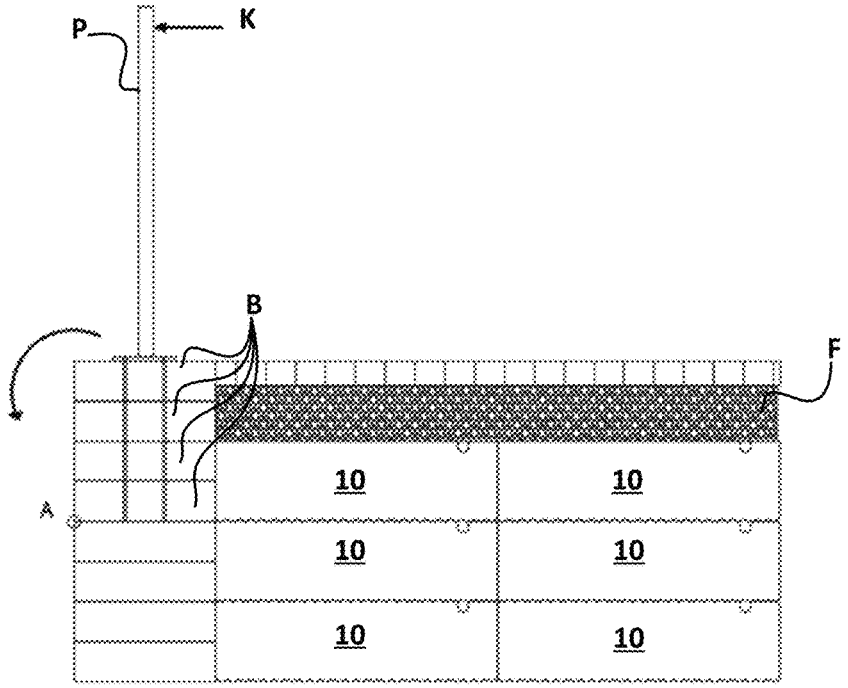
FIG. 58 is a left side cross-sectional view of a portion of a finished patio, with a handrail atop a topmost course of the concrete blocks and showing a direction in which the handrail could overturn about a pivot point.
Figure 59:
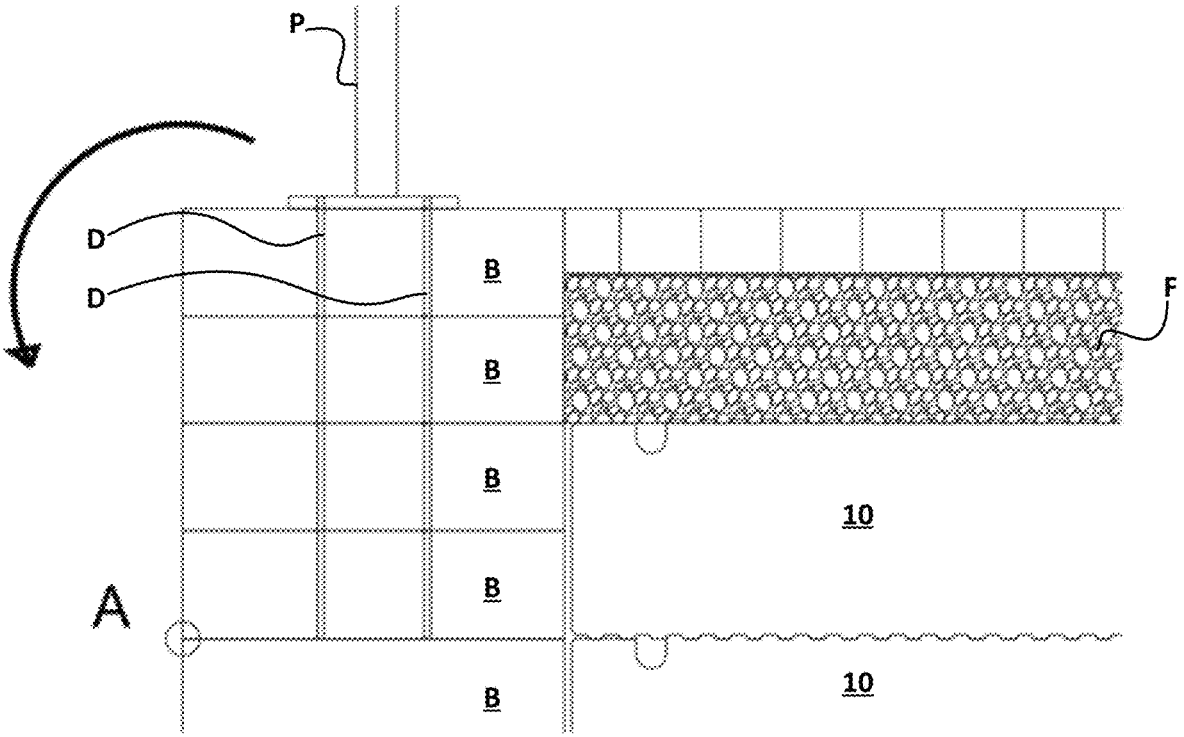
FIG. 59 is a magnified left side cross-sectional view of a portion of the finished patio of FIG. 58.

It will be appreciated that a building code may require a pedestrian guard or handrail where grade differences exceed 0.6 m-1.0 m, whether for steps or for raised patios. It has been discovered that the stiffness and rigidity of the rigid foam body of MSFB 10 provides opportunities to make use of the mass to anchor a pedestrian guard against overturning. FIG. 58 is a left side cross-sectional view of a portion of a finished patio, with a pedestrian guard P—a handrail—atop a topmost course of the concrete blocks B and showing with a counter-clockwise arrow a direction in which the handrail could overturn about a pivot point A. FIG. 59 is a magnified left side cross-sectional view of a portion of the finished patio of FIG. 58.

By way of further explanation, as shown in FIG. 58, when a pedestrian guard P such as a post or a handrail is secured to the top of the retaining wall formed of blocks B, a building code may require that the pedestrian guard P be able to restrain a specified force K acting at a specified distance from the patio grade. This force K represents a pedestrian load acting near the top of the pedestrian guard P. Force K near the top of pedestrian guard P creates an overturning moment on the wall to which it is secured, about a pivot point A, the overturning moment represented by the counterclockwise arrow. In order to comply with the code or at least to ensure a safe and suitable pedestrian guard P, the wall and related systems must have a mass sufficient to resist the overturning moment applied by the pedestrian load.

It is common to create a system in which several blocks B are secured together to provide at least part of the resisting mass. As can be seen in FIG. 59, in this case, steel dowels D are used to connect four (4) courses of wall blocks B. The steep dowels D are typically rebar affixed with epoxy, or concrete anchors. The rotation point is therefore about the point A at the bottom corner of the lowermost of these four (4) wall blocks B. However, it may be the case that the wall blocks B are not alone sufficiently massive to resist the large moment produced by force K on pedestrian guard P. Because of this, it may be useful for the wall blocks B to be further reinforced to provide additional resistance to the rotation. Therefore, to enable the incorporation of greater resistance using MSFBs 10, the male-type connectors 80 when received into female-type lateral interlock interfaces are utilized as kinds of anchors for reinforcements, as will be shown and described.

Figure 60:
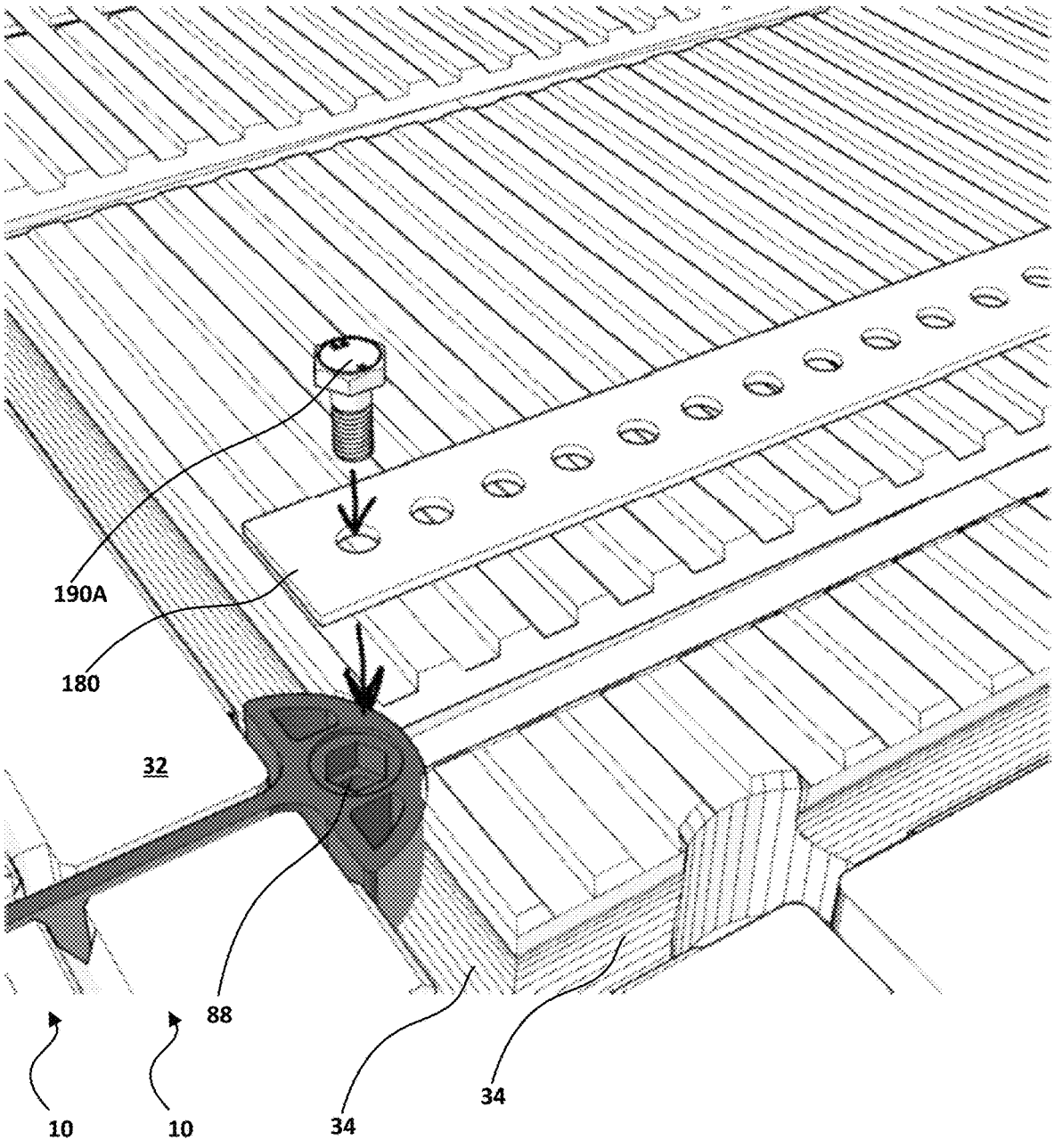
FIG. 60 is a magnified perspective view of portions of two adjacent MSFBs horizontally interconnected with one another using a male-type connector, and a reinforcing strap connected to the male-type connector using a threaded fastener.
Figure 61:
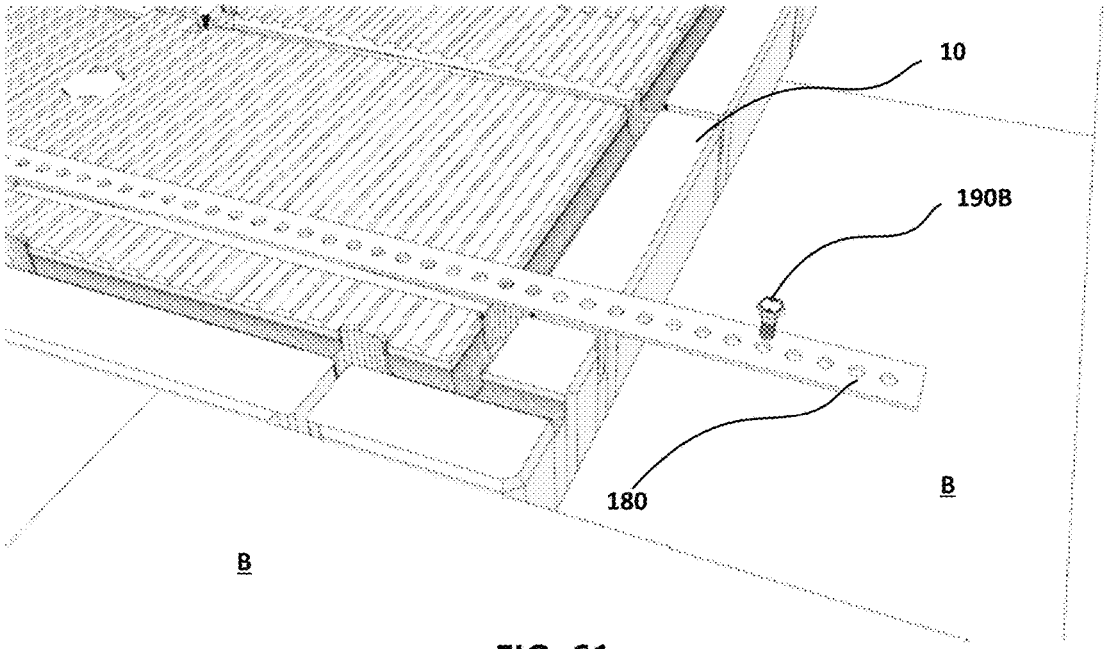
FIG. 61 is a magnified perspective view of a portion of an MSFB and a reinforcing strap extending across the MSFB to be connected to an adjacent concrete block with a fastener.
Figure 62:
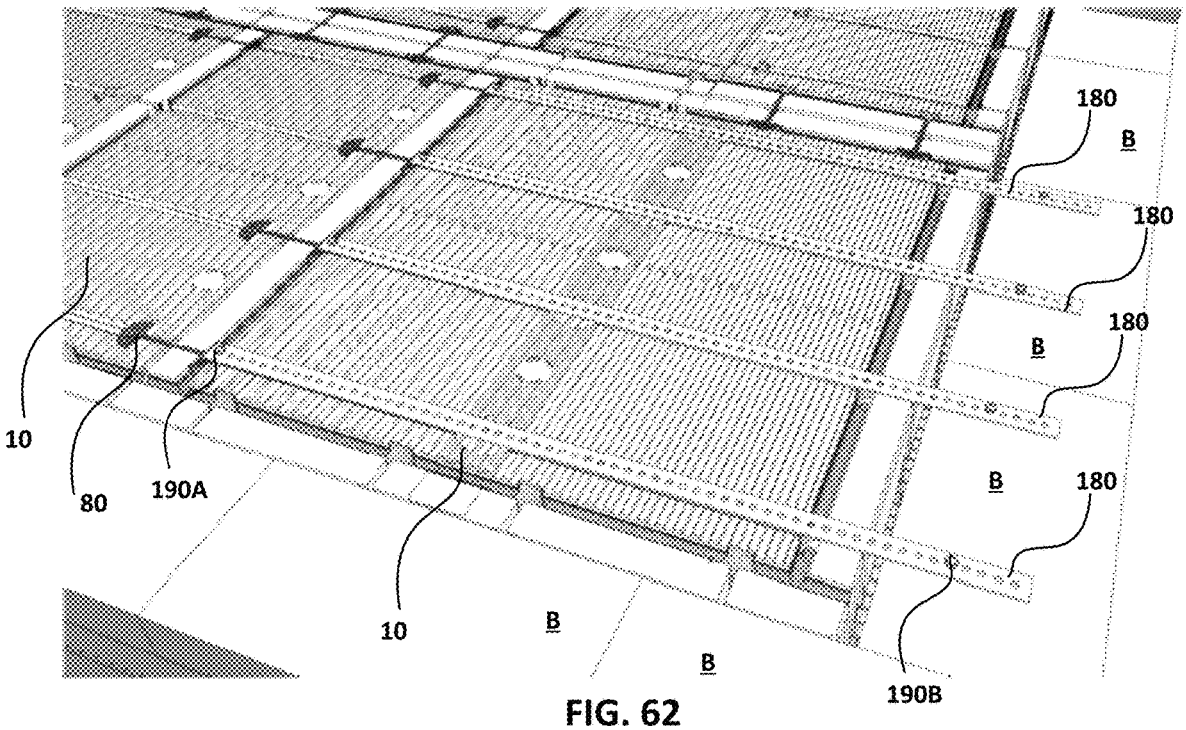
FIG. 62 is a magnified perspective view of an MSFB with multiple reinforcing straps connected with respective threaded fasteners to respective male-type connectors received, in turn, within female-type lateral interlock interfaces, the reinforcing straps each extending across the MSFB to be connected to adjacent concrete blocks with a respective fastener.

FIG. 60 is a magnified perspective view of portions of two adjacent MSFBs 10 horizontally interconnected with one another using a male-type connector 80, and a reinforcing strap 180 connected to the male-type connector 80 using a threaded fastener 190A threaded into threaded female receptacle 88. Threaded fastener 190A may be a threaded screw or bolt. FIG. 61 is a magnified perspective view of a portion of the MSFB 10 of FIG. 60 and the reinforcing strap 180 extending across the MSFB 10 to be connected to an adjacent concrete block B with a fastener 190B. FIG. 62 is a magnified perspective view of the MSFB 10 with multiple reinforcing straps 180 connected with respective threaded fasteners 190A to respective male-type connectors 80 received, in turn, within respective female-type lateral interlock interfaces. The reinforcing straps 180 each extend across the MSFB 10 to be connected to adjacent concrete blocks B with a respective fastener 190B. Fasteners 190B may be a threaded screw or bolt suitable for being affixed into concrete blocks, such as concrete anchors.

Figure 63:
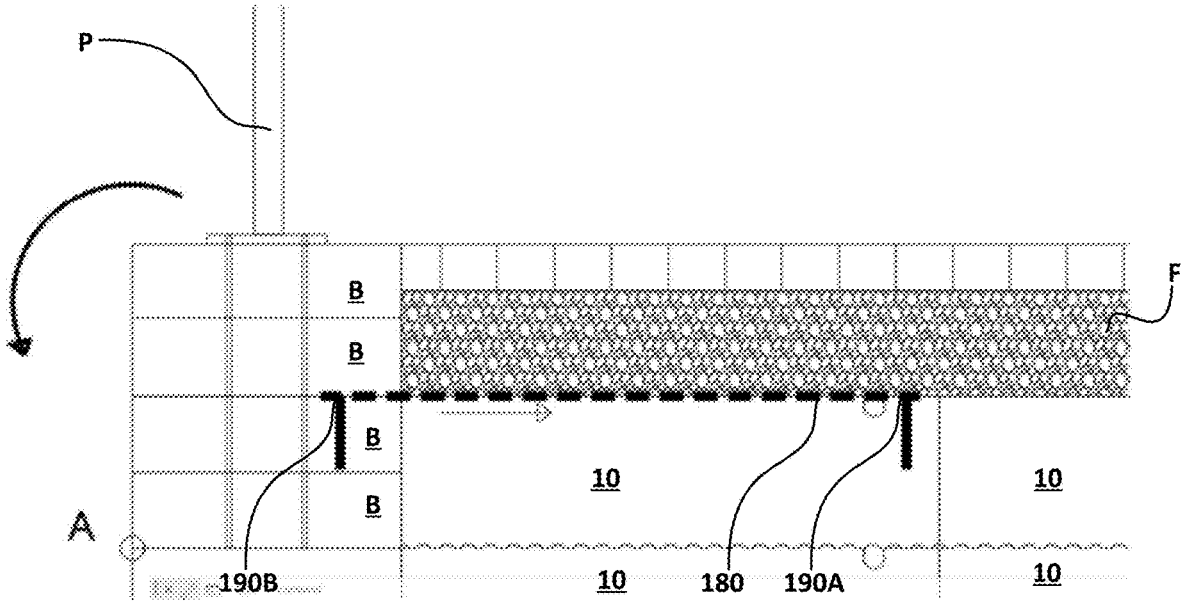
FIG. 63 is a left side cross-sectional view of a portion of a finished patio, with a handrail atop a topmost course of the concrete blocks and showing a reinforcing strap connected to and extending between a concrete block and a male-type connector received within a female-type lateral interlock interface of an adjacent MSFB, thereby to inhibit overturning of the handrail.

FIG. 63 is a left side cross-sectional view of a portion of a finished patio, with a handrail P atop a topmost course of the concrete blocks B and showing a reinforcing strap 180 (in dashed lines for ease of viewing) connected to a block B with a fastener 190B and extending to a male-type connector 80 having the threaded female receptacle 88 to which strap 180 is attached with fastener 190A. With the reinforcing straps 180 having been affixed in place as shown, the remaining wall blocks B may continue to be stacked, and the gravel fill F and paving stones 200 added to finish the raised patio or steps with pedestrian guard. As reinforcing straps 180 are now anchored into the back of respective MSFBs 10, the entire structure provides a significantly higher resisting mass due to the weight of the gravel fill F and the paving stones 200 bearing down onto the MSFB 10.

While the stacking of concrete blocks B atop of each other for forming raised patios and/or steps as described herein is useful, it may be useful for an installer to have the option of hanging one or more facing panels on an exterior of the MSFB 10 as an alternative to stacking concrete blocks B.

Figure 64:
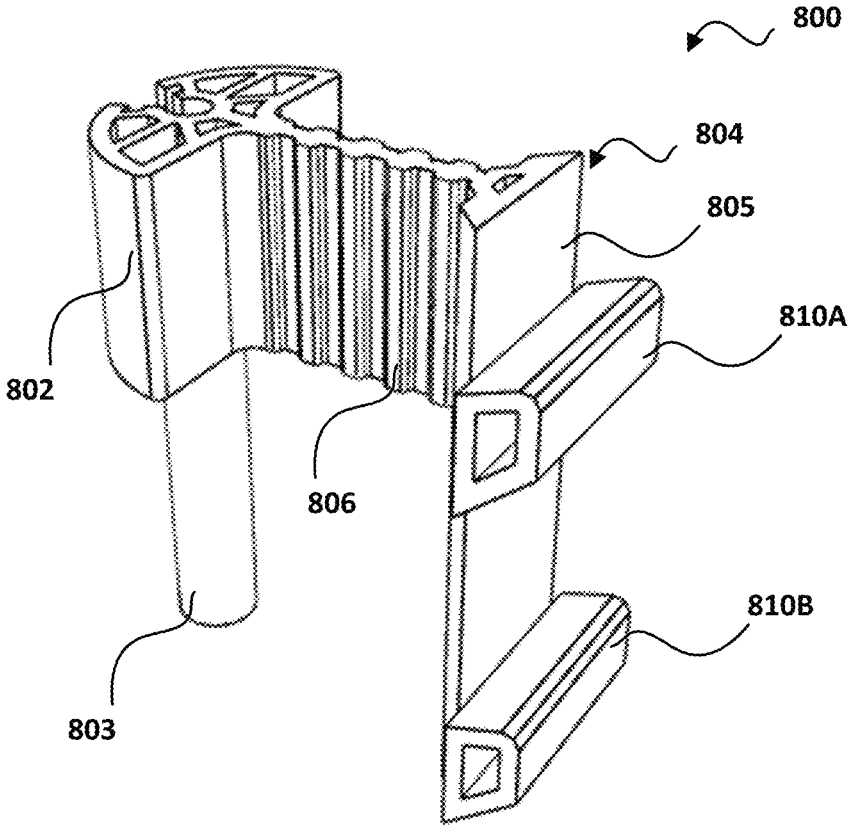
FIG. 64 is a front perspective view of a facing connector, according to an example, that is dimensioned to be received and retained within a female-type lateral interlock interface of an MSFB.

FIG. 64 is a front perspective view of a facing connector 800 that is dimensioned to be received and retained within a female-type lateral interlock interface 40 of MSFB 10 (in lieu, for example, of a male-type connector 80) and to both interface with and support a facing panel placed adjacent to MSFB 10.

In this example, facing connector 800 includes a proximal head 802, a panel interface 804, and a neck 806 or web extending between proximal head 802 and panel interface 804. Facing connector 800 is formed of a rigid material, such as a plastic material, and is of sufficient thickness and material to withstand a degree of lateral and torsional stress without breaking or bending very easily while interface with a facing panel, as will be described. In this example, in order to be used with MSFBs 10, proximal head 802 of facing connector 800 is dimensioned to be received and retained within a respective head socket 42 of a respective female-type lateral interlock interface 40 (see, for example, FIG. 21). Furthermore, neck 806 of facing connector 800 is dimensioned to be received and retained within the respective neck socket 44 of a respective female-type lateral interlock interface 40. Facing connector 800 further includes a cylindrical anchor 803 integral with and extending downwards from proximal head 803 and having a diameter that enables cylindrical anchor 803 to be received within shaft 52. As explained herein, shaft 52 extends downwards into the rigid foam body from head socket 42 of female-type lateral interlock interface 40 as proximal head 802 and neck 806 are pressed from above down into respective portions of female-type lateral interlock interface 40 to seat therein. Retention of cylindrical anchor 803 within a respective shaft 52 is useful for resisting overturning moment of facing connector 800 as the weight of a facing panel is imparted to facing connector as described herein. In this example, proximal head 802 and neck 806 of facing connector 800 have a top to bottom height of about 50 mm, so that these portions of facing connector 800 can be pressed into a respective female-type lateral interlock interface 40 of MSFBs 10 to seat therein without extending above top side 12. As such, proximal head 802 has a semi-circular periphery.

Panel interface 804 of facing connector 800 includes a base 805 that is dimensioned to be received within a respective open-topped channel 70 while proximal head 802 and neck 806 are received within female-type lateral interlock interface 40 and to, once received within the respective open-topped channel 70, sit generally flush with the respective side of MSFB 10.

Panel interface 804 also includes, integral with and extending outward from base 805 in a direction away from proximal head 802 (i.e., extending outward from a respective side of MSFB 10), two parallel rails 810A and 810B, spaced from each other one above the other. Each of rails 810A and 810B appears, when viewed from the side, as upward-facing "hooks" enabling complementary structures of facing panels to engage the hooks from above and be difficult to separate without lifting the facing panels upwards and off of the hooks.

Furthermore, in this example, each of rails 810A and 810B has a left-right width that is greater than the left-right width of base 805. As for rail 810A, its left and right sides extending past the width of base 805 can rest adjacent to or against the respective side of MSFB 10 while base 805 itself is received within the respective open-topped channel 70. As for rail 810B, which extends from a point along base 805 that is lower than rail 810A and adjacent to the respective cavity 50, its left and right sides extending past the width of base 805 may extend as far as and beyond the left and right sides of cavity 50, or may extend a lesser amount. Rails 810A and 810B have, in this embodiment, the same left-right length. However, in alternative examples rails 810A and 810B may have different left-right lengths.

Figure 65:
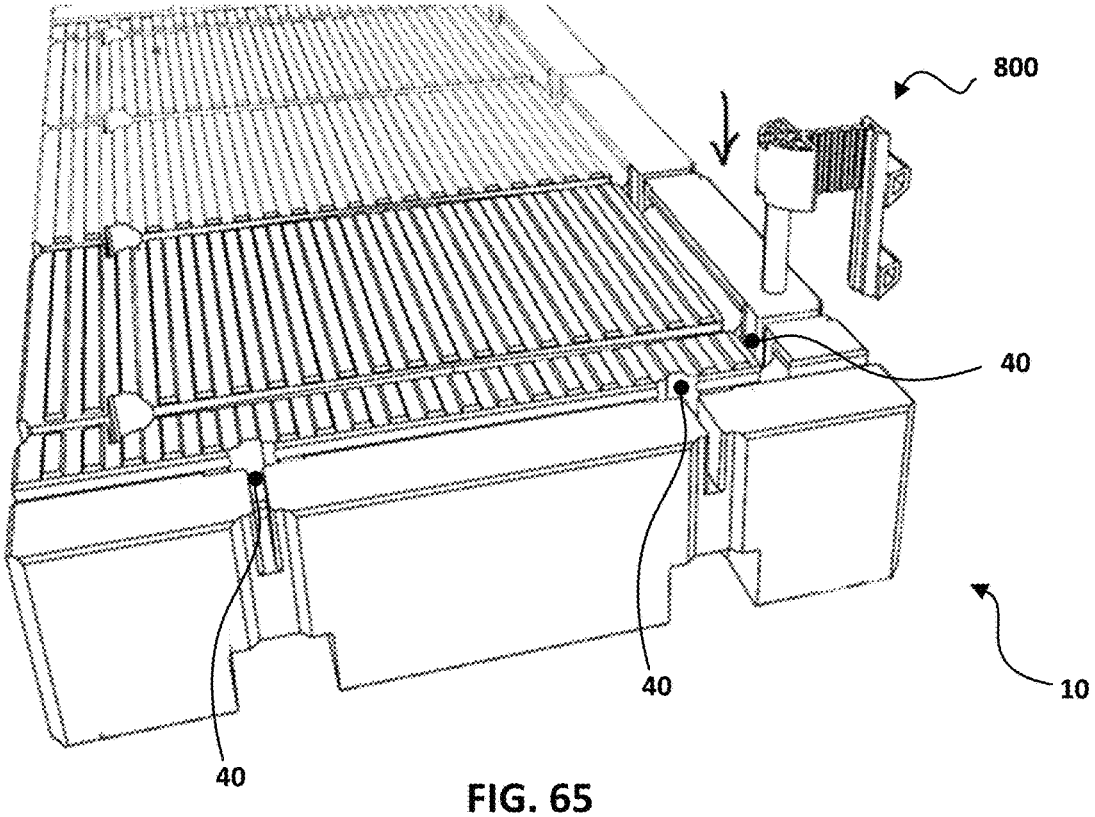
FIG. 65 is a second side perspective view of part of an MSFB with a facing connector poised above a respective female-type lateral interlock interface to be received and retained therein.
Figure 66:
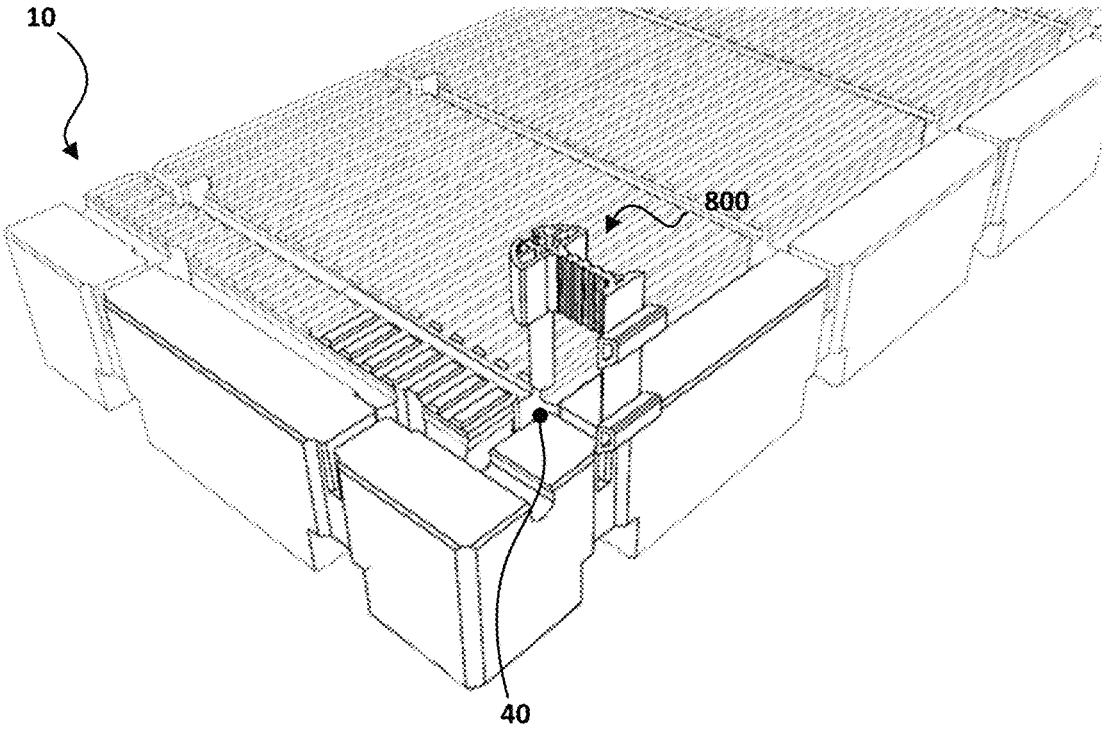
FIG. 66 is a front side perspective view of part of the MSFB of FIG. 65 with the facing connector poised as in FIG. 65.

FIG. 65 is a second side perspective view of part of an MSFB 10 with a facing connector 800 poised above a respective female-type lateral interlock interface 40 to be received and retained therein. FIG. 66 is a front side perspective view of part of the MSFB 10 of FIG. 65 with the facing connector 800 poised as in FIG. 65.

Figure 67:
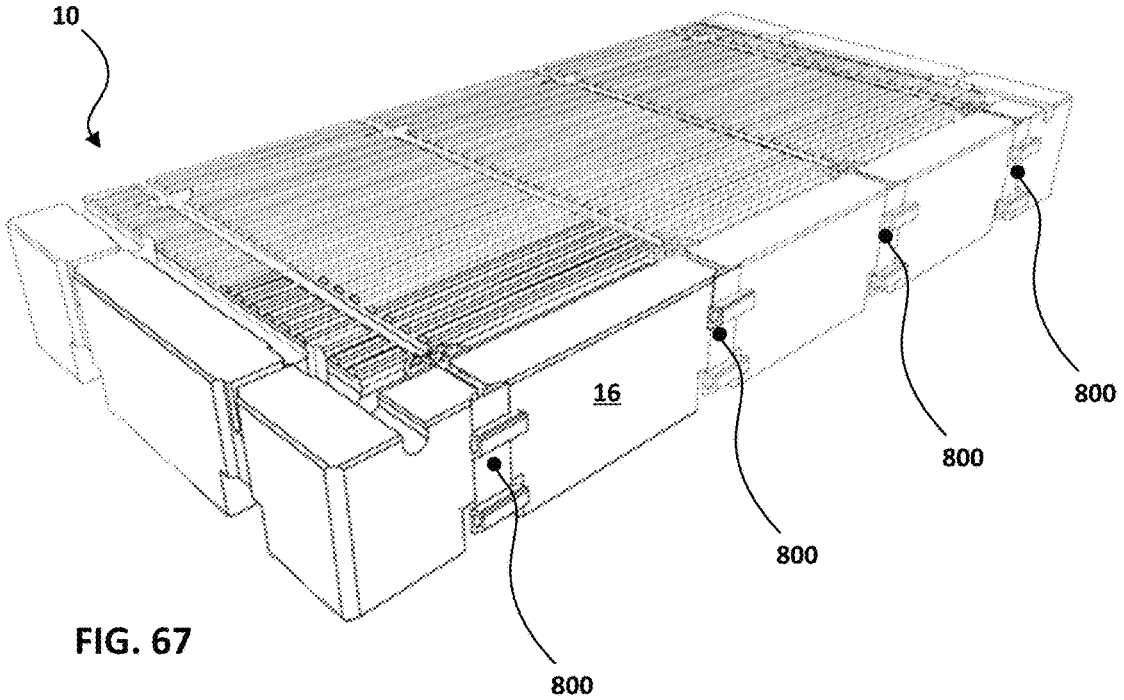
FIG. 67 is a front side perspective view of an MSFB with four (4) facing connectors received and retained within respective female-type lateral interlock interfaces along a front side of the MSFB and presenting respective rails extending from the front side.

FIG. 67 is a front side perspective view of MSFB 10 with four (4) facing connectors 800 received and retained within respective female-type lateral interlock interfaces 40 along front side 16 and presenting respective rails 810A, 810B extending from front side 16.

Figure 68:
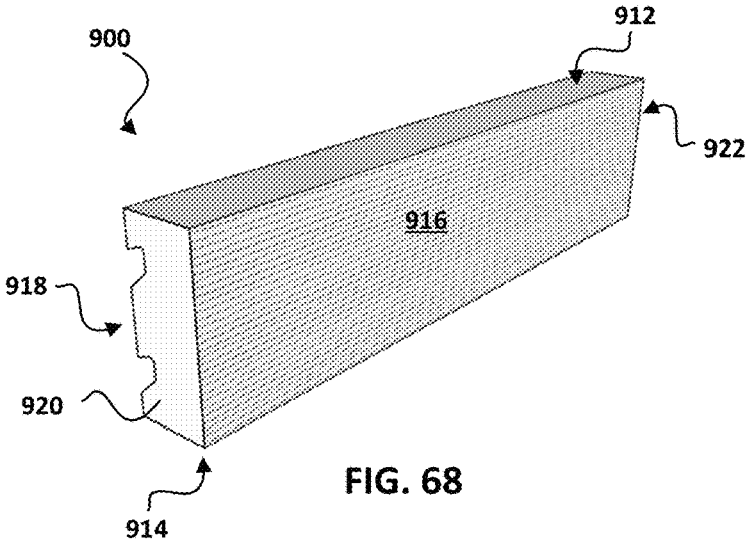
FIG. 68 is a front side perspective view of a facing panel that may interface with panel interfaces of multiple facing connectors by hanging facing panel onto rails.
Figure 69:
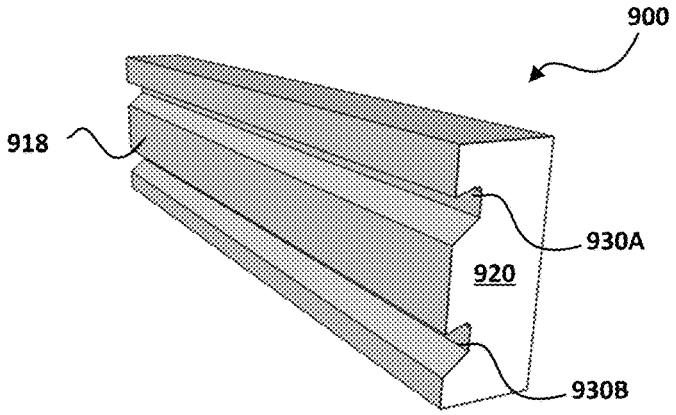
FIG. 69 is a rear side perspective view of a facing panel.

FIG. 68 is a front side perspective view of a facing panel 900 that may interface with panel interfaces 804 of multiple facing connectors 800 by hanging facing panel 900 onto rails 810A, 810B as will be described. FIG. 69 is a rear side perspective view of facing panel 900.

In this example, facing panel 900 includes a rigid body having a top side 912 and a bottom side 914 opposite top side 912, a front side 916 and a rear side 918 opposite front side 916, and a first (left) side 920 and a second (right) side 922 opposite first side 920. Facing panel 900 is generally rectangular in cross-section (when viewed, for example, from any of its sides), but includes, extending along rear side 918 between first side 920 and second side 922, two grooves 930A, 930B spaced from each other one above the other and running parallel to one other. When viewed from, for example, first side 920, each of grooves 930A has an upward-facing "hook" cross-sectional shape (female) that is complementary to the upward-facing "hook" cross-sectional shape (male) of the rails 810A, 810B. Grooves 930A, 930B may therefore receive respective ones of rails 810A, 810B to hang facing panel 900 onto one or more sets of rails 810A, 810B. Bringing facing panel 900 adjacent to facing connectors 800 would be done by bringing facing panel 900 towards facing connectors 800 and downwards, so that the upward hook-shaped grooves 930A, 930B of facing panel 900 receive the upward hook-shaped rails 810A, 810B of facing connectors 800. In this way, facing panel 900 may be hung alongside MSFBs 10.

Figure 70:
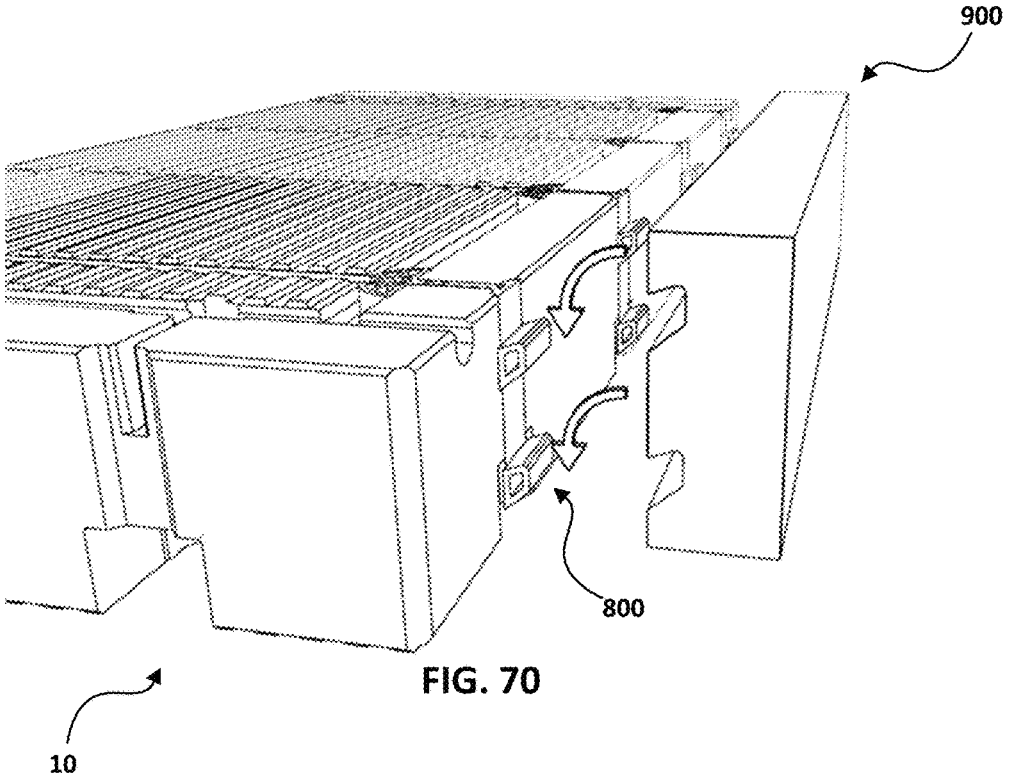
FIG. 70 is a first side perspective view of a facing panel being hung on rails of multiple facing connectors that have been received and retained within an MSFB.
Figure 71:
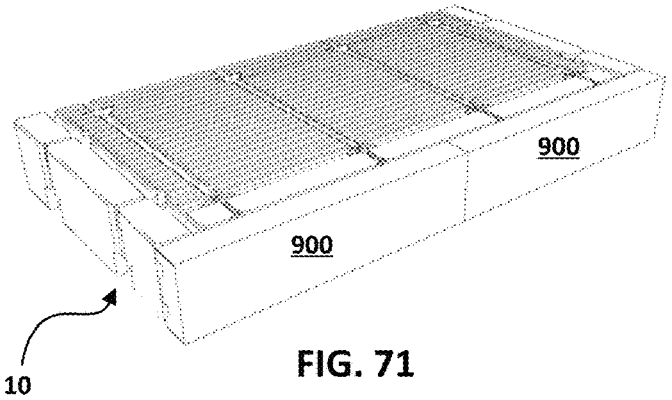
FIG. 71 is a front perspective view of two facing panels having been hung on the front side of an MSFB.
Figure 72:
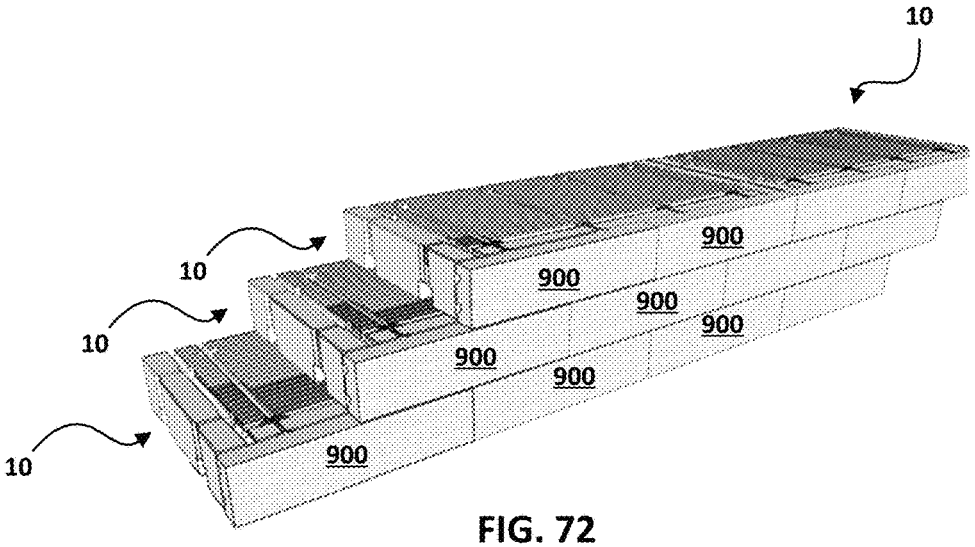
FIG. 72 is a front perspective view of multiple facing panels having been hung in a similar manner to that shown in FIG. 71, on respective MSFBs which are, in turn, stacked atop of each other in a step configuration.

FIG. 70 is a first side perspective view of a facing panel 900 being hung on rails 810A, 810B of multiple facing connectors 800 that have been received and retained within MSFB 10 as described herein. FIG. 71 is a front perspective view of two facing panels 900 having been hung on the front side 12 of MSFB 10. FIG. 72 is a front perspective view of multiple facing panels 900 having been hung in a similar manner to that shown in FIG. 71, on respective MSFBs 10 which are, in turn, stacked atop of each other in a step configuration as described herein.

The weight of a facing panel 900 imparts downward pressure on respective facing connectors 800, and the pulling forward of facing connectors 800 under influence of this downward pressure is resisted by the retention of proximal head 802 and neck 806 being retained within female-type lateral interlock interface 40 and the long cylindrical anchor 803 being retained with a respective shaft 52. The combined resistance provided by multiple facing connectors 800 received within multiple female-type lateral interlock interfaces 40 and shafts 52 provides a stable hanging surface for facing panels 900.

In this example, facing panel 900 is formed of concrete, but in alternative examples facing panel 900 may be formed of one or more other materials suitable for hardscape construction. Various configurations and aesthetic designs of facing panels may interface in a similar manner as facing panel 900 with panel interfaces 804 of facing connectors 800.

While examples have been described, alternatives are possible.

Clauses

Clause 1. A stackable interlocking support block comprising:

a rigid foam body comprising:

a top side and a bottom side opposite the top side;

a front side and a rear side opposite the front side; and a first side and a second side opposite the first side;

a geogrid interface integral with the top side and comprising:

an apron having an outer periphery that is adjacent to the first side, the front side, and the second side, the apron having an inner periphery spaced from the outer periphery; and a channel adjacent to and extending along the inner periphery of the apron, the channel having an open top; and a vertical interlock system integral with the rigid foam body and comprising:

a top side interlocking structure associated with the top side and comprising, from the channel to the rear side, a first plurality of ridges each parallel to the front side and having a front-rear depth of Wk, each of the first plurality of ridges spaced from each other by a gap having a front-rear depth of Wg; and a bottom side interlocking structure associated with the bottom side and comprising, from the front side to the rear side, a second plurality of ridges each parallel to the front side and having the front-rear depth of Wk, each of the second plurality of ridges spaced from each other by a gap having the front-rear depth of Wg.

Clause 2. The stackable interlocking support block of clause 1, wherein the apron comprises:

a left apron portion adjacent to the first side and extending between the front side and the rear side;

a right apron portion adjacent to the second side and extending between the front side and the rear side; and a front apron portion adjacent to the front side and extending between the left apron portion and the right apron portion.

Clause 3. The stackable interlocking support block of clause 2, wherein the channel comprises:

a left channel portion extending along the left apron portion at least from the rear side to the front apron portion;

a right channel portion extending along the right apron portion at least from the rear side to the front apron portion; and a front channel portion extending along the front apron portion at least from the left channel portion to the right channel portion.

Clause 4. The stackable interlocking support block of clause 1, further comprising:

one or more female-type lateral interlock interface, each female-type lateral interlock interface associated with a respective one of the front side, the rear side, the first side and the second side, and extending partially into the rigid foam body from the top side.

Clause 5. The stackable interlocking support block of clause 4, wherein each female-type lateral interlock interface comprises:

a head socket spaced from the respective side; and a neck socket extending from the head socket to the respective side.

Clause 6. The stackable interlocking support block of clause 5, further comprising:

for each of the one or more female-type lateral interlock interfaces, a cavity in vertical alignment with the female-type lateral interlock interface, each cavity being open to, and extending partially into the rigid foam body from, both the bottom side of the rigid foam body and the respective one of the first side, second side, front side and rear side with which the female-type lateral interlock interface is associated.

Clause 7. The stackable interlocking support block of clause 5, further comprising:

for each of the female-type lateral interlock interfaces, a shaft extending downwards through the rigid foam body from the head socket, the shaft being open to the bottom side.

Clause 8. The stackable interlocking support block of clause 7, wherein:

the one or more female-type lateral interlock interfaces comprises one or more female-type lateral interlock interface associated with the front side and one or more female-type lateral interlock interface associated with the rear side, wherein each of the one or more female-type lateral interlock interfaces associated with the front side is in lateral alignment with a respective one of the one or more female-type lateral interlock interfaces associated with the rear side.

Clause 9. The stackable interlocking support block of clause 8, further comprising:

one or more open-topped conduit associated with the top side, each open-topped conduit extending along the top side of the rigid foam body from a respective female-type lateral interlock interface associated with the front side to a respective laterally-aligned female-type lateral interlock interface associated with the rear side, each open-topped conduit being in fluid communication with the gaps between the first plurality of parallel ridges.

Clause 10. The stackable interlocking support block of clause 9, further comprising:

one or more open-topped conduit associated with each of the front side, the rear side, the first side and the second side, each open-topped conduit extending from the top side to the bottom side.

Clause 11. The stackable interlocking support block of clause 1, wherein:

the open top of the channel is narrower than a maximum width of the channel.

Clause 12. The stackable interlocking support block of clause 11, wherein:

the channel is semi-circular in cross-section.

Clause 13. A support system for assembling a hardscape patio or hardscape stairs, the support system comprising:

a plurality of the stackable interlocking support block of clause 5; and at least one male-type connector for laterally interlocking a respective laterally-adjacent pair of the stackable interlocking support block in a respective course, each of the at least one male-type connector being dimensioned to be retained simultaneously within (a) a female-type lateral interlock interface of a first of the laterally-adjacent stackable interlocking support blocks in the pair and (b) a female-type lateral interlock interface of a second of the laterally-adjacent stackable interlocking support blocks in the pair.

Clause 14. The support system of clause 13, wherein each male-type connector comprises:

a proximal head;

a distal head; and a neck extending between the proximal head and the distal head, wherein:

each of the proximal head and the distal head is dimensioned to be retained within a respective head socket of a respective female-type lateral interlock interface, and the neck is dimensioned to be retained within the respective neck sockets of both of the respective female-type lateral interlock interfaces.

Clause 15. The support system of clause 14, wherein each of the proximal head and the distal head comprises:

a threaded female receptacle dimensioned to receive a threaded fastener.

Clause 16. A stair system comprising:

a box formed at least partially by a plurality of retaining wall blocks;

the support system of clause 13 in an interior of the box; and a plurality of step blocks and/or landing blocks supported by the support system.

Clause 17. A patio system comprising:

a box formed at least partially by a plurality of retaining wall blocks;

the support system of clause 13 in an interior of the box; and a plurality of paving stones supported by the support system.

Clause 18. A male-type connector for horizontally interlocking a plurality of stackable interlocking support blocks, the male-type connector comprising:

a proximal head;

a distal head;

a neck extending between the proximal head and the distal head;

a first threaded female receptacle in the proximal head and dimensioned to receive a respective threaded fastener; and a second threaded female receptacle in the distal head and dimensioned to receive a respective threaded fastener.

Clause 19. The male-type connector of clause 18, wherein the proximal head and the distal head are mirror images of one another across the neck.

Clause 20. The male-type connector of clause 18, wherein each of the proximal head and the distal head has a semi-circular periphery.

What is claimed is:

1. A stackable interlocking support block comprising:

a rigid foam body comprising:

a top side and a bottom side opposite the top side;

a front side and a rear side opposite the front side; and a first side and a second side opposite the first side;

a geogrid interface integral with the top side and comprising:

an apron having an outer periphery that is adjacent to the first side, the front side, and the second side, the apron having an inner periphery spaced from the outer periphery; and a channel adjacent to and extending along the inner periphery of the apron, the channel having an open top;

and a vertical interlock system integral with the rigid foam body and comprising:

a top side interlocking structure associated with the top side and comprising, from the channel to the rear side, a first plurality of ridges each parallel to the front side and having a front-rear depth of Wk, each of the first plurality of ridges spaced from each other by a gap having a front-rear depth of Wg; and a bottom side interlocking structure associated with the bottom side and comprising, from the front side to the rear side, a second plurality of ridges each parallel to the front side and having the front-rear depth of Wk, each of the second plurality of ridges spaced from each other by a gap having the front-rear depth of Wg.

2. The stackable interlocking support block of claim 1, wherein the apron comprises:

a left apron portion adjacent to the first side and extending between the front side and the rear side;

a right apron portion adjacent to the second side and extending between the front side and the rear side; and a front apron portion adjacent to the front side and extending between the left apron portion and the right apron portion.

3. The stackable interlocking support block of claim 2, wherein the channel comprises:

a left channel portion extending along the left apron portion at least from the rear side to the front apron portion;

a right channel portion extending along the right apron portion at least from the rear side to the front apron portion; and a front channel portion extending along the front apron portion at least from the left channel portion to the right channel portion.

4. The stackable interlocking support block of claim 1, further comprising:

one or more female-type lateral interlock interface, each female-type lateral interlock interface associated with a respective one of the front side, the rear side, the first side and the second side, and extending partially into the rigid foam body from the top side.

5. The stackable interlocking support block of claim 4, wherein each female-type lateral interlock interface comprises:

a head socket spaced from the respective side; and a neck socket extending from the head socket to the respective side.

6. The stackable interlocking support block of claim 5, further comprising:

for each of the one or more female-type lateral interlock interfaces, a cavity in vertical alignment with the female-type lateral interlock interface, each cavity being open to, and extending partially into the rigid foam body from, both the bottom side of the rigid foam body and the respective one of the first side, second side, front side and rear side with which the female-type lateral interlock interface is associated.

7. The stackable interlocking support block of claim 5, further comprising:

for each of the female-type lateral interlock interfaces, a shaft extending downwards through the rigid foam body from the head socket, the shaft being open to the bottom side.

8. The stackable interlocking support block of claim 7, wherein:

the one or more female-type lateral interlock interfaces comprises one or more female-type lateral interlock interface associated with the front side and one or more female-type lateral interlock interface associated with the rear side, wherein each of the one or more female-type lateral interlock interfaces associated with the front side is in lateral alignment with a respective one of the one or more female-type lateral interlock interfaces associated with the rear side.

9. The stackable interlocking support block of claim 8, further comprising:

one or more open-topped conduit associated with the top side, each open-topped conduit associated with the top side extending along the top side of the rigid foam body from a respective female-type lateral interlock interface associated with the front side to a respective laterally-aligned female-type lateral interlock interface associated with the rear side, each open-topped conduit associated with the top side being in fluid communication with the gaps between the first plurality of parallel ridges.

10. The stackable interlocking support block of claim 9, further comprising:

one or more open-topped conduit associated with each of the front side, the rear side, the first side and the second side, each open-topped conduit associated with each of the front side, the rear side, the first side and the second side extending from the top side to the bottom side.

11. The stackable interlocking support block of claim 1, wherein:

the open top of the channel is narrower than a maximum width of the channel.

12. The stackable interlocking support block of claim 11, wherein:

the channel is semi-circular in cross-section.

* * * * *